US005698354A

United States Patent [19]

Ugai et al.

[11] Patent Number: 5,698,354

[45] Date of Patent: Dec. 16, 1997

[54] IMAGE-FORMING METHOD AND IMAGE-FORMING APPARATUS

[75] Inventors: Toshiyuki Ugai, Kawasaki; Tatsuya Nakamura, Tokyo, both of Japan

[73] Assignee: Canon Kabushiki Kaisha, Tokyo, Japan

[21] Appl. No.: 599,079

[22] Filed: Feb. 9, 1996

[30] Foreign Application Priority Data

Feb. 10, 1995 [JP] Japan ..... 7-045113

[51] Int. Cl.[6] ..... G03G 13/01

[52] U.S. Cl. ..... 430/45; 430/47; 430/111; 430/126

[58] Field of Search ..... 430/45, 47, 126

[56] References Cited

U.S. PATENT DOCUMENTS

| | | | |
|---|---|---|---|
| 4,162,843 | 7/1979 | Inoue et al. | 430/42 |
| 4,968,577 | 11/1990 | Kohri et al. | 430/111 |
| 5,260,159 | 11/1993 | Ohtani et al. | 430/111 |
| 5,281,504 | 1/1994 | Kanbayashi et al. | 430/99 |
| 5,305,061 | 4/1994 | Takama et al. | 430/111 |
| 5,510,222 | 4/1996 | Inaba et al. | 430/109 |
| 5,547,797 | 8/1996 | Anno et al. | 430/111 |

FOREIGN PATENT DOCUMENTS

| | | |
|---|---|---|
| 36-10231 | 7/1961 | Japan . |
| 53-74037 | 7/1978 | Japan . |
| 56-13945 | 4/1981 | Japan . |
| 59-53856 | 3/1984 | Japan . |
| 59-61842 | 4/1984 | Japan . |

OTHER PUBLICATIONS

"The Glass Transition Temperature of Polymers", W.A. Lee et al., Polymer Handbook, 2nd Edition, III–P139–192, John Wiley & Sons Co.

*Primary Examiner*—Roland Martin

*Attorney, Agent, or Firm*—Fitzpatrick, Cella, Harper & Scinto

[57] ABSTRACT

An image-forming method is comprised of delivering a transfer-receiving medium to a first image-forming unit, forming a first toner image by a first image-forming means of the first image-forming unit, transferring the first toner image onto the transfer-receiving medium at a first transfer section of the first image-forming unit with a first transfer bias applied, and delivering the transfer-receiving medium to a second image-forming unit. Forming a second toner image by a second image-forming means of the second image-forming unit, transferring the second toner image onto the transfer-receiving medium carrying the first toner image at a second transfer section of the second image-forming unit with a second transfer bias applied, fixing the first toner image and the second toner image transferred on the transfer-receiving medium by a fixing means. The length of the transfer-receiving medium in the direction in which the transfer-receiving medium is conveyed is larger than the spacing between the first transfer section and the second transfer section. The intensity of the second transfer bias is different from the intensity of the first transfer bias. A first toner for forming the first toner image and a second toner for forming the second toner image both have shape factors of SF-1 ranging from 100 to 180 and SF-2 ranging from 100 to 140.

41 Claims, 10 Drawing Sheets

IMAGE-FORMING METHOD AND IMAGE-FORMING APPARATUS

BACKGROUND OF THE INVENTION

1. Field of the Invention

The present invention relates to an image forming method, and an apparatus therefor. In particular, the present invention relates to an image-forming method applicable to a color electrophotographic machine such as a color printer or a color copying machine in which plural image-holding members such as electrophotographic photosensitive members are employed, a color toner image is formed on the respective image-holding members in different colors, the respective formed toner images are transferred successively onto one and the same image-receiving medium, and the transfer image is fixed on the image-receiving medium. The present invention also relates to an image-forming apparatus for the above image-forming method.

2. Related Background Art

Various color image-forming apparatuses are disclosed which have plural image-forming sections, form different color toner images in the respective image-forming sections, and transfer the toner images successively onto one and the same image-receiving member. Of the color image-forming apparatuses, most widely used are color-recording apparatuses employing a multi-color electrophotographic system.

A typical conventional electrophotographic color recording apparatus has a constitution shown in FIG. 13, and is provided with an image-forming section in the main body of the apparatus. The image-forming section comprises a latent image-holding member (a photosensitive drum) 501, end around the image-holding member, there are provided a light-projecting lamp 521, a drum electrifier 502, and a polygon mirror 517 for scanning with a light beam projected from a light source not shown in the drawing. Scanning is carried out with a laser beam emitted from a light source not shown in the drawing while rotating of the polygon mirror 517, and the scanning light beam deflected by the reflection mirror is condensed through an fθ lens onto a generatrix of the photosensitive member 501 to form an electrostatic latent image in accordance with image signals.

A rotational developing device 503 comprises a yellow developing device 503*a*, a magenta developing device 503*b*, a cyan developing device 503*c*, and a black developing device 503*d*. The developing devices 503*a*, 503*b*, 503*c*, and 503*d* are filled respectively with a prescribed amount of a toner of a color of cyan (referred to as "C"), magenta (referred to as "M"), yellow (referred to as "Y"), or black (referred to as "K") by a feeding apparatus not shown in the drawing.

In formation of a color image, a color toner image for the color of the toner is formed on the respective photosensitive drums by the light beam from the original filtrated through a color separation filter complementary to the color. Then the developing device for the respective colors forms a visible image on the photosensitive drum 501. A transfer-receiving medium 506 as a recording medium in a recording-medium cassette 560 is held electrostatically on a transfer-receiving medium holder 508 which rotates synchronously with the photosensitive drum 501, whereby the visible image is transferred onto the transfer-receiving medium in a visible image transfer section by e transfer-electrifying means 504. This process is repeated for the respective colors successively, and while adjusting registration, the toner images are superposed on one and the same recording medium. After completion of the above process, the recording medium 506 is separated from the recording medium holder 508 by a separating nail, and is sent to a fixing section 507. In the fixing section, the recording medium 506 carrying the toner image is allowed to pass through a gap between a fixing roller 571 and a pressing roller 572 to be heated and pressed to form a final full color image by one fixation operation. The toner particles remaining on the photosensitive drum 501 without transferred to the transfer-receiving medium are removed by a cleaning device 505.

Such an image-forming apparatus which has one image-forming section in the main body has an advantage that is compact, but has a disadvantage that its printing speed is low owing to the necessity of three or four times of repetition of electrostatic image formation.

To overcome the disadvantage, an image-forming apparatus was disclosed which has plural photosensitive member, and successively multi-transfers formed toner images onto a transfer-receiving medium delivered by a belt type delivery means, thereby increasing the speed of color image formation; for example, in Japanese Patent Laid-Open Application No. 53-74037 (corresponding to U.S. Pat. No. 4,162,843). With this apparatus, a full color image can be formed by one passage of a transfer-receiving medium. Thereby the printing speed is greatly increased advantageously, but the apparatus becomes larger and is difficult to make compact (or miniaturize).

To miniaturize the above-mentioned image-foaming apparatus which conducts successively multiple transfer of the toner images onto a image-receiving medium on a conveying belt by use of plurality of photosensitive members, one measure is to decrease the diameter of the photosensitive drum and to shorten the spacing between the photosensitive drums. However, the shortening of the spacings of the photosensitive drums causes other problems as follows.

That is, in the case where toner images each having different colors are transferred in sequence onto a transfer-receiving medium to form a full color image, the transfer bias output applied to the first transfer section is set to be higher than the transfer bias output applied to the second transfer section, and because of the presence of The first toner image on the transfer-receiving medium and for the reason that since the transfer bias is applied at the first transfer section from the back surface side of the transfer receiving-medium, the front surface side of the transfer-receiving medium comes to have the charge opposite to the charge applied by the transfer bias, the transfer bias substantially applied to the second toner image at the second transfer section is reduced so that transfer efficiency is reduced.

When, as stated above, the transfer bias output applied to the second transfer section is set to be higher than the transfer bias output applied to the first transfer section, for example, if the spacing between the first and second transfer mediums is set to be shorter than the length of the transfer medium in the direction in which the transfer medium is conveyed for the purpose of miniaturizing the main body of the image-forming apparatus, due to the difference between the transfer bias outputs applied to the first and second sections, before transfer of the first toner image is completed, transfer of the second toner image at the second transfer section is started, and before transfer of the second toner image is completed, transfer of the second toner image at the second transfer section is started, in particular, whereby the problem that the transfer state of the second toner image at the second transfer section is varied between before and after the transfer-receiving medium passes through the first transfer section, is liable to rise.

This is presumably due to the fact that the paper sheet as the transfer-receiving medium becomes humid under the high temperature and high humidity conditions to have lower electric resistance, and therefore, the transfer bias applied to the second transfer section leaks through the transfer-receiving medium having the lowered resistance to the first transfer section where the applied transfer bias is lower until the entire transfer-receiving medium have passed through the first transfer section. Thereby the transfer bias substantially applied to the second toner image at the second transfer section becomes lower than the prescribed level. After the transfer-receiving medium has passed through the first transfer section, the leak of the transfer bias from the second transfer section to the first transfer section ceases, whereby the substantially applied transfer bias at the second transfer section comes to be approximate to the prescribed level. Thus, the substantial transfer bias applied to the transfer-receiving medium varies at the second transfer section varies during and after the passage of the transfer-receiving medium through the first transfer section, which causes variation of the state of the toner image transfer at the second transfer section.

This disadvantage is more remarkable with a shorter spacing between the first transfer section and the second transfer section, particularly remarkable with the spacing of less than 110 mm.

Therefore, conventional apparatuses cannot be made compact without impairing the image quality since the spacings between the photosensitive drums are set at such a certain level that the above disadvantages is substantially inhibited.

OBJECTS OF THE INVENTION

An object of the present invention is to provide an image-forming method which does not involve the above problems, and an image-forming apparatus therefor.

Another object of the present invention is to provide an image-forming method for forming a full color image by use of a small and high-speed image-forming apparatus, and to provide an apparatus therefor.

A further object of the present invention is to provide an image-forming method for forming images with high image quality without variation of color tone independently of the environmental conditions of temperature and humidity.

SUMMARY OF THE INVENTION

It has been discovered that the foregoing objects can be realized by providing an image-forming method which comprises the steps of delivering a transfer-receiving medium to a first image-forming unit, forming a first toner image by a first image-forming means of the first image-forming unit, transferring the first toner image onto the transfer-receiving medium at a first transfer section of the first image-forming unit with a first transfer bias applied, delivering the transfer-receiving medium to a second image-forming unit, forming a second toner image by a second image-forming means of the second image-forming unit, transferring the second toner image onto the transfer-receiving medium carrying the first toner image at a second transfer section of the second image-forming unit with a second transfer bias applied, fixing the first toner image and the second toner image transferred on the transfer-receiving medium by a fixing means, wherein the length of the transfer-receiving medium in the direction in which the transfer-receiving medium is conveyed is larger than the spacing between the first transfer section and the second transfer section, the intensity of the second transfer bias is different from the intensity of the first transfer bias, and a first toner for forming the first toner image and a second toner for forming the second toner image both have shape factors of SF-1 ranging from 100 to 180 and SF-2 ranging from 100 to 140.

The present invention also provides an image-forming apparatus which comprises: (i) a first image-forming unit having a first toner image-forming means for forming a first toner image, and a first transfer means for transferring the first toner image formed by the first image forming-unit onto a transfer-receiving medium at a first transfer section with a first transfer bias applied; (ii) a second image-forming unit having a second toner image-forming means for forming a second toner image, and a second transfer means for transferring the second toner image formed by the second image-forming means onto the transfer-receiving medium at a second transfer section with a second transfer bias applied; (iii) a fixing means for fixing the first toner image and the second toner image on the transfer-receiving medium; and (iv) a delivering means for delivering the transfer-receiving means successively through the first image-forming unit, the second image-forming unit, and the fixing means, wherein the length of the transfer-receiving medium in the direction in which the transfer-receiving medium is conveyed is larger than the spacing between the first transfer section for transferring the first toner image and the second transfer section for transferring the second toner image, the intensity of the second transfer bias is different from the intensity of the first transfer bias, and a first toner for forming the first toner image and a second toner for forming the second toner image both have shape factors of SF-1 ranging from 100 to 180 and SF-2 ranging from 100 to 140.

DESCRIPTION OF THE PREFERRED EMBODIMENTS

Figure 1:
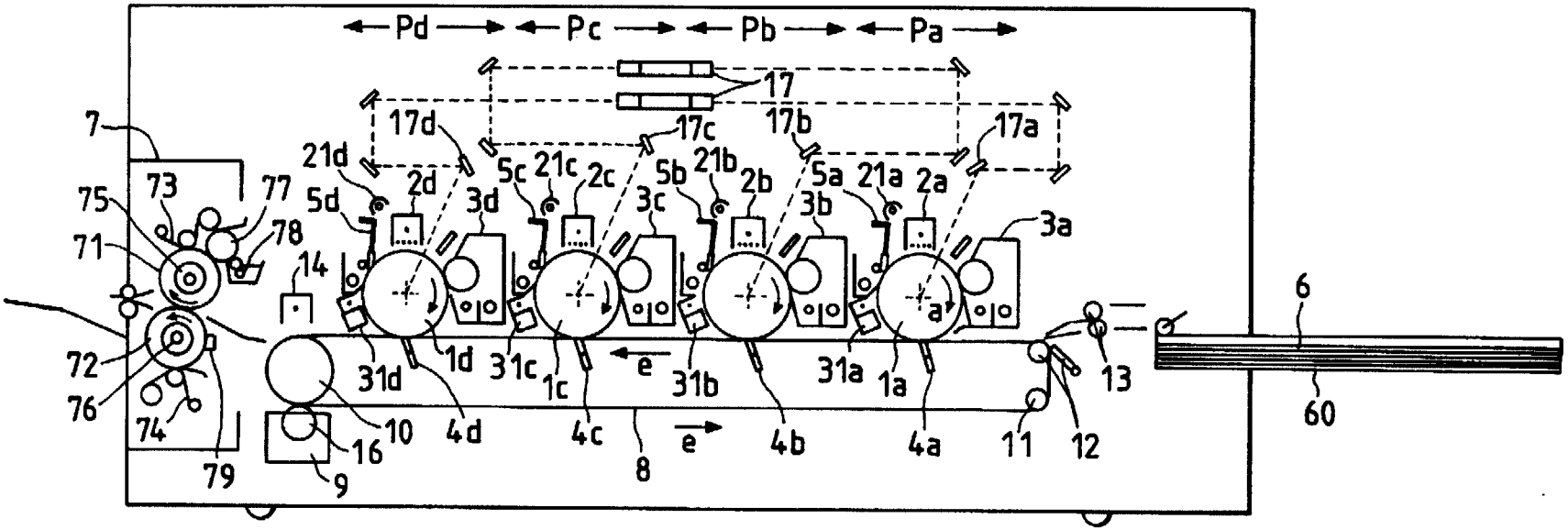
FIG. 1 is a schematic drawing for illustrating a first embodiment of practicing the image-forming method of the present invention.

After comprehensive investigation, the inventors of the present invention has found that in an image-forming method which comprises steps of delivering a transfer-receiving medium to a first image-forming unit, forming a first toner image by a first image-forming means of the first image-forming unit, transferring the first toner image onto the transfer-receiving medium at a first transfer section of the first image-forming unit with a first transfer bias applied, and delivering the transfer-receiving medium to a second image-forming unit. Forming a second toner image by a second image-forming means of the second image-forming unit, transferring the second toner image onto the transfer-receiving medium carrying the first toner image at a second transfer section of the second image-forming unit with a second transfer bias applied. Fixing the first toner image and the second toner image transferred on the transfer-receiving medium by a fixing means, when the length of the transfer-receiving medium in the direction in which the transfer-receiving medium is conveyed is larger than the spacing between the first transfer section and the second transfer section, the intensity of the second transfer bias is different from the intensity of the first transfer bias, the use of the toner with the shape factors of SF-1 ranging from 100 to 180 and SF-2 ranging from 100 to 140. is effective to solve the above mentioned problems.

That is, the use of the toner having shape factors of SF-1 ranging from 100 to 180 and SF-2 ranging from 100 to 140 broaden the latitude of the transfer bias since the toner having the above shape factors is transferred satisfactorily with high transfer efficiency. Therefore, even if the spacing between the transfer sections is smaller than the length of the transfer-receiving medium in the direction of its conveyance, preferably 110 mm or less, more preferably 100 mm or less for miniaturization of the entire image-forming apparatus, the toner transfer efficiency varies less at the second transfer section regardless of variation of the transfer bias applied to the second toner being transferred at the second transfer section before and after the passage of the transfer-receiving medium through the first transfer section, even at high temperature and high humidity. Further, even if the transfer bias output at the second transfer section is set to be lower than that for the most desired transfer efficiency, and the difference between the transfer bias outputs at the first transfer section and that at the second transfer section is made smaller to such a level that the transfer bias substantially applied to the toner being transferred at the second transfer section is not varied before and after passage of the-transfer-receiving medium through the first transfer section at high temperature and high humidity, the toner transfer efficiency at the second transfer section is less lowered, which results in less variation in the transfer state before and after the passage of the transfer-receiving medium through the first transfer section, formation of uniform image on one and the same sheet of the transfer-receiving medium, and less variation of color tone of the color image formed at ordinary temperature and ordinary humidity and at high temperature and high humidity. Thereby, the main body of the image-forming apparatus can be made more compact.

Further, the toner having the specified shape factors employed in the present invention has excellent lubricity. Therefore the friction is low between the surface of the photosensitive member and the cleaning member in a cleaning process in which a cleaning member is brought into contact with the photosensitive member surface, whereby abrasion of the photosensitive member surface is retarded and a photosensitive drum of a smaller diameter can be employed.

Furthermore, the toner having the specified shape factors employed in the present invention enables prevention of re-transfer of the first transferred toner image from the transfer-receiving medium to the latent image-holding photosensitive member in the second image-forming unit.

In particular, as described above, by lowering the second transfer bias at the second transfer section, the re-transfer of the first toner image having been transferred onto the transfer receiving medium can be prevented. Therefore, the re-transfer is effectively prevented by synergistic effect of the toner shape and the lower transfer bias in the second transfer section.

The toner having the specified shape factors of the present invention exhibits excellent transfer efficiency as described above. Therefore the cleaner for recovering the toner remaining on the photosensitive member after the toner transfer can be made smaller, and an image-forming method of development-and-cleaning system is practicable in which the developing means simultaneously serves as the cleaning means for recovering the remaining toner and cleaning the photosensitive member, eliminating necessity of a separate cleaner for recovery of the remaining toner after the toner transfer. Thus the image-forming apparatus can be made more compact.

The toner in the present invention has a shape factor SF-1 ranging from 100 to 180, preferably from 100 to 160, more preferably from 100 to 140, and a shape factor SF-2 ranging from 100 to 140, preferably from 100 to 135, more preferably from 100 to 120.

The toner of the shape factor SF-1 of higher than 180 or the shape factor SF-2 of higher than 140 tends to cause a lower toner transfer efficiency, a higher toner re-transfer ratio, and increased abrasion of the surface of the latent image-holding member.

The shape factors SF-1 and SF-2 in the present invention are measured for 100 toner particles selected at random by means of FE-SEM (Model S-800, Hitachi Ltd.) at a magnification ratio of from 1,000 to 3,000, and the image information is introduced through an interface to an image analysis apparatus (Model Luzex 3, Nicole K.K.) to analyze the image information. The shape factors SF-1 and SF-2 are defined by the equations below:

$$SF\text{-}1 = \frac{(MXLNG)^2}{\text{AREA}} \times \frac{\pi}{4} \times 100$$

$$SF\text{-}2 = \frac{(PERI)^2}{\text{AREA}} \times \frac{1}{4\pi} \times 100$$

where AREA is a projected area of toner, MXLNG is absolute maximum length, and PERI is periphery length.

The toner having specified shape factors has lubricity to retard the abrasion of the surface of the photosensitive member, and exhibits high transfer efficiency with prevention of re-transfer because of he reasons below.

The shape factor SF-1 shows the degree of spherality of the toner. With increase of the SF-1 value from 100, the shape gradually changes from a spherical shape to an irregular shape. The shape factor SF-2 shows the degree of surface irregularity. With the SF-2 value of 100 or more the surface irregularity (or unevenness) becomes remarkable. In the present invention, by controlling the shape factor SF-1 within the range of from 100 to 180 and the shape factor SF-2 within the range of from 100=to 140, the toner is made spherical in shape and smooth at the surface, thereby the fraction being reduced between the photosensitive drum and the cleaning member to prevent abrasion of the photosensitive drum.

Figure 2:
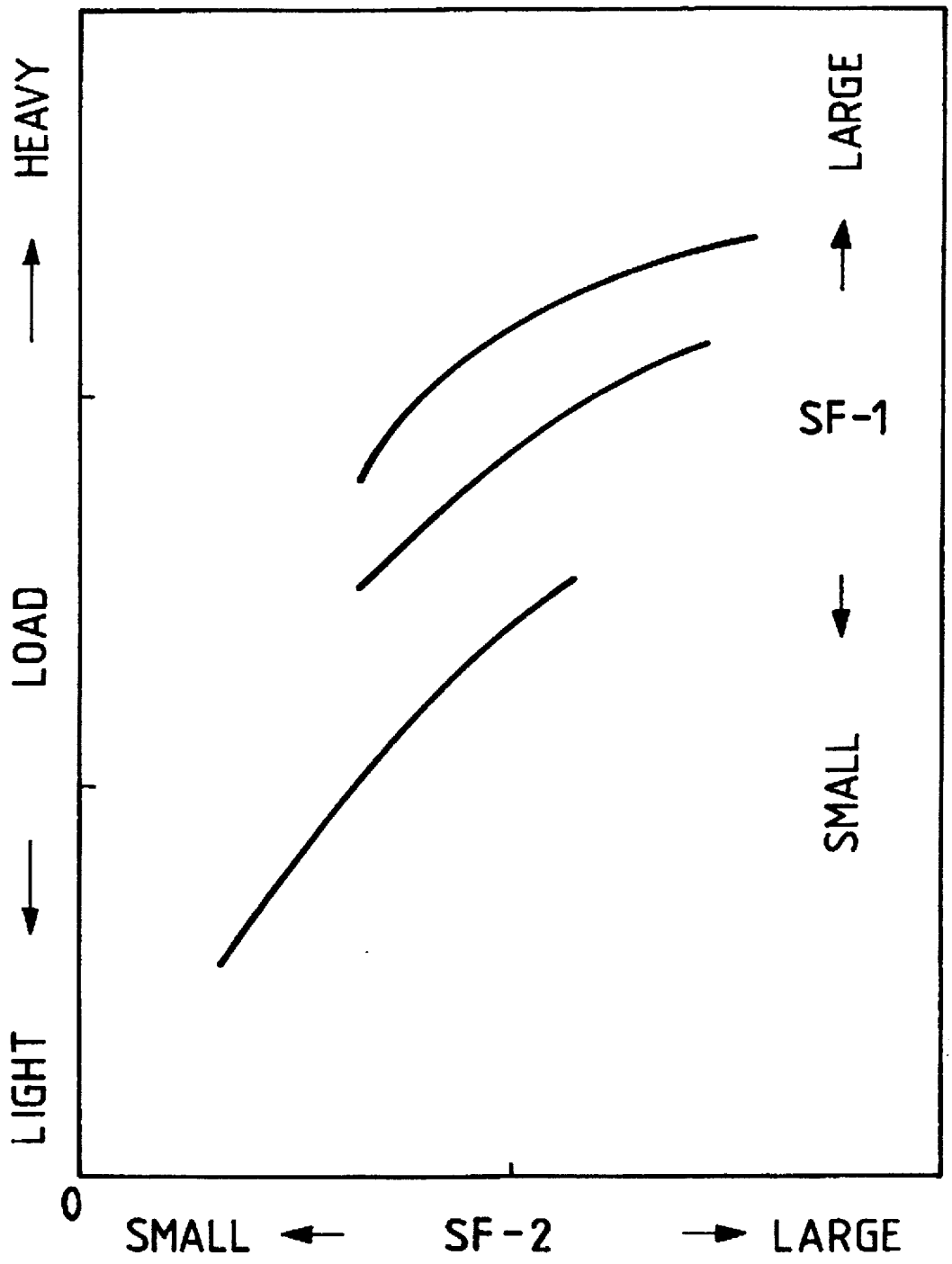
FIG. 2 shows dependency of lubricity on the shape factors, SF-1 and SF-2.

FIG. 2 shows the correlation between the shape factors and the lubricity. The lubricity is measured in such a manner that the toner is applied on a glass plate, a urethane rubber is placed thereon with a weight of 300 g, the urethane rubber is pulled horizontally, and the load which makes the rubber start to move is determined. FIG. 2 shows that the smaller shape factors give higher lubricity. In a practical test with a practical image-forming apparatus, the toner of the smaller shape factors causes little abrasion and gave longer life of the photosensitive drum.

Further, the toner with smaller shape factors is advantageous in image transfer properties for the reasons that the contact area with the photosensitive drum reduces the adhesion power and enables image transfer with a high efficiency.

Figure 3:
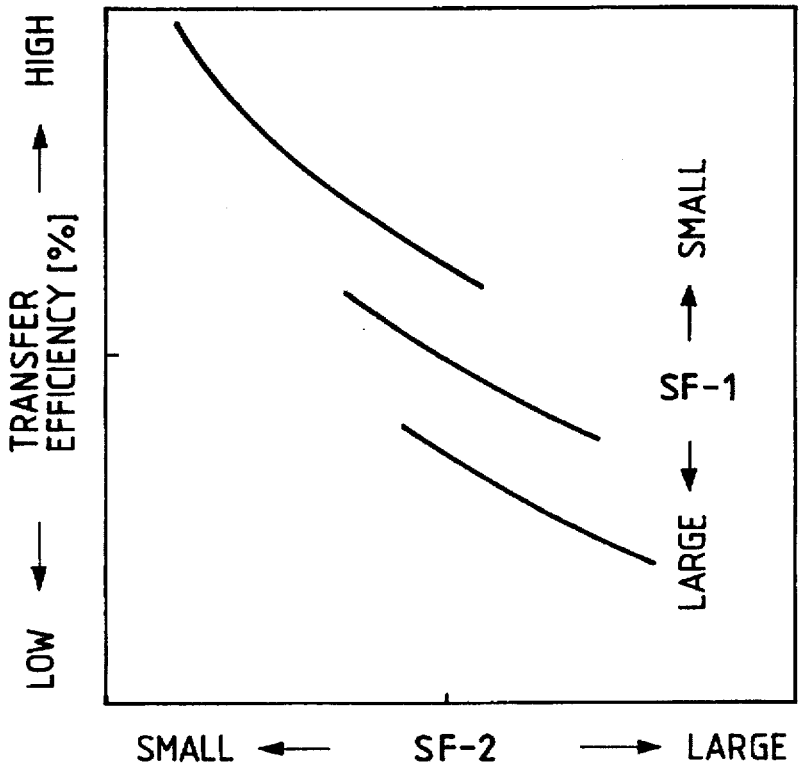
FIG. 3 shows dependency of transfer efficiency on the shape factors, SF-1 and SF-2.

FIG. 3 shows a correlation between the shape factors and the image transfer efficiency. It can be seen from FIG. 3 that the smaller the shape factors, the larger the transfer efficiency. Therefore, the amount of the remaining toner recovered after the image transfer is greatly decreased, whereby the cleaner device can be made smaller.

In a development-and-cleaning type image-forming apparatus, the amount of the toner remaining on a photosensitive member is required to be much smaller. In such an case, the toner has preferably a shape factor SF-1 ranging from 100 to 140, and a shape factor SF-2 ranging from 100 to 120.

A toner having a spherical shape and a smooth surface can be electrically charged to a constant level after transfer onto a transfer-receiving medium, and its surface can be uniformly charged electrically because the protrusions excessively brought into contact with the photosensitive member is less. In such a toner, image force is small and the contact area with the surface of a photosensitive member is small, as compared with a toner having a larger SF-2 value and irregular in its surface shape, and therefore, adhesion to the photosensitive member is weaker because of smaller Van der Weals force in comparison with a toner having a irregular shape as a whole and a large SF-1 value. Owing to The effects of the constant electric charge of the toner after transfer and the uniform electric charging on the smooth surface of the toner as mentioned above, the re-transfer of the toner having been transferred in the first image-forming unit is suppressed in the second image-forming unit. Consequently, high quality of an image can be achieved without disturbance of the toner on the transfer-receiving medium, and the change of color tone of a color image under a high humidity environment can be reduced when compared with the change under an ordinary humidity environment.

The transfer means for transferring a toner image in e transfer section onto a transfer-receiving medium may be either a non-contact type transfer means which utilizes corona discharge, or a contact type transfer means which conducts image transfer by bringing a contacting member such as a blade or a roller into contact with the reverse face of the transfer-receiving medium. In the present invention, however, for shortening the spacings between the transfer sections, a contact type transfer means in which applied transfer bias is readily concentrated to the transfer portion is preferred to a non-contact type transfer means in which transfer bias applied to a transfer portion is liable to diffuse, in view of transferring properties and less generation of ozone.

In the apparatus of the present invention in which plural image-forming units and plural image-transfer unit are provided and a transfer-receiving medium is delivered successively through the respective sections, and thereby effecting multiple image transfer, the transfer bias outputs for the image transfer units are preferably set to be higher at further downstream side in the direction in which the image-receiving medium is conveyed.

In the present invention, the term "transfer bias output" signifies e product of a voltage (V) multiplied by an electric current (μA), which are values at the time of transferring an image.

The transfer bias output can be made larger by controlling the voltage (V) applied in image transfer, or the electric current intensity (μA), or the both of them.

Therefore, the aforementioned problems of drop of transfer bias acting substantially on the second toner in the second transfer section which are caused by the transfer in the first transfer section can be solved by changing the respective transfer bias outputs in the first transfer section and the second transfer section. Thereby the difference of the transfer biases acting substantially on the toner can be decreased between the first transfer section and the second transfer section.

The means for primary electrification of a photosensitive member, a latent image holding member in the present invention, may be either a non-contact electrifying means such as a corona discharge means or a contact electrifying means such as a roller and a blade. For suppression of ozone generation, contact electrifying means are preferred in the present invention.

In an image forming method in a development-and-cleaning system (in which cleaning is carried out simultaneously with development), a cleaning means brought into contact with the photosensitive member for removal of a remaining toner is not provided separately. Generally, in such a system, the toner particles remaining after the image transfer is pressed against the surface of the photosensitive member, which is liable to cause fusion-bonding of the toner onto the photosensitive member and to cause film formation (i.e. filming) due to accumulation of the fused toner because of the absence of scraping operation for the surface of the photosensitive member with a cleaning means.

In the present invention, however, the toner particles are spherical in shape and have smooth surface as shown by the specified shape factors of the toner. Therefore, the toner of the present invention ie especially effective in image formation in a development-and-cleaning system employing a contact electrifying means.

The toner of the present invention exhibits a high efficiency of toner transfer and a low ratio of toner re-transfer. Therefore, the toner of the present invention remaining on the photosensitive member after the image-transfer is less, and barely damage the surface of the photosensitive member. Further the toner hardly causes fusion-bonding or filming on the photosensitive member because of the less contact area of the toner with the photosensitive member.

Such effects are especially remarkable for a photosensitive drum of a smaller diameter for miniaturization of the entire image-forming apparatus. The smaller diameter of the photosensitive drum will give a smaller contact area between the photosensitive drum and the contact electrifying means to allow stress to be concentrated at the contact portion, which tends to cause toner fusion-bonding and film formation on the surface of the photosensitive member. However, the toner having the specified shape factors of the present invention enables satisfactory image formation even under such conditions that the aforementioned fusion-bonding or filming of the toner occurs.

The diameter of the photosensitive member in the present invention is preferably in the range of from 20 to 40 mm for miniaturizing the entire apparatus. When the diameter is larger than 40 mm, the miniaturization is not sufficient, and when smaller than 20 mm, matching with other devices such as a developing device and a cleaning device is difficult.

The surface layer of the photosensitive drum of the present invention contains preferably a substance having a fluorine atom and or a silicon atom therein, and the ratio thereof is particularly preferably:

F/C=0.03 to 1.00

Si/C=0.03 to 1.00 according to X-ray photoelectron spectroscopy (XPS).

The fluorine-containing substance lowers the surface energy of the photosensitive drum, thereby reducing the friction between the photosensitive drum and other members, which is particularly preferable for the image-forming method of the present invention. The effect of the fluorine can be expected to the silicon-containing substance.

Specifically, a surface layer is formed by using at least a binder resin, and a fluorine-substituted compound and/or a silicon-containing compound. At least two compounds are incorporated as the fluorine-substituted compound and/or the silicon-containing compound: one compound is incompatible with the binder, and another compound is compatible with or emulsifiable in the binder. The two compounds of the fluorine-substituted compound and/or the silicon-containing compound are distributed uniformly in the surface of the photosensitive member by co-existence. Thereby, the electrophotographic photosensitive member of the present invention has a lower surface energy, and the aforementioned problems can be solved.

If the F/C ratio or the Si/C ratio is lower than 0.03, the surface energy is not sufficiently lowered, while if higher than 1.00, the strength of the surface layer becomes lower or the adhesion of the surface layer to the underlying layer becomes weaker.

The electrophotographic photosensitive member has at least a photosensitive layer formed on an electroconductive substrate. The surface layer of the photosensitive layer in the present invention contains at least a binder resin and the fluorine-substituted compound and/or the silicon-containing compound.

The fluorine-substituted compound includes fluorinated carbons; polymers and copolymers of tetrafluoroethylene, hexafluoropropylene, trifluoroethylene, chlorotrifluoroethylene, vinylidene fluoride, vinyl fluoride, perfluoroalkyl vinyl ethers, and the like; graft copolymers, block copolymers, and surfactant containing the above polymer in the molecule. The incompatible powdery fluorine-substituted compound for the use has a particle diameter ranging from 0.01 to 5 μm, and a molecular weight ranging from 3,000 to 5,000,000.

The silicon-containing compound includes three-dimensionally crosslinked monomethylsiloxane polymers, three-dimensionally crosslinked dimethylsiloxane-monomethylsiloxane copolymers, ultra-high molecular polydimethylsiloxane; block copolymers, graft copolymers, surfactants, and macromonomers having polydimethylsiloxane segments, and terminal-modified polydimethylsiloxane. The three-dimensionally crosslinked polymer is used in a particulate form having a particle diameter ranging from 0.01 to 5 μm. The polydimethylsiloxane compound for the use has a molecular weight ranging from 3,000 to 5,000,000. The fine particulate material is dispersed with a binder resin as the photosensitive layer components. The dispersion treatment is conducted by a sand mill, a ball mill, a roll mill, a homogenizer, a nanomizer, a paint shaker, an ultrasonic dispersing device, or the like. The content of the fluorine-substituted compound and/or The silicon-containing compound in the outermost layer of the photosensitive member is preferably in the range of from 1% to 70% by weight, more preferably from 2% to 55% by weight. With a content lower than 1% by weight, the surface energy is not lowered sufficiently, while with a content higher than 70% by weight, the film strength of the surface layer becomes low.

The binder resin for dispersing the fluorine-substituted compound end/or the silicon-containing compound includes polyesters, polyurethanes, polyacrylates, polyethylenes, polystyrenes, polybutadienes, polycarbonates, polyamides, polyproppylenes, polyimides, polyamideimides, polysulfones, polyarylethers, polyacetals, nylons, phenol resins, acrylic resins, silicone resins, epoxy resins, urea resins, allyl resins, alkid resins, and butyral resins. Further, reactive epoxy compounds and acrylic or methacrylic monomers and oligomers can be used by mixing and curing.

The photosensitive layer in the present invention may have either a single layer structure or a lamination layer structure. In the photosensitive layer of the single layer structure, photo-carriers are formed and transported within this layer, and the fluorine-substituted compound and/or the silicon-containing compound is contained in this outermost surface layer. In the photosensitive layer of the lamination structure, a charge-generating layer for forming the photo-carriers and a charge-transporting layer for transporting the carrier are laminated. Either the charge-generating layer or the charge-transporting layer may constitute the surface layer. In either case, the fluorine-substituted compound and/or the silicon-containing compound in the present invention is contained in the outermost layer. The single-layered photosensitive layer has a thickness of from 5 to 100 μm, preferably from 10 to 60 μm, end contains a charge-generating substance and/or a charge-transporting substance in an amount ranging from 20% to 80% by weight, more preferably from 30% to 70% by weight. In the lamination type photosensitive layer, the charge-generating layer has a thickness ranging from 0.001 to 6 μm, more preferably from 0.01 to 2 μm, and contains charge-generating substance in an amount ranging from 10% to 100% by weight, more preferably from 40% to 100% by weight; and the charge-transporting layer has a thickness ranging from 5 to 100 μm, more preferably from 10 to 60 μm, and contains charge-transporting substance in an amount ranging from 20% to 80% by weight, more preferably from 30% to 70% by weight.

The charge-generating substance employed in the present invention includes phthalocyanine pigments, polycyclic quinone pigments, azo pigments, perylene pigments, indigo pigments, quinacridone pigments, azulenium salt dyes, squatilium dyes, cyanine dyes, pyrylium dyes, thiopyryllum dyes, xanthene colors, quinoneimine colors, triphenylmethane colors, styryl colors, selenium, selenium-tellurium, amorphous silicon, and cadmium sulfide.

The charge-transporting substance employed in the present invention includes pyrene compounds, carbazole compounds, hydrazone compounds, N,N-dialkylaniline compounds, diphenylamine compounds, triphenylamine compounds, triphenylmethane compounds, pyrazoline compounds, styrene compounds, and stilbene compounds.

Of the photosensitive drum, a protecting layer may be laminated on the photosensitive layer. The protecting layer has a thickness ranging from 0.01 to 20 μm, preferably from 0.1 to 10 μm, and may contain the aforementioned charge-generating substance or charge-transporting substance, a metal or an oxide, nitride, salt, alloy thereof, an electroconductive material such as carbon, or a like substance. When the protecting layer is employed, the fluorine-substituted compound and/or the silicon-containing compound is also contained in this layer.

The binder resin used for the protecting layer includes polyesters, polyurethanes, polyacrylates, polyethylenes, polystyrenes, polybutadienes, polycarbonates, polyamides, polyproppylenes, polyimides, polyamideimides, polysulfones, polyarylethers, polyacetals, nylons, phenol resins, acrylic resins, silicone resins, epoxy resins, urea resins, allyl resins, alkid resins, and butyral resins. Further, a reactive epoxy compounds, an acrylic or methacrylic monomer, or an oligomer can be mixed therein and cured.

The material for the electroconductive substrate for the electrophotographic photosensitive member of the present invention includes metals such as iron, copper, nickel, aluminum, titanium, tin, antimony, indium, lead, zinc, gold, and silver, and alloys and oxides thereof; carbon; and electroconductive resins. The electroconductive material may be molded, applied as a paint, or vapor-deposited. A subbing layer may be provided between the electroconductive substrate and the photosensitive layer. The subbing layer is mainly composed of a binder resin, but may contain the aforementioned electroconductive material or an acceptor. The binder resin used for the subbing layer includes polyesterst, polyurethanes, polyacrylates, poiyethylenes, polystyrenes, polybutadienes, polycarbonates, polyamides, polypropylenes, polyimides, polyamideimides, polysulfones, polyarylethers, polyacetals, nylons, phenol resins, acrylic resins, silicone resins, epoxy resins, urea resins, allyl resins, alkid resins, and butyral resins. The electrophotographic photosensitive member of the present invention is produced by vapor-deposition, coating, or a like method. The coating can be conducted by a method such as bar coating, knife coating, roll coating, attritor coating, spray coating, immersion coating, electrostatic coating, and powder application.

When the electric charge is directly injected to the photosensitive member through an electroconductive magnetic brush serving as the electrifying means in contact with the surface of the photosensitive member in the present invention, a charge injection layer which contains electroconductive fine particles is preferably formed on the surface of the photosensitive member. The charge injection layer 16 is constituted, for example, of an electroconductive particulate material in an amount of from 20 to 200 parts by weight dispersed in 100 parts by weight of a resin such as photosetting acrylic resin. The electroconductive fine particulate material may be derived from a material such as $SnO_2$, $TiO_2$, and ITO, and has an average particle diameter preferably of not larger than 1 μm, more preferably in the range of from 0.5 to 50 nm for uniform electrification.

The average particle diameter of the electroconductive fine particulate material in the present invention is represented by 50%-average particle diameter derived from volume-size distribution of the maximum lateral length of the randomly selected 100 or more particles under a scanning electroscope.

The method for production of the toner having the specified shape factor in the present invention includes: (i) sphering treatment of the pulverized toner particles, (ii) production of all or a part of each toner particle by polymerization, and (iii) atomization of a molten mixture into the air by use of a disk or a multiple fluid nozzle as disclosed in Japanese Patent Publication No. 56-13945.

The pulverized toner particles to be processed can be made, for example, as follows. Toner materials such as a resin, a low-softening-point releasing agent, a colorant, and a charge-controlling agent are dispersed uniformly by a mixer such as a Henschel mixer and a media disperser, and melt-kneaded by a blender such as a pressure-kneader or an extruder; the kneaded product is allowed collide against a target by mechanical force or a jet stream to pulverize the toner into a desired particle diameter; and the pulverized particles are classified to obtain a sharp particle size distribution.

The sphering method for the toner particles includes the use of a pulverizer of mechanical impact type, the use of an air jet pulverizer at a less pulverizing pressure with more recycling frequency, the hot bath method to heat the toner particles dispersed in water, the heat treatment by passing the toner particles in a hot air stream, and the mechanical impact method of applying mechanical energy. Among the above methods, the mechanical impact method is particularly preferred. The mechanical impact can be applied by using a pulverizer such as a Kryptron system (Kawasaki Heavy Industries Ltd.) and a turbo mill (Turbo Kogyo K.K.), or by applying compression/friction force, pressing the toner onto the inside wall of the casing by centrifugal force caused by a high-speed rotating blade in Mechanofusion System (Hosokawa Micron K.K.), or in a Hybridization System (Nara Kikai Seisakusho K.K.).

The method for preparing the entire or a part of the toner particle by polymerization includes suspension polymerization as disclosed in Japanese Patent Publication 36-10231, Japanese Patent Laid-Open Publications 59-53856 and 59-61842; dispersion polymerization by use of an aqueous solvent in which the monomer is soluble but the resulting polymer is insoluble; and emulsion polymerization such as soap-free polymerization in the presence of a water-soluble polar polymerization initiator.

The toner, at least of which surface portion was formed by polymerization, is preferable for its approximately spherical and smooth surface, since such toner particles are prepared by dispersing the pretoner (a monomer composition) particles in a dispersion medium, and forming necessary part by polymerization.

Among the polymerization method, suspension polymerization is preferred since control of the toner shape factor SF-1 in a range from 100 to 180, and the toner shape factor SF-2 from 100 to 140 is easy, and it can be obtained rather easily the fine particulate toner of the particle diameter of from 4 to 8 μm can be obtained with sharp particle diameter distribution. The suspension polymerization may be conducted either under normal pressure or under an elevated pressure.

The particle diameter distribution, the toner shape factors, and the particle diameter can be controlled by selecting the kind and the amount of the slightly water-soluble inorganic salt or a dispersant exhibiting a colloid protection effect in the reaction mixture; controlling the mechanical conditions of agitation such as the peripheral speed of the roller, the frequency of passage, the shape of stirring blade, and shape of the reaction vessel; or controlling the solid concentration in the aqueous reaction mixture.

The binder resin for the toner in the present invention includes generally used styrene-(meth)acrylate copolymers, polyester resins, epoxy resins, styrene-butadiene copolymers. In the direct toner production by polymerization, monomers for these binder resins are preferably used, specifically including styrene type monomers such as styrene, o- (m-, p-)methylstyrene, and m- (p-)ethylstyrene; acrylate ester type monomers such as methyl (meth)acrylate, ethyl (meth)acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth) acrylate, and diethylaminoethyl (meth)acrylate; and ene type monomers such as butadiene, isoprene, cyclohexene, (meth) acrylonitrile, and acrylamide. These monomers can be used solely or in combination thereof.

When the monomers are used in combination, the combination is selected to obtain a copolymer having a theoretical glass transition temperature (Tg) in the range of from 40° to 75° C. as defined in Polymer Handbook (second edition, III-P139–192, John Wiley & Sons Co.). With the binder resin having the theoretical glass transition temperature of lower than 40° C., the storage stability of the toner and durability of the developer may be adversely affected. With a binder resin having the theoretical glass transition temperature of higher than 75° C., the fixation temperature rises, color mixing of the color toners is insufficient to decrease color reproducibility in full color images, and impair transparency of OHP images, thus lowering the image quality disadvantageously.

The molecular weight of the resin component of the toner is measured by GPC (gel permeation chromatography). Specifically, the GPC measurement is conducted as follows. The toner is extracted with toluene using a Soxhlet extractor for 20 hours. The toluene is removed using a rotary evaporator. The residue is washed sufficiently with an organic solvent like chloroform which dissolves ester wax but does not dissolve the binder resin. The washed residue is dissolved in THF (tetrahydrofuran). The solution is filtered through a solvent-resistant membrane filter of pore diameter of 0.3 μm. The filtered solution is applied to a GPC apparatus Model 150C (Waters Co.) equipped with serially connected columns of A-801, 802, 803, 804, 805, 806, and 807 (product of Showa Denko K.K.). The molecular weight distribution can be determined based on a calibration curve obtained with standard polystyrene resins. In the present invention, for the resin component it is preferable that the number-average molecular weight (Mn) is from 5,000 to 1,000,000, and the ratio of the weight average molecular weight (Mw) to the number average molecular weight (Mn), Mw/Mn, is from 2 to 100.

As the colorants for yellow, ms, colorants of yellow, magenta, cyan, and black are used.

The black colorant includes carbon black, magnetic materials, and a mixture of a yellow colorant, a magenta colorant, and a cyan colorant formulated to show black color.

The yellow colorant includes condensed azo compounds, isoindrlnone compounds, anthraguinone compounds, azo metal complexes, methine compounds, and allylamide compounds. Specific examples thereof are C.I. Pigment Yellows 12, 13, 14, 15, 17, 62, 74, 83, 93, 94, 95, 97, 109, 110, 111, 120, 127, 128, 129, 147, 168, 174, 176, 180, 181, and 191.

The magenta colorant includes condensed azo compounds, diketopyrrolopyrrole compounds, anthraguinone compounds, qunacridone compounds, basic dye lake compounds, naphthol compounds, benzimidazolone compounds, thioindigo compounds, and perylene compounds. Specific examples are C.I. Pigment Reds 2, 3, 5, 6, 7, 23, 48:2, 48:3, 48:4, 57:1, 81:1, 144, 146, 166, 169, 177, 184, 185, 202, 206, 220, 221, and 254.

The cyan colorant includes copper phthalocyanine compounds, and derivatives thereof, anthraquinone compounds, and basic dye lake compounds. Specific examples thereof are C.I. Pigment Blues 1, 7, 15, 15:1, 15:2, 15:3, 15:4, 60, 62, and 66.

These colorants may used solely, in combination, or in a state of a solid solution. The colorants in the present invention are selected in consideration of hue, color saturation, lightness, weatherability, OHP transparency, and dispersibility in the toner. The amount of the colorant in the toner ranges preferably from 1 to 20 parts by weight for 100 parts by weight of the resin.

The magnetic substance as the black colorant is preferably contained in the toner in an amount ranging from 40 to 150 parts by weight to 100 parts of the resin, differing from other colorants.

Although the charge-controlling agent used in the present invention can be a conventional one, those colorless, fast in charge build up, and capable of stably maintaining a constant charge amount are preferable. When the toner is produced by direct polymerization, especially preferred is a charge-controlling agent which does not inhibit the polymerization nor contain a water-soluble matter. The preferred charge-controlling agent of negative type includes metal compounds of salicylic acid, metal compounds of naphtholc acid, metal compounds of dicarboxylic acids, macromolecular compounds having side chains of sulfonic groups or carboxylic groups, boron compounds, urea compounds, silicon compounds, and carycsarene. The preferred charge-controlling agent of positive type includes quaternary ammonium salts, macromolecular compounds having a quaternary ammonium group in its side chain, guanidine compounds, and imidazole compounds. The charge-controlling agent is added to the toner preferably in an amount of from 0.5 to 10 parts by weight to 100 parts by weight of the resin. The charge-controlling agent, however, is not essential in the present invention. The charge-controlling agent is not necessarily used, since in two-component development triboelectricity is be utilized, or in non-magnetic one-component blade coating development triboelectricity by a blade member or a sleeve member can be intentionally utilized.

When direct polymerization is used for toner production in the present invention, the polymerization initiator to be used includes azo or diazo type initiators such as 2,2'-azobis (2,4-dimethylvaleronitrile), 1,1'-azobis(cyclchexane-1-carbonitrile), 2,2'-azobis-4-methoxy-2,4-dimethylvaleronitrile, and azobisisobutyronitrile; and peroxide type initiators such as benzoyl peroxide, methyl ethyl ketone peroxide, diisopropyl peroxycarbonate, cumene hydroperoxide, 2,4-dichlorobenzoyl peroxide, and lauroyl peroxide. The amount of the polymerization initiator to be added to the polymerization system depends on the intended polymerization degree, and is generally in the range of from 0.5% to 20% by weight of the monomer. The kind of the polymerization initiator differs a little by the desired polymerization degree, but selected considering the 10-hour half-life temperature, and is used solely or in combination.

For the control of the polymerization degree, a crosslinking agent, a chain transfer agent, or a polymerization inhibitor may further be added to the polymerization system.

When suspension polymerization is employed for production of the toner in the present invention, an inorganic oxide or an organic compound may be added as a dispersing agent to the aqueous phase. The inorganic oxide includes calcium tertiary phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials, and ferrite. The organic compound includes polyvinyl alcohol, gelatin, methylcellulose, methylhydroxypropylcellulose, ethylcellulose, sodium salt of carboxymethylcellulose, and starch. The dispersing agent is preferably used in an amount of from 0.2 to 2.0 parts by weight to 100 parts by weight of the polymerizable monomer.

The commercial dispersing agent may be used by itself. Otherwise, the dispersing particles of a fine and uniform particle size may be prepared by mixing the inorganic compound at a high speed in a dispersion medium. For example, calcium tertiary phosphate can be prepared by mixing an aqueous sodium phosphate solution with an aqueous calcium chloride solution under highspeed agitation to obtain a dispersing agent suitable for suspension polymerization. To form a dispersing agent of fine particles, a surfactant may be used in combination in an amount of 0.001–0.1 part by weight. Commercial nonionic, anionic, and cationic surfactants are useful therefor. Specific examples of the surfactant include sodium dodecylsulfate, sodium tetredecylsulfate, sodium pentadecylsulfate, sodium octylsulfate, sodium oleate, sodium laurate, potassium stearate, and calcium oleate.

When the toner is produced by direct polymerization, the production can be conducted as follows. Into a monomer, are added a colorant, a charge-controlling agent, a polymerization initiator, and other additives, and a monomer composition is prepared by making the mixture into a solution or a homogeneous dispersion by means of a dispersing machine such as a homogenizer and an ultrasonic dispersing machine. This monomer composition is dispersed in an aqueous phase containing a dispersion-stabilizing agent by means of a usual stirrer, or a dispersing machine such as a homomixer and homogenizer. Preferably, the stirring conditions such as stirring speed and stirring time are controlled to obtain droplets of the monomer composition in a size of the intended toner particles. Thereafter stirring is conducted to an extent to keep the particulate.state by an action of the dispersing agent and to prevent sedimentation of the particles. The polymerization temperature is controlled to be not lower than 40° C., generally in the range of from 50° to 90° C. The polymerization temperature may be elevated in a later stage of polymerization reaction. Further, in a later stage, or after completion of the polymerization, a part of the aqueous medium may be distilled off for the purpose of removing the unreacted monomer and by-products for the purpose of improving durability in the present invention. After completion of the polymerization, the formed toner particles are washed, collected by filtration, and dried. In the suspension polymerization, water is used as the dispersion medium generally in an amount of from 300 to 3000 parts by weight to 100 parts of the monomer.

The toner used in the present invention preferably contains an unreacted monomer at a content of not higher than 1000 ppm, more preferably not higher than 500 ppm, still more preferably not higher than 300 ppm to prevent the drop of toner transfer efficiency and occurrence of the reverse transfer when the image formation is done with a large number of sheets. If the content of the remaining monomer is higher than 1000 ppm in the toner, the remaining monomer tends to soil the surface of the photosensitive member to lower the contact angle of the surface of the photosensitive member, thereby lowering the toner transfer efficiency and causing the toner reverse transfer.

The content of the residual monomer in the toner can be reduced to 1000 ppm or lower by following methods. When the toner is produced by suspension polymerization, the remaining monomer is removed by the methods such as washing the toner with a highly volatile organic solvent which does not dissolve the toner binding resin but dissolve the polymerizable monomer and/or the organic solvent component of the polymerization medium; washing with an acid or alkaline solution; addition of a solvent component which does not dissolve the polymer or a blowing agent into the polymerization medium to make the toner porous, increasing the surface area from which the polymerizable monomer or the organic solvent component in the particle can evaporate; and evaporation of the polymerizable monomer and/or the organic solvent component of the polymerization medium under reduced pressure. Of these methods, the evaporation under reduced pressure is most suitable, since in the former method it is difficult to prevent toner components from eluting because of the toner deterioration in capsuling properties, or difficult to select a proper solvent which does not remain.

To reduce the monomer content in the toner which is produced by the pulverization method followed by sphering treatment, following methods can be used; production of a toner binding resin by suspension polymerization with feeding of gaseous nitrogen; production of a toner binding resin by suspension polymerization and subsequent evaporation of water with the monomer from the suspension at a temperature higher than the glass transition temperature of the binder resin; production of a toner binding resin by suspension polymerization for sufficiently long time to achieve polymerization ratio of 98% or higher; and drying of the resin after the polymerization under reduced pressure with heating. These methods may be employed together.

The toner containing less residual monomer is preferred as mentioned above in view of the prevention of soiling of the surface of the photosensitive member in image formation on multiple sheets. This is particularly advantageous for a photosensitive member of an organic photoconductive material (OPC). Since the organic photoconductive member is made from a resin, it can be deteriorated when the toner contains residual monomers in a large amount. Therefore, the low content of the residual monomer in the toner is desired.

As described above, the toner containing a residual monomer at a content of not higher than 1000 ppm is advantageous for the image-forming method and the image-forming apparatus of the present invention since it is less liable to cause drop of the toner transfer efficiency or increase of toner reverse transfer in many sheets of image formation. Such a toner is especially effective in an image formation of contact electrifying method where the primary electrifying is done in contact with the photosensitive member. Such a toner is further more effective in image formation of combination use of the contact electrifying method and the development-and-cleaning method.

In an image-forming method using contact electrifying, the more the toner remains on the photosensitive member after image-transfer (both the untransferred and reverse-transferred toner), the more the toner not removed by a cleaning means reaches the contact charger, tending to cause melt-adhesion of the toner component onto the contact electrifying member. This phenomenon is more notable with a toner containing a larger amount of residual monomer.

In a development-and-cleaning type of image formation in which no cleaning means for cleaning the remaining toner on the photosensitive member is provided between a transfer section and a contact-charger, the amount of the toner reaching the contact-electrifier is larger, and melt-adhesion the toner component onto the contact-electrifying means is liable to occur.

However, the toner in the present invention having specified shape factors is transferred with a high transfer efficiency, and is reverse-transferred less. Therefore, the remaining toner after image transfer is decreased, and melt-adhesion of a toner component onto the contact-electrifying means is prevented. Further, a toner containing a less amount of residual monomer is prevented more completely from the melt-adhesion of the toner onto the contact-electrifying means, and is applicable to development-and-cleaning type of image formation.

The residual monomer in a toner is measured as follows in the present invention. A toner sample (0.2 g) is dissolved in 4 mL of tetrahydrofuran, and is subjected to gas chromatographic analysis (GC) with internal standards under the following conditions.

G.C. Conditions:

Apparatus: GC-15A (Shimadzu Corp.)

Carrier gas: $N_2$ gas, 2 kg/cm$^2$, 50 mL/min, split ratio=1:60, linear velocity=30 mm/sec Column: ULBON HR-1, 50 mm×0.25 mm Temperature elevation:
50° C. for 5 min; 5° C./min to 100° C.;
10° C./min to 200° C.; held at 200° C.

Amount of sample: 2 μL

Standard sample: Toluene

Particles of the toner used in the present invention have a weight-average diameter ranging from 1 to 9 μm, preferably from 2 to 8 μm for precisely develop latent analog images or latent fine dot image, for high image quality. Further, the toner particles have size distribution of a variation coefficient (A) of not more than 35%. The toner having a weight-average diameter of less than 1 μm is transferred at a lower transfer efficiency to remain more on an electrostatic image-holding member like a photosensitive member, and further is liable to cause fogging, and irregularity of the image owing to incomplete transfer, not preferable in the present invention. The toner having a weight-average diameter of more than 9 μm tends to cause melt-adhesion onto the surface of the photosensitive meter or the like. The above disadvantageous tendencies are more notable in the toner having the variation coefficient of more than 35% in number size distribution.

The size distribution of the toner particles is measured by use of a Coulter counter in the present invention. For example, a Coulter Counter, Model TA-II (manufactured by Coulter Electronics Inc.) or a Coulter Multisizer (manufactured by Coulter Electronics Inc.) is employed as the measurement apparatus; an interface (manufactured by Nikkaki K.K.) and CX-1 personal computer (manufactured by Canon K.K.) are connected thereto for outputting the number size distribution and the volume size distribution; and an aqueous sodium chloride solution of about 1% concentration prepared with sodium chloride of the first reagent grade is used as the electrolyte solution. ISOTON II (produced by Coulter Scientific Japan K.K.) is useful therefor. To 100–150 mL of the aqueous electrolyte solution, are added 0.1–5 mL of a surfactant (preferably an alkylbenzenesulfonate salt) and 2–20 mg of a sample for the measurement. The electrolyte solution containing the sample is dispersed by use of a ultrasonic dispersing apparatus for about 1 to 3 minutes. Then the number-based particle size distribution is measured by the above-mentioned Coulter Counter TA-II with a 100μ aperture or a 50μ aperture in the range of from 2 to 40μ (or 1 to 20μ), from which the values of the present invention are derived. The variation coefficient A for the number-size distribution of the toner particles is shown by the equation below:

Variation coefficient (A)=$[S/D_1]\times 100$ where S is a standard deviation in number-size distribution of the toner particles, and $D_1$ is a number-average particle diameter (μm) of the toner particles.

The toner in the present invention preferably contains additionally a fine particulate material mixed therein as an external additive to improve the toner fluidity. The external additive has preferably a diameter of 1/10 times or less as large as the weight-average particle diameter of the toner. The particle diameter of the external additive means an average diameter derived by observation of the surface of the toner particle by electron microscopy with magnification of 50000×.

The external additive includes particles of metal oxides such as aluminum oxide, titanium oxide, strontium titanate, cerium oxide, magnesium oxide, chromium oxide, tin oxide, and zinc oxide; nitrides such as silicon nitride; carbides such as silicon carbide: metal salts such as calcium sulfate, barium sulfate, and calcium carbonate; metal salts of fatty acids such as zinc stearate, calcium stearate; carbon black; and silica.

It is preferable that the fine particulate material as the external additive is hydrophobic with a hydrophobicity degree of not less than 60%, more preferably not less than 80%, still more preferably not less than 90%.

The hydrophobicity degree of the external additive in the present invention is measured as follows. Similar measurement methods can be applicable by reference to the measurement method of the present invention. In a stoppered 200-mL separation funnel, are placed 100 mL of deionized water and 0.1 g of a sample. The separation funnel is shaken with a shaker (Turbula Shaker Mixer, Model T2C) at 90 rpm for 10 minutes. After completion of the shaking, it was left standing for 10 minutes to allow the inorganic powder layer to separate from the water layer. Then 20–30 mL of the lower water layer is collected and is introduced into a 10-mm cell. The light transmittance is measured at wavelength of 500 nm by reference to the ionized water containing no fine powder as a blank. The value of the transmittance is defined as the hydrophobicity of the inorganic fine powder.

When the fine particulate material as the external additive has a hydrophobicity degree of less than 60% it tends to absorb moisture, especially in high humidity conditions which results in less electrification and less fluidity of the toner, thus low transfer efficiency, toner scattering, end image fogging.

The fine particulate material can be made hydrophobic by the method described later for treatment of inorganic fine particulate material a and a silicone compound b.

The external additive in the present invention is used in an amount preferably of from 0.1 to 5 parts, more preferably from 0.2 to 4 parts by weight to 100 parts by weight of the toner particles. With the external additive in an amount of less then 0.1 part by weight, the fluidity of the toner is not improved sufficiently, while with external additive in an amount of 5 parts by weight, the external additive particles released from the toner particles tend to soil the carrier or the development sleeve to lower the toner electrification ability.

The toner of the present invention is spherical in shape and has a smooth surface. Therefore, the contact area between the toner particles or between the toner particle and the carrier particle, which causes stress concentration there. The stress concentration may cause embedding of the external additive particles in the toner particles, impairing the durability of the toner disadvantageously.

To offset the disadvantage, the external additive in the present invention is preferably a combination of an inorganic particulate material a having been treated for hydrophobicity (hydrophobic inorganic material a) and a silicon compound b having a diameter larger than the inorganic particulate material a and having been treated for hydrophobicity (hydrophobic silicon compound b). In the above combination, the hydrophobic inorganic particulate material a has preferably an average particle diameter ranging from 3 to 90 nm, and the hydrophobic silicon compound preferably has an average particle diameter ranging preferably from 3 to 120 nm, and a particle size distribution such that the silicon compound particles are constituted of 15%–45% in number of particles of 5–30 nm diameter, 30%–70% in number of particles of 30–60 nm, and 5%–45% in number of particles of larger than 60 nm.

In the above combination, the base material the inorganic particulate material a includes metal oxides such as titanium oxide, aluminum oxide, strontium titanate, cerium oxide, and magnesium oxide; nitrides such as silicon nitride; carbide such as silicon carbide; metal salts such as calcium sulfate, barium sulfate, and calcium carbonate; and carbon fluorides. Of these, titanium oxide is particularly preferred. The titanium oxide can be produced by gas-phase oxidation of a titanium halide compound or a titanium alkoxide. The titanium oxide may be either crystalline (anatase or rutile) or non-crystalline.

The treatment for hydrophobicity of the inorganic particulate material a may be conducted either by a wet process or by a dry process. The hydrophobioity-imparting agent includes silane-coupling agents, titanium coupling agents, aluminate coupling agents, zircoaluminum coupling agents, and silicone oils. Of these, preferred are silane coupling agents represented by the general formula below:

$R_mSiY_n$ where R is an alkoxy group, Y is a hydrocarbon group such as alkyl, vinyl, glycidoxy, and methacryl; m is an integer of from 1 to 3; and n is an integer of from 1 to 3. Of the silane coupling agents, particularly preferred are monoalkyltrialkoxysilane coupling agents. Specific examples of the silane coupling agents are: vinyltrimethoxysilane, vinyltriethoxysilane, γ-methacryloxypropyltrimethoxysilane, vinyltriacetoxysilane, methyltrimethoxysilane, methyltriethoxysilane, ethyltrimethoxysilane, ethyltriethoxysilane, propyltrimethoxysilane, propyltriethoxysilane, butyltrimethoxysilane, butyltriethoxysilane, isobutyltrimethoxysilane, isobutyltriethoxysilane, dimethyldimethoxysilane, dimethyldiethoxysilane, trimethylmethoxysilane, hydroxypropyltrimethoxysilane, phenyltrimethoxysilane, n-hexadecyltrimethoxysllane, n-octadecyltrimethoxysilane, n-butyltrimethoxysilane, and n-octyltrimethoxysilane.

The amount of the hydrophobicity-imparting agent employed for the treatment is preferably in the range of from 1 to 50 parts, more preferably from 3 to 40 parts by weight to 100 parts by weight of the fine particulate material or the inorganic fine particulate material a. With the hydrophobicity-imparting agent of less than 1 part by weight, sufficient hydrophobicity cannot be obtained and the charge stability of the toner is impaired with rapid leak of the electric charge under high humidity conditions. With the amount of the agent of more than 50 parts by weight, formation of coarse secondary particles may be accelerated, and fluidity is not sufficiently improved.

The average particle diameters of the fine particulate material or the hydrophobic inorganic fine powdery material a and the hydrophobic silicon compound b are measured by taking an electron microphotograph of the fine particles at a magnification of 50000× using a scanning electron microscope (manufactured by Hitachi, Ltd.), measuring the diameters of 100 or more particles having a diameter of 5 nm or more by LUZEX III (manufactured by Nileco Co.), and averaging the obtained diameters.

The hydrophobic inorganic fine particulate material a has preferably a hydrophobicity degree of not less than 60%, more preferably not less than 80%, still more preferably not less than 90%. When the inorganic fine particulate material a has a hydrophobicity degree of less than 60%, it tends to absorb moisture, especially in high humidity conditions which results in less electrification and less fluidity of the toner, thus low transfer efficiency, toner scattering, and image fogging.

The hydrophobic inorganic fine particulate material a preferably has a triboelectricity of not more than 45 mC/kg, more preferably not more than 35 mC/kg in absolute value measured by use of powdery iron carrier for stable electrification of small diameter toner particles. The quantity of triboelectricity of the hydrophobic inorganic particulate material is measured as follows: 2 parts by weight of the fine powdery material and 98 parts by weight of powdery iron carrier (for example, powdery iron carrier EFV-200/300 produced by Powder Tec K.K.) are mixed and shaken in a polyethylene container 300–400 times, and then the electrification is measured in a manner similar to that for the frictional electricity of the toner described later.

The hydrophobic inorganic fine particulate material a preferably has a SET specific surface area ranging from 100 to 300 $m^2/g$ determined using nitrogen gas, in order to efficiently increase the fluidity of the toner particles.

The hydrophobic inorganic fine particulate material a in the present invention is added preferably in an amount of from 0.05 to 3.5 parts, more preferably from 0.1 to 2.0 parts by weight to 100 parts by weight of the particulate toner. By use thereof in an amount of less than 0.05 parts by weight, the sufficient fluidity is not imparted to the toner particles. By use thereof in an amount of larger than 3.5 parts by weight, the free additive particles tends to soil the surface of the carrier or a development sleeve to lower the electrification quantity.

The hydrophobic fine powdery silicon compound b is explained below, which serves to prevent or control the embedding of the hydrophobic inorganic fine powdery material a in the surface of the toner particles.

The base material for the fine powdery silicon compound b is preferably fine powdery silica or fine powdery silicone resin. The fine powdery silica b may be a material constituted of a core made of inorganic fine particulate material other than silica and a surface layer of silica.

The fine powdery silica b can be produced by a gas phase oxidation or a sol-gel process of a halogenated silicon compound.

For the hydrophobicity treatment of the silicon compound, a silane coupling agent or a silicone oil is used as the hydrophobicity-imparting agent. The silane coupling agent includes hexamethyldisilasane, trimethylsilane, trimethylchlorosilane, trimethylethoxysilane, dimethyldichlorosilane, methyltrichlorosilane, allyldimethylchlorosilane, allylphenyldlchlorosilane, benzyldimethylchlorosilane, bromomethyldimethylchlorosilane, α-chloroethyltrichlorosilane, β-choroethyltrichlorosilane, chloromethyldimethylchlorosilane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

For imparting a positive triboelectricity property to the hydrophobic fine powdery silicon compound, there may be used a nitrogen-containing silane coupling agent. The nitrogen-containing silane coupling agent includes aminopropyltrimethoxysilane, aminopropyltriethoxysilane, dimethylaminoproyltrimethoxysilane, diethylaminoproyltrimethoxysilane, dipropylaminopropyltrimethoxysilane, dibutylaminopropyltrimethoxysilene, monobutylaminopropyltrimethoxysilane, dioctylaminopropyltrimethoxysilane, dibutylaminopropyldimethoxysilane. dibutylaminopropylmonomethoxysilane, dimethylaminophenyltriethoxysilane, trimethoxysilyl-γ-propylphenylamine, and trimethoxysilyl-γ-propylbenzylamine.

The silicone oil includes the compound represented by the formula below:

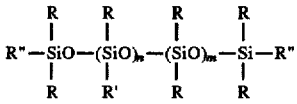

where R is an alkyl group of 1 to 3 carbons; R' is a silicone oil-modifying group such as alkyl, halogenated alkyl, phenyl, and modified phenyl; and R" is an alkyl or alkoxy group of 1 to 3 carbons. The specific example of the silicone oil includes dimethylsilicone oils, alkyl-modified silicone oils, α-methylstyrene-modified silicone oils, chlorophenylsilicone oils, and fluorine-modified silicone oils. The silicone oil has preferably a viscosity ranging from 50 to 100 centistokes at 25° C.

A nitrogen-containing silicone oil may be used for imparting hydrophobicity and positive triboelectricity property to the hydrophobicity-imparted fine powdery silicon compound. As a silicone oil having a nitrogen atom in the side chain, those having a moiety represented by the formulas below are useful:

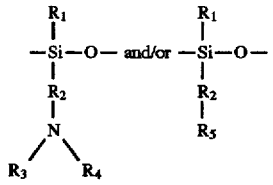

where $R_1$ is hydrogen, an alkyl group, an aryl group, or an alkoxy group; $R_2$ is an alkylene group or a phenylene group, $R_3$ and $R_4$ represent hydrogen, an alkyl group, or an aryl group; and $R_5$ is a nitrogen-containing heterocyclic ring group. The alkyl, aryl, alkylene, and phenylene group may have an organic group containing a nitrogen atom, or may nave a substituents such as a halogen atom provided that the electrification properties is not impaired.

The amount of the hydrophobicity-imparting agent to be used for the hydrophobicity treatment is preferably from 1 to 50 parts, more preferably from 2 to 35 parts by weight to 100 parts by weight of fine powdery silicon compound. The hydrophobicity thereof is preferably in the range of from 30% to 80%, more preferably from 35% to 75%.

The hydrophobic fine powdery silicone compound b used in the present invention has preferably broader particle size distribution and larger particle size than conventionally used fine silica powder, in order to prevent or inhibit the inorganic fine powdery material a from being embedded in the toner surface, where the inorganic fine powdery material a is used for remarkably improving the toner particle fluidity. The hydrophobicity-imparted fine powdery silicon compound b has an average diameter ranging from 30 to 120 nm, and a broad particle distribution containing particles of from 5–30 nm in diameter 15–45% by number (preferably 20–40%); particles of 30–60 nm in diameter 30–70% by number (preferably 45–70%, more preferably 50–70%); and particles of 60 nm or more in diameter 5–45% by number (preferably 10–40%).

The hydrophobic silicon compound b is used in an amount of preferably from 0.05 to 3.5 parts, more preferably from 0.1 to 2.0 parts by weight to 100 parts by weight of the toner particles in the present invention.

The hydrophobic fine powdery silicon compound b prevents embedding of the fluidity-improvement agent in the surface layer of the toner particles, raises the transfer ratio of the toner image in a transfer process, and allows effective removal of remaining small toner particles from an electrostatic image-holding member in a cleaning process. The above effect is probably due to the fact that the coarser particles contained in the fine powdery silicone compound material b, are not so easily embedded in the surface layer of the toner particle serving as a kind of spacer. When the hydrophobic fine powdery silicon compound is larger in the absolute triboelectricity than the fluidity-improving agent, the former is present closer to the toner particles than the latter, thus preventing more effectively the embedding of the latter into the toner surface layer.

The hydrophobic fine powdery silicon compound b has preferably a BET specific surface area of not more than 80 $m^2/g$, more preferably not more than 70 $m^2/g$, measured by use of nitrogen gas, and the quantity of the absolute triboelectricity with an iron powder carrier in the range of preferably from 50 to 300 mC/kg, more preferably from 70 to 250 mC/kg, in order to more efficiently prevent the fluidity-improving hydrophobic inorganic fine particles from being embedded in the toner particle surface.

In the present invention, the effect of combined use of the hydrophobic fine powdery inorganic material a and the hydrophobic fine powdery silicon compound b becomes more remarkable as the shape factors SF-1 and SF-2 are closer to 100.

In the present invention the developer may be a one-component developer or a two-component developer.

An one-component developer containing a magnetic material in the toner particles may be delivered and electrified by utilizing a magnet built in a developing sleeve. A non-magnetic one-component developer which contains no magnetic material in the toner particle may be delivered by forcibly electrifying the toner particles by friction with a blade or a roller on a developing sleeve to attach the toner to the developing sleeve.

In the present invention, a two-component developer can be comprised of a toner and a carrier. The magnetic carrier is constituted of a simple element such as iron, copper, zinc, nickel, cobalt, manganese, and chromium, or in a state of a completed ferrite. The magnetic carrier may be in a spherical, flat, or irregular shape. The surface of the magnetic carrier is preferably controlled to have a minute surface structure (for example, rough surface). Generally, the carrier is prepared by calcining and granulating the aforementioned inorganic oxide to prepare magnetic carrier core particles and coating the core particle with a resin. In order to reduce the carrier load to the toner, a low-density dispersion carrier can be obtained by blending an inorganic oxide and a resin, pulverizing the mixture and classifying it; or precisely spherical magnetic toner can be prepared by conducting suspension polymerization of a monomer in the presence of an inorganic oxide in an aqueous medium directly.

A resin-coated carrier is particularly preferred which is constituted of carrier particles coated at the surface with a resin. The coating can be conducted by application of a solution or suspension of a resin in a solvent onto the carrier particles, or simply mixing resin powder with carrier particles to cause adhesion.

The material applied to the carrier particle surface depends on the material of the toner, and includes polytetrafluoroethylene, poly(monochlorotrifluoroethylene), polyvinylidene fluoride, silicone resins, polyester resins, styrene resins, acrylic resins, polyamides, polyvinylbutyrals, and aminoacrylate resins.

The carrier has preferably magnetic properties as below. The magnetization intensity ($\sigma_{1000}$) at 1000 Oersted after magnetic saturation should be in the range of from 30 to 300 emu/cm$^3$, preferably in the range of from 100 to 250 emu/cm$^3$ for higher image quality. The carrier of 300 emu/cm$^3$ or hither will not give higher quality of the toner image. The carrier of 30 emu/cm$^3$ or less is liable to cause carrier adhesion because of its lower magnetic constraint.

The carrier has preferably a shape factor SF-1, representing a sphericity degree, of not more than 180, and a shape factor SF-2, representing irregularity degree, of not more than 250. Here the SF-1 and the SF-2 are defined respectively by equations below, and are measured by LVZEX III manufactured by Nileco Co.

$$SF\text{-}1 = \frac{(CMXLNG)^2}{CAREA} \times \frac{\pi}{4} \times 100$$

$$SF\text{-}2 = \frac{(CPERI)^2}{CAREA} \times \frac{1}{4\pi} \times 100$$

where CMXLNG is the maximum length of the carrier particle, CPERI is the peripheral length of the carrier particle, and CAREA is a projected area of the carrier particle.

In preparation of a two-component developer used in the present invention, the toner and the magnetic carrier are mixed at a mixing ratio of the toner of from 2% to 15%, preferably 4% to 13% by weight to obtain satisfactory results.

The image-forming method and the image-forming apparatus with the toner of the present invention are explained below by reference to the annexed drawings.

FIG. 1 is a schematic drawing of an image-forming apparatus for practicing the image-forming method of the present invention. The main body of the image-forming apparatus is provided with a first image-forming unit Pa, a second image-forming unit Pb, a third image-forming unit Pc, and a fourth image-forming unit Pd which form respectively an image in a different color on an image-receiving medium through steps of latent image formation, development, and transfer.

Figure 4:
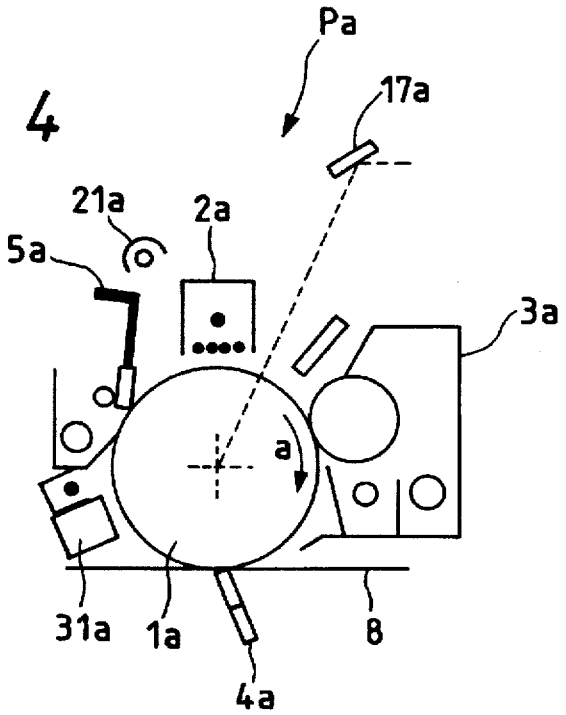
FIG. 4 is an enlarged schematic view of a part of the first image-forming unit of the image-forming apparatus shown in FIG. 1.

The constitution of each of the image-forming units provided in the image-forming apparatus is explained by reference to FIG. 4 showing the constitution of the first image-forming unit Pa.

In the first image-forming unit Pa, an electrophotographic photosensitive member drum 1*a* is driven to rotate in the arrow mark direction. A primary electrifier 2*a* as the electrifying means is a corona charger which does not come into contact with the photosensitive drum 1*a*. A polygon mirror 17*a* serves as a latent image forming means reflecting a laser beam with rotation to allow the laser beam to scan the surface of the photosensitive drum 1*a* having been electrified uniformly to form a latent image on the surface. A developing device 3*a* is a developing means holding a color toner for developing the latent image held on the photosensitive drum 1*a* to form a color toner image. A transfer blade 4*a* as a transfer means transfers the color toner image formed on the photosensitive drum 1*a* onto a transfer-receiving medium delivered by a belt-like transfer medium holder 8. The transfer blade 4*a* is to apply a transfer bias by touching the reverse face of the transfer medium holder 8. A cleaning means 5*a* removes a color toner remaining on the surface of the photosensitive drum after the image transfer, and comprises a cleaning blade for removing the color toner from the surface of the photosensitive drum by contact with it, and a container for holding the recovered color toner. An erasing light projector 21*a* as a destaticizer eliminates electric charge from the surface of the photosensitive drum 1*a*.

In this first image-forming unit 1*a*, a photosensitive member on the photosensitive drum 1*a* is electrified uniformly by the primary electrifier 2*a*, an electrostatic latent image is formed on the photosensitive member by the latent image-forming means 17*a*, the latent image is developed by the developer 3*a* with a color toner, and the developed toner image is transferred onto the transfer-receiving medium 6 by application of a transfer bias with a transfer blade 4*a* in contact with the belt-shaped transfer-receiving medium holder 8 at the reverse face thereof in the first transfer section. The color toner remaining on the photosensitive member is removed by the cleaning blade of the cleaning means 5*a*, and is recovered by the cleaner. The photosensitive member is destaticized by the erasing light projector 21*a*, and is used repeatedly for the above image-forming process.

The image-forming apparatus of the present invention comprises, in addition to the first image forming unit Pa, in series, the second image-forming unit Pb, the third image-forming unit Pc, and the fourth image-forming unit Pd which have respectively the same constitution as the first image-forming unit Pa but toners of different colors. For example, a magenta toner is used in the first image-forming unit Pa; a cyan toner in the second image-forming unit Pb; a yellow toner in the third image-forming unit Pc; and a black toner in the fourth image-forming unit Pd, and the respective toner images formed are transferred successively on to a transfer-receiving medium in the respective transfer sections. In this process, the respective toner images are transferred with precise registration onto one and the same transfer-receiving medium by one passage of the medium. After completion of the transfer of the images, the transfer-receiving medium 6 is separated form the transfer medium holder 8 by a separation electrifier 14, and is delivered to a fixation device 7. Thereby, a final full-color image is obtained by only one fixation operation.

The fixation device 7 comprises a pair of a fixing roller 71 and a pressing roller 72, and each of the rollers has a heating means 75 or 76 in the interior thereof. Webs 73, 74 remove soiling matters from the face of the fixing rollers. A oil-applying roller 77 as an oil applying means applies a releasing oil like a silicone oil onto the surface of the fixing roller 71. The unfixed color toner image on the transfer-receiving medium 6 is fixed thereon by passing through the press-contact zone between fixing roller 71 and the pressing roller 72 of the fixation device 7 by action of heat and pressure.

In FIG. 1, the transfer medium holder 8 is in a shape of an endless belt, and is driven by a driving roller 10 to move in the arrow mark direction. The numeral 9 denotes a transfer belt cleaning device; the numeral 11, a belt-driven roller; and the numeral 13, a pair of registration rollers for delivering the transfer-receiving medium in the cassette 60 to the transfer medium holder 8. The numeral 17 denotes a polygon mirror which scans the photosensitive drum with a laser light beam from an light source (not shown) to form a latent image, where the scanning light is deflected by a reflection mirror and through an Fθ lens the light beam is condensed on the generatrix of the photosensitive drum.

The electrifying means for primary electrification of the photosensitive member in the present invention may be a non-contact electrifying member like a corona charger which electrifies the photosensitive drum without direct contact, or may be a contact electrifying member like a roller, a blade, or a magnetic brush which electrifies the photosensitive member in contact therewith. However, the contact electrifying member is more suitable in view of prevention of ozone generation in the electrification.

The image-transfer means may be the one which employs a transfer roller which is in contact with the reverse face of the transfer-receiving medium to apply a transfer bias directly thereto, in place of the transfer blade. In place of the above contact transfer means, conventional non-contact transfer medium may also be employed which applies the transfer bias by a corona charger placed at the reverse side of the transfer medium holding member without contact therewith. However, in view of suppression of ozone generation on application of the transfer bias, the contact transfer means is more preferable.

The construction of the contact electrifying means useful in the present invention is explained in detail by reference to a drawing.

Figure 5:
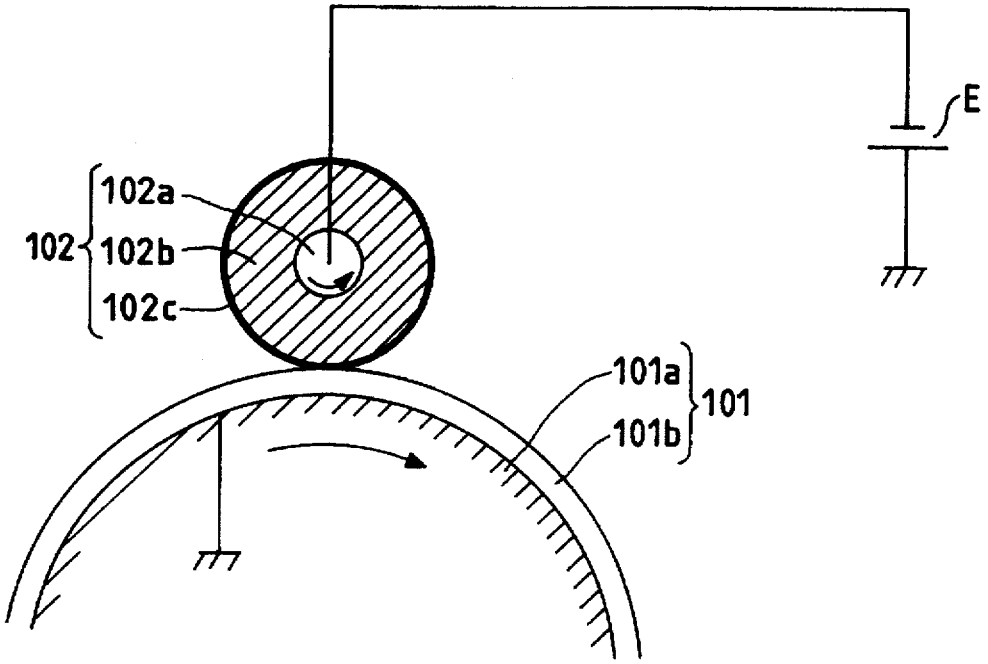
FIG. 5 illustrates schematically the constitution of an electrifying roller of a contact-electrifying means.

FIG. 5 illustrates schematically the constitution of an electrifying roller useful as the contact electrifying means in the present invention. A photosensitive drum 101 as a latent image carrying member comprises an aluminum drum base 101*a* and a photosensitive layer of an organic photoconductive material (OPC) 101*b*, and rotates at a prescribed rate in an arrow mark direction. An electrifying roller 102 as the contact electrifying member is brought into contact with the above photosensitive member 101 at a prescribed pressure. The electrifying roller 102 comprises a metal shaft 102*a*, an electroconductive rubber layer 102*b* provided thereon, and a surface layer 102*c* as a releasing film provided further on the peripheral face thereof. An excessively high resistance of the film prevents electrification of the photosensitive drum 101, while an extremely low resistance thereof causes application of excessively high voltage to the photosensitive drum 101, resulting in damage of the drum or formation of pin holes. Therefore, the releasing film has preferable a volume resistivity ranging from $10^9$ to $10^{14}$ Ωm. The thickness of the releasing film is preferably not larger than 30 μm, and is preferably not smaller than 5 μm for prevention of exfoliation or turn-over of the film.

As a specific example, the electrifying roller 102 useful in the present invention has an outer diameter of 12 mm, comprising an electroconductive rubber layer 102*b* made from EPDM, and a surface layer 102*c* of 10 μm thick made from a nylon resin, and having a hardness (Asker C) of 54.5°. In FIG. 5, an electric source E applies a prescribed voltage to the shaft 102*a* of the electrifying roller 102.

The electroconductive rubber layer of the electrifying roller allows sufficient contact of the electrifying roller with the photosensitive member without causing insufficient electrification.

The above construction of the electrifying roller in which a surface layer 102*c* is formed from a releasing resin like a nylon having a low surface energy, will prevent exudation of a softening agent from the electroconductive rubber at the contact portion of the electrifying roller with the photosensitive member, thereby preventing disturbance in the image caused by fall of the resistance of the photosensitive member, the decrease of electrifying ability caused by formation of a toner film on the photosensitive member, drop of electrification, and deterioration of toner releasability of the photosensitive member. Combination of this construction with the toner used ill the present invention having specified shape factors, high transferability, and less reverse transfer, enables formation of a satisfactory full color image with satisfactory transferability and prevention of reverse transfer.

The electric source E in FIG. 5 is shown to output a DC voltage. However, the voltage may be superposition of a DC voltage and an AC voltage.

The electrifying roller 102 may be driven by the rotating photosensitive drum 101, or rotated in the same direction or reverse direction relative to the rotation of the photosensitive drum 101, or not rotated.

Figure 6:
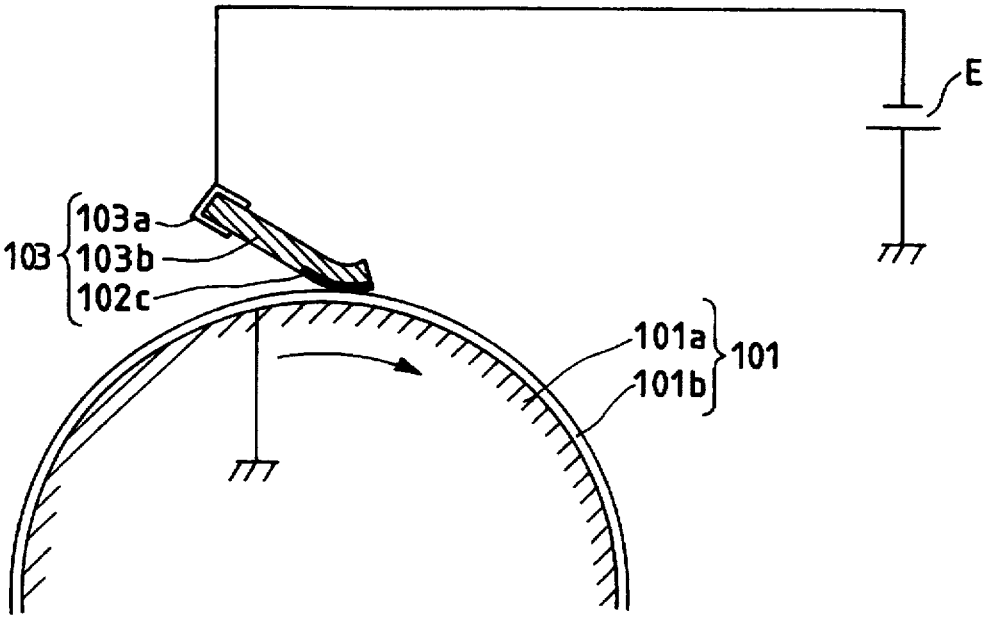
FIG. 6 illustrates schematically the constitution of an electrifying blade of a contact-electrifying means.

FIG. 6 illustrates schematic constitution of the electrifying blade of a contact electrifying means applicable to the present invention. The same reference. numerals as in FIG. 5 are used for the corresponding members without repeating the explanation.

A contact electrifying member 103 is in a shape of a blade, and is brought into contact with a photosensitive drum 101 at a prescribed pressure in a normal direction. This blade 103 comprises a metallic supporting member 103*a*, an electroconductive rubber 103*b* supported by the supporting member 103*a*, and a surface layer 103*c* serving as a releasing film at the portion in contact with the photosensitive drum 101. The surface layer 103*c* is preferably prepared from a releasing resin such as a nylon resin in a thickness of 10 μm. This construction will prevent undesired adhesion of the blade to the photosensitive drum. The effect of the releasing resin as the surface layer on the outside of the electroconductive rubber layer is the same as in the case of the aforementioned electrifying roller.

In the above description, the electrifying member is a roller type or a blade type, but is not limited thereto, and other type of electrifying member may be used in the present invention. The aforementioned electrifying members comprise an electroconductive rubber layer and a releasing film. The constitution is not limited thereto, and a layer of high resistance such as a hydrin rubber layer of less environmental variation is preferably formed between the electroconductive rubber layer and the releasing surface film layer for prevention of leak to the photosensitive member.

The releasing resin may be PVDF (polyvinylidene fluoride) or PVDC (polyvinylidene chloride) in place of the nylon resin.

The photosensitive member may be made of amorphous silicon, selenium, or ZnO. Particularly in the case of amorphous silicon photosensitive member, the insulating film is highly effective in comparison with the other types of photosensitive member, since even the slightest adhesion of the softening agent of the elctroconductive rubber layer to the photosensitive member will cause notable smeared images.

Figure 7:
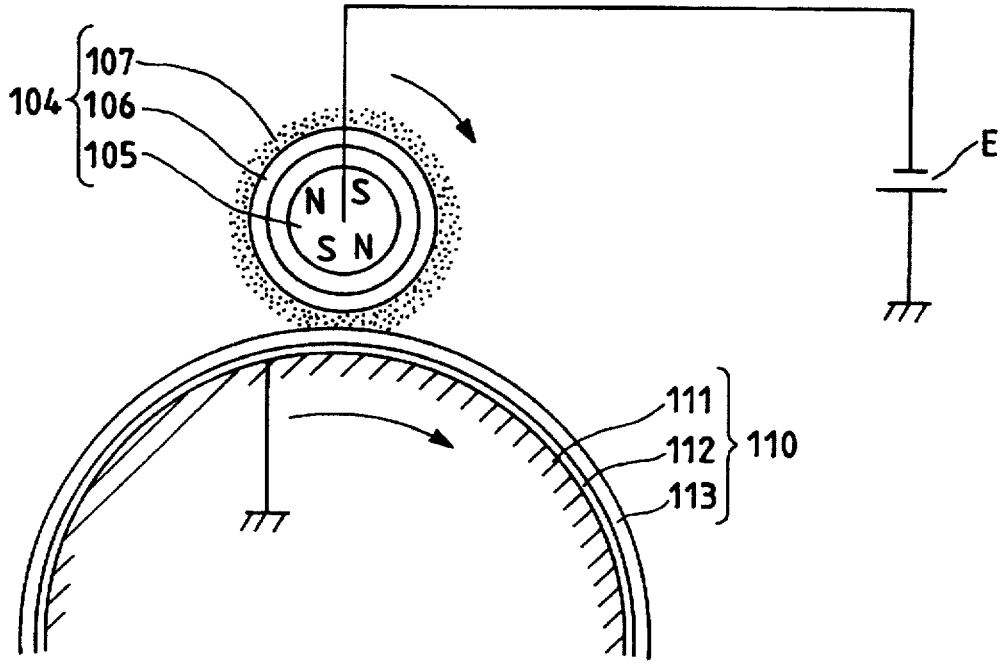
FIG. 7 illustrates schematically the constitution of a magnetic brush of a contact-electrifying means.

FIG. 7 illustrates schematic constitution of a magnetic brush of a contact electrifying means. The magnetic brush electrifier 104 is constituted of a non-magnetic sleeve 106, a magnetic roll 105 placed inside the sleeve 106, and electroconductive magnetic particles 107 confined magnetically on the sleeve 106.

The material for the electroconductive magnetic particles includes mono- or mixed crystals of electroconductive metals, such as ferrite, and magnetite. The material is once sintered and then reduced or oxidized to control the resistance. The electroconductive magnetic particulate material may be particles constituted of electroconductive magnetic fine particles dispersed in a binder polymer, which is produced by blending electroconductive magnetic fine particles with a binder polymer and forming the mixture into particles. The above electroconductive magnetic particles may further be coated with a resin. In this case, the overall resistance of the electroconductive magnetic particles is controlled by the resistance of the coating resin layer, adjusting the amount of an electroconductive agent like carbon in the coating layer.

The average diameter of the electroconductive magnetic particles in the present invention may be in the range of from 1 to 100 μm, but is preferably in the range of from 5 to 50 μm in view of the compatibility of the electrifying properties and the retention of particle state.

The average diameter of the electroconductive magnetic particles in the present invention is a 50%-average particle diameter determined by measuring maximum chord lengths in horizontal direction of 100 or more particles randomly selected under optical or scanning electron microscopy, calculating therefrom volume-particle size distribution.

The magnetic brush electrifier 104 is fixed with a spacer member (not shown in the drawing) at the lengthwise ends thereof with a distance between the surface of the photosensitive drum 110 and the sleeve 106 of from 0.1 to 1 mm, thereby the magnetic brush of the electroconductive magnetic particles 107 is brought into contact with the photosensitive member surface. The sleeve 106 is rotated in the same direction as the drum 110 (clockwise in FIG. 7) with the magnet roll 105 fixed, whereby the photosensitive drum is electrified. For electrification with the magnetic brush 104, the photosensitive member has preferably a charge-injection layer, and the charge is directly injected from the magnetic brush into the charge injection layer.

A preferred constitution of the photosensitive drum for electrification with the magnetic brush is described below in detail.

The photosensitive drum 110 comprises an aluminum base 111, a organic photoconductive material (OPC) layer 112 formed on the aluminum base by forming successively a subbing layer, a positive charge injection-preventing layer, a charge-generating layer, and a charge-transporting layer in this order in lamination, and a charge-injection layer 113 formed further thereon. The charge injection layer 113 is preferably formed by dispersing 20 to 100 parts by weight of electroconductive fine particles in 100 parts by weight of a resin like a photosetting acrylic resin. The material of the electroconductive fine particles includes $SnO_2$, $TiO_2$, ITO, and the like. The particle size of the electroconductive fine particles is preferably not more than 1 μm, more preferably in the range of from 0.5 to 50 nm for uniform electrification.

The average diameter of the electroconductive fine particles in the present invention is a 50%-average particle diameter determined by measuring maximum chord lengths in horizontal direction of 100 or more particles randomly selected by scanning electron microscopy, calculating therefrom volume-particle size distribution.

The binder resin for the electroconductive fine particle includes transparent resins such as acrylic resins, polycarbonates, polyesters, polyethylene-terephthalates, and polystyrenes. Additionally, a lubricating substance such as teflon may be added to the charge-injection layer 113 in an amount of from 10 to 40 parts by weight to 100 parts by weight of the binder resin in order to improve the lubricity of the photosensitive drum surface. A crosslinking agent, and a polylmerization initiator may also be added to the layer for film formation in an appropriate amount. The charge injection layer 113 is provided intentionally as the injection site in order to electrify uniformly the surface of the drum by injecting directly the electric charge from the magnetic brush 104. The charge injection layer 113 should have a resistivity of not lower than $1\times10^8$ Ωcm to prevent diffusion of the charge of the latent image through the surface.

The resistivity of the charge injection layer 113 is determined in the present invention by applying the charge injection layer on an insulating sheet and measuring the surface resistance at an applied voltage of 100 V with a high-resistivity meter 4329A manufactured by Hewlett-Packard Co.

In electrification of the photosensitive member by the magnetic brush electrifier 104, a prescribed voltage is applied to the sleeve 106 to inject electric charge to the charge injection layer 113, whereby the surface of the photosensitive drum 110 is electrified finally to the same potential as the magnetic brush.

The developing device useful in the present invention has a construction described below in detail by reference to a drawing.

The developing system in the present invention includes contact development systems in which a developer held by a developer holder is brought into contact with a photosensitive member surface at a development zone; and also non-contact jumping development systems in which a developer held by a developer holder set apart from a photosensitive member is allowed to fly onto the surface of the photosensitive member at a development zone.

The contact development systems include a method employing a two-component developer comprising a toner and a carrier, and a method employing one component developer.

The contact developing system is preferred from the standpoint of simplicity and compactness of the apparatus since the developing device as the developing means can serve also as a cleaning means for removing the toner remained on the photosensitive member after image transfer, and a separate cleaning means such as a cleaning blade is not necessary.

Figure 8:
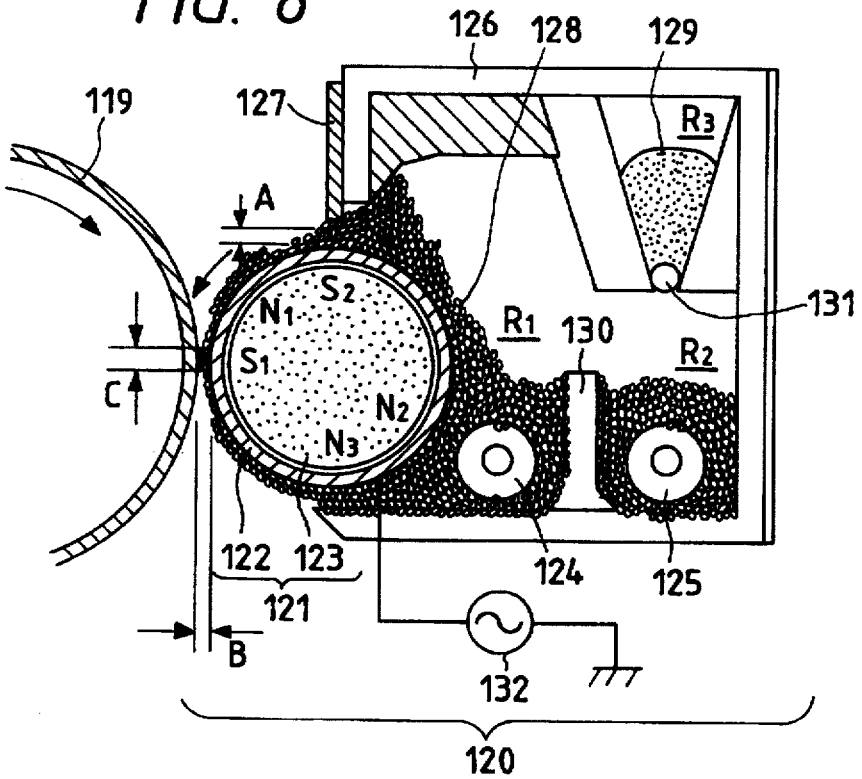
FIG. 8 illustrates schematically the constitution of a developing apparatus of a contact two-component development type.

The two-component contact development system conducts development with a two-component developer containing a toner and a carrier, for example, by means of a development apparatus 120 shown in FIG. 8.

The development apparatus 120 comprises a developer vessel 126 containing a two-component developer 128, a developing sleeve 121 as a developer holding member for holding the two-component developer 128 and feeding it to a development zone, and a development blade 127 as a means for controlling the thickness of the developer layer to control the thickness of the toner layer formed on the development sleeve 121. The development sleeve 121 has a magnet 123 inside a non-magnetic sleeve base 122.

The inside of the developing vessel 126 is partitioned by a partitioning wall 130 into a development room (first room) $R_1$ and an agitation room (second room) $R_2$. Above the agitation room $R_2$, a toner storage room $R_3$ is provided spars from the partitioning wall 130. The developer 128 is stored in the development room $R_1$ and the agitation room $R_2$. A toner for replenishment (non-magnetic toner) 129 is stored in the toner storage room $R_3$. The toner storage room $R_3$ has a replenishing opening 131 for replenishing the toner 129 to the agitation room $R_2$ by gravity in an amount corresponding to the consumed toner.

A delivering screw 124 provided in the development room $R_1$ rotates to deliver the developer 128 in the development room $R_1$ in the direction of the length of the developing sleeve 121. Similarly, a delivery screw 125 provided in the storage room $R_2$ rotates to deliver the toner having fallen from the replenishing opening 131 to the agitation room $R_2$ in the direction of the length of the developing sleeve 121.

The developer 128 is a two-component developer composed of a non-magnetic toner and a magnetic carrier. An aperture is provided at the portion of the development vessel 126 near the photosensitive drum 119. From the aperture, the developing sleeve 121 protrudes outside. A gap is provided between the developing sleeve 121 and the photosensitive drum 119. A bias application means 132 is connected to the non-magnetic developing sleeve 121 to apply a bias.

The magnetic roller, namely a magnet 123, as a magnetic field-generating means fixed in the sleeve base 122 has a developing magnetic pole $S_1$, and a magnetic pole $N_3$, and magnetic poles $N_2$, $S_2$, and $N_1$ for delivery of the developer 128. The magnet 153 is placed in the sleeve base 122 such that the developing magnetic pole $S_1$ is placed in the counter position to the photosensitive drum 119. The developing magnetic pole $S_1$ generates a magnetic field near the development zone between the developing sleeve 121 and the photosensitive drum 119. The magnetic brush is formed by this magnetic field.

The controlling blade 127 placed above the developing sleeve 121 is made of a non-magnetic material such as aluminum and SUS316, and serves to control the layer thickness of the developer 128 on the development sleeve 121. The distance between the edge of the non-magnetic blade 127 and the surface of the developing sleeve 121 is preferably in the range of from 300 to 1000 μm, more preferably from 400 to 900 μm. The distance smaller than 300 μm causes problems of accumulation of the magnetic carrier therein, tending to result in irregularity in the developer layer and insufficient application of the developer, thus forming an irregular image with a low density. In order to prevent non-uniform application of the developer (or blade clogging) caused by unnecessary particles existing in the developer, the distance is preferably not less than 400 μm. The distance larger than 1000 μm will cause increase of the amount of the developer applied onto the developing sleeve 121 to make difficult the control of the development agent layer thickness, whereby the magnetic carrier particles attach to the photosensitive drum in a larger amount to prevent satisfactory circulation of the developer and the control of the development, tending to cause fogging of the image owing to insufficient triboelectricity of the toner.

With this development apparatus 120 employing a two-component type developer, the development is preferably conducted by application of AC voltage and by bringing the magnetic brush composed of the toner and the carrier into contact with the latent image holding member such as a photosensitive drum. The distance B between the developer holding member (developing sleeve) 121 and the photosensitive drum 119 (S-D distance) is preferably in the range of from 100 to 1000 μm to prevent the carrier adhesion and to improve the dot image reproducibility. With the distance shorter than 100 μm, the feed of the developer is liable to be insufficient resulting in low image density, while with the distance longer than 1000 μm, the magnetic force lines will diffuse to lower the density of the magnetic brush, causing poor dot reproducibility and carrier adhesion owing to the weak confining force for the carrier.

The peak to peak voltage of the alternating electric field ranges preferably from 500 to 5000 V, and the frequency thereof ranges preferably from 500 to 10000 Hz, more preferably from 500 to 3000 Hz. The voltage and the frequency are selected to be suitable for the process. The waveform of the alternating electric fields may be triangle, rectangle, or sine curve, or the one having a modified duty ratio. With the applied voltage lower than 500 V, sufficient image density cannot be achieved, and fogging in a non-image area can occur and toner recovery can be insufficient. With the applied voltage of higher than 50000 V, the electrostatic image is liable to be disturbed through the magnetic brush to deteriorate the image quality.

Use of a satisfactorily electrified two-component type developer reduces the fog-inhibiting voltage (Vback) and reduces the primary electrification of the photosensitive member, thereby lengthening the life of the photosensitive member. The Vback is preferably is not higher than 150 V, more preferably not higher than 100 V depending on the developing system.

The contrast potential ranges preferably from 200 to 500 V for sufficient image density.

When the frequency is lower than 500 Hz, charge injection to the carrier is liable to occur to disturb the latent image and lower the image quality. With the frequency higher than 10000 Hz, the toner cannot follow the electric field to cause low image quality.

For conducting the development to obtain sufficient image density with high dot reproducibility without carrier adhesion, the contact width (development nip C) of the magnetic brush on the developing sleeve 121 with the photosensitive drum 119 is preferably in the range of from 3 to 8 mm. With the development nip C of less than 3 mm, sufficient image density and satisfactory dot reproducibility cannot readily be achieved, while with the development nip C of larger than 8 mm, packing of the developer tends to occur to stop the machine or to render difficult the prevention of carrier adhesion. The development nip can be adjusted suitably by adjusting the distance A between the developer-controlling member 127 and the developing sleeve 121, or adjusting the distance B between the developing sleeve 121 and the photosensitive drum 119.

Figure 9:
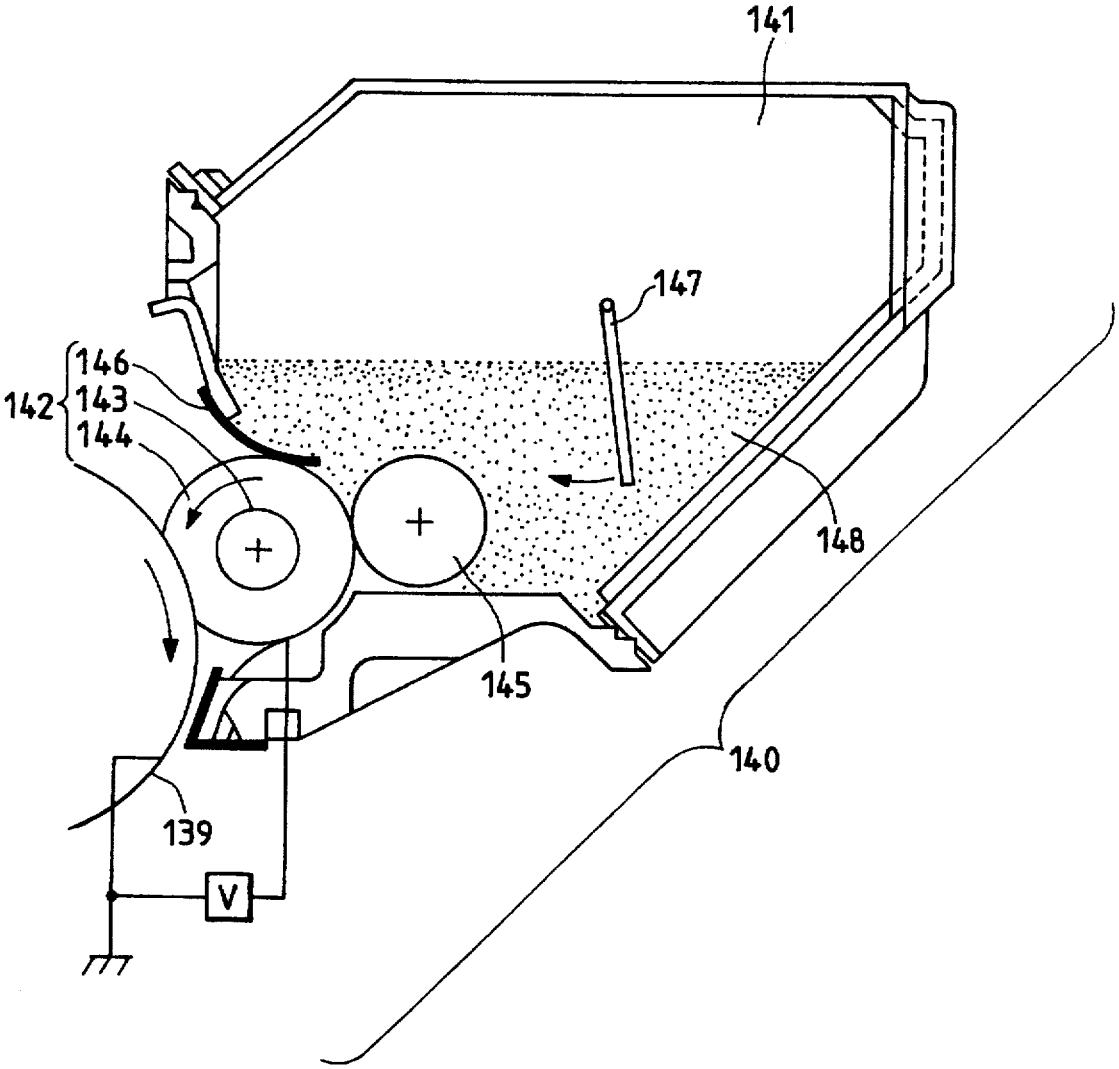
FIG. 9 illustrates schematically the constitution of a developing apparatus of a contact one-component development type.

The contact development with a one-component developer can be conducted either by using a magnetic toner or a non-magnetic toner, and by using, for example, a developing apparatus 140 shown in FIG. 9. The developing apparatus 140 comprises a development vessel 141 containing therein a one-component developer 148 comprised of a magnetic or non-magnetic toner, a developer holding member 142 for holding the one-component developer 148 contained in the development vessel 141 and delivering it to the developing zone. a feeding roller 145 for feeding the developer to the developer holding member, an elastic blade 146 as a member for controlling the thickness of the developer layer on the developer holding member, and an agitation member 147 for stirring the developer 148 in the development vessel 141. The developer holding member 142 is preferably an elastic roller comprising a base roller 143, and an elastic layer 144 formed thereon made of an elastic material such as an elastic rubber or resin (e.g. a foamed silicone rubber). The elastic roller 142 pressed To come into contact with the surface of the photosensitive drum 139 which is the latent image holder, develops a latent image formed on the photosensitive member with the one-component developer 148 present on the surface of the elastic roller, and at the same time it recovers the unnecessary one-component developer 148 remaining on the photosensitive member after the image transfer.

In this embodiment of the present invention, the developer holding member is substantially in contact with the surface of the photosensitive member. That is, even when the one-component developer is not present, the developer holding member is in contact with the photosensitive member. With this developer holding member, an image is obtained without the edge effect owing to the electric field exerting between the photosensitive member and the developer holding member through the developer, and simultaneously cleaning is conducted. The surface of the elastic roller as the developer holding member or vicinity thereof should have a certain level of electric potential, and an electric field needs to exist between the surfaces the photosensitive member and the elastic roller. For this purpose, the elastic roller is prevented from electrical conduction with the surface of the photosensitive member by controlling the resistance of the elastic rubber to a medium-resistance range, or a thin dielectric layer may be formed on the surface layer of the conductive roller. As the other constitution, it is also possible to provide a conductive roller with a conductive resin sleeve where the surface facing the photosensitive member is coated with an insulating material, or with an insulating sleeve having a conductive layer on its surface not facing the photosensitive member.

The elastic roller holding the one-component developer may be rotated in the same direction with the photosensitive member or in the reverse direction. When rotated in the same direction, the toner carrying member may preferably be rotated at a different peripheral speed from that of the photosensitive member, at a peripheral speed ratio of 100% or more. to that of the photosensitive member. If it is less than 100%, a problem occurs in image quality, such that the lane sharpness is poor. As the peripheral speed ratio increases, the quantity of the toner fed to a developing zone increases and the toner more frequently comes off and on the latent image, where the toner is taken off at unnecessary areas and imparted to necessary areas, and this is repeated to obtain a toner image faithful to the latent image. More preferably, the peripheral speed ratio is not less than 110%. In the simultaneous development and cleaning, the effect is expected that the remaining developer adhering to the photosensitive member surface is physically scraped off by the difference of the peripheral speeds for recovery. Therefore, the recovery of the developer is more satisfactory at a higher ratio of the peripheral speeds.

The member 146 for controlling the developer layer thickness is not limited to the elastic blade, and may be an elastic roller of any other type of member which is capable of press-contact with elasticity with the surface of the developer holding member.

The elastic blade and the elastic roller may be made from a rubbery elastic material such as silicone rubbers, urethane rubbers, and NBR rubbers; elastic synthetic resin such as polyethylene terephthalates; and elastic metallic articles such as stainless steel and steel; and composites thereof.

When an elastic blade is employed, the blade is fixed at the upper edge portion thereof to the developer container, and the lower portion of the blade is bent in the normal or reverse direction of the developing sleeve against the blade elasticity with the inside (outside for reverse direction) blade face elastically pressed to the sleeve at an appropriate pressure.

The feeding roller 145 is produced from a foamed material like a polyurethane foam, and rotates in a normal or reversed direction (not a speed of zero) relative to the developer holding member, thereby feeding the one-component developer and scraping off the remaining developer after development (unused toner).

When an electrostatic latent image on the photosensitive member is developed with a one-component developer in the developing zone, a DC and/or AC bias is preferably supplied between the developer holding member and the photosensitive drum.

Next, the non-contact jumping development system is explained below. In the non-contact jumping development system, there are a development system employing a one-component magnetic developer containing a magnetic toner, and another development system employing a one-component non-magnetic developer containing a non-magnetic toner.

The jumping development system employing a one-component magnetic toner containing a magnetic toner is explained by reference to the schematic illustration of FIG. 10.

The developing apparatus 150 comprises a development vessel 151 containing therein a one-component magnetic developer 155 comprised of a magnetic toner, a developer holding member 152 for holding the one-component magnetic developer 155 contained in the development vessel 151 and delivering it to the developing zone, a doctor blade 154 as a restriction member for controlling the thickness of the developer layer on the developer holding member, and a member 156 for agitating the one component magnetic developer 155 in the development vessel 151.

Figure 10:
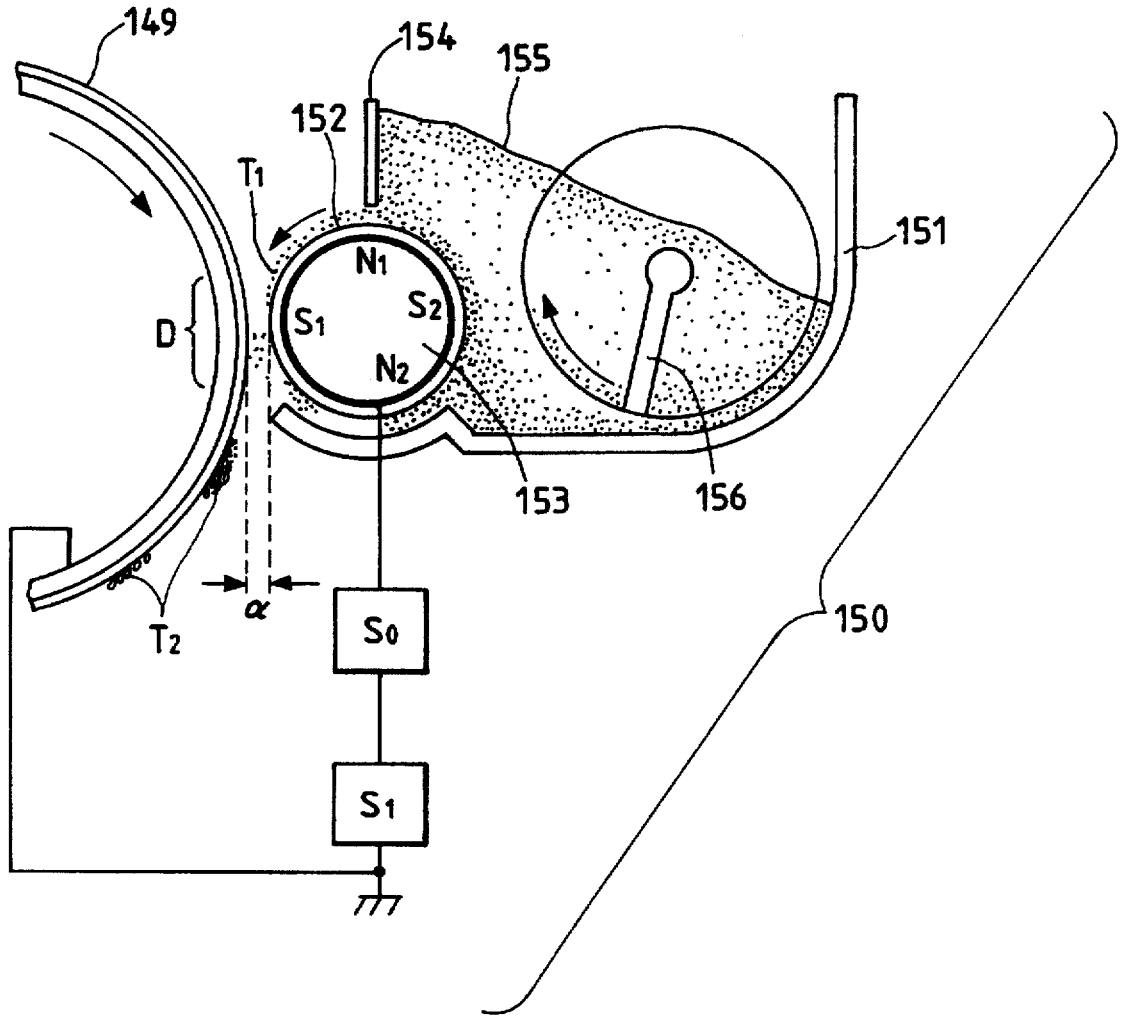
FIG. 10 illustrates schematically the constitution of a developing apparatus of a non-contact one-component magnetic development type.

In FIG. 10, the development sleeve 152 as the developer holding member is kept to be in contact with the stocked toner in the development vessel 151 at about the right half peripheral face thereof. The one-component magnetic developer is attracted to the surface of the development sleeve by the magnetic force of the magnet 153 in the sleeve and/or electrostatic force, and is held on the surface. As The development sleeve 152 rotates, the layer of the developer on the sleeve is allowed to pass through the position of the doctor blade 154, and thereby the one-component magnetic developer is formed into a state of a thin layer $T_1$ having an approximately uniform thickness. The electrification of the one-component magnetic developer is caused mainly by contact friction between the rotating sleeve surface and the developer in the vicinity thereof. The thin layer formed on the development sleeve 152 is moved by the rotation of the development sleeve toward the latent image holding member 149, and passes through the development zone D, namely the closest interval between the latent image holding member 149 and the development sleeve 152. During the passage, particles of the one-component magnetic developer in the thin layer are allowed to fly by the DC and AC electric field generated by the DC and AC voltage applied between the latent image holding member 149 and the development sleeve 152, and move reciprocally within the gap ($\alpha$) of the development zone D between the latent image holding member 149 and the development sleeve 152. Finally the particles of the one-component magnetic developer are transferred from the development sleeve 152 onto the surface of the electrostatic latent image holding member 149 in accordance with the potential pattern of the latent image selectively to form a developer image $T_2$ successively.

After passing through the development zone D, the face of the development sleeve from which the selected part of the one-component magnetic developer is removed is brought again by rotation to the stock of the developer in the development vessel, and is replenished with the one-component magnetic developer. The thin layer $T_1$ of the one-component magnetic developer on the development sleeve 152 is moved to the development zone D, and thus the development process is repeated.

The doctor blade as the member for controlling the developer layer thickness is a metallic blade or a magnetic blade (such as the blade 154 as shown in FIG. 14), placed at a certain gap from the development sleeve. In place of the doctor blade, a rigid roller, or sleeve of metal, resin or ceramic may be used. A magnetizing means may be provided therein.

In one-component developing systems using a magnetic one-component developer or non-magnetic one-component developer, an elastic blade being in contact elastically with the surface of the development sleeve is useful as the member for controlling the developer layer thickness. An elastic roller may be used in place of the doctor blade.

The material for the elastic blade or the elastic roller includes rubbers, such as silicone rubbers, urethane rubbers, and NBR rubbers; synthetic resin elastomers such as polyethylene terephtnalate resins; metallic elastic articles such as stainless steel and steel; and composites thereof. Of these, rubber elastomers are preferred.

The material of the elastic blade of the elastic roller will affect greatly the electrification of the developer on the developer holding member. For that reason, organic or inorganic substances may be incorporated, melt blended, or dispersed in the elastic material. Such substances include metal oxides, powdery metals, ceramics, carbon allotropes, whiskers, inorganic fibers, dyes, pigments, and surfactants. For controlling electrification of the developer, article made of a resin, rubber, metal oxide, or metal may be attached on the sleeve-contact portion. For durability of the elastic article or the developer holding member, a preferable constitution is an elastic metal article and a rubber article bonded thereto at the place in contact with the development sleeve.

When a negatively chargeable developer is employed, the elastic article is preferably formed from a material such as urethane rubbers, urethane resins, polyamides, nylon resins, and other positively chargeable materials. When a positively chargeable developer is employed, the elastic article is preferably formed from a material such as urethane rubbers, urethane resins, silicone rubbers, silicone resins, polyester resins, fluororesins (e.g., teflon resins), polyimide resins, and other negatively chargeable materials. When the sleeve-contact portion is a molded article of a resin or a rubber, it may preferably contain a metal oxide such as silica, alumina, titania, tin oxide, zirconia, and zinc oxide; carbon black, and conventionally used charge-controlling agent for toners.

Figure 11:
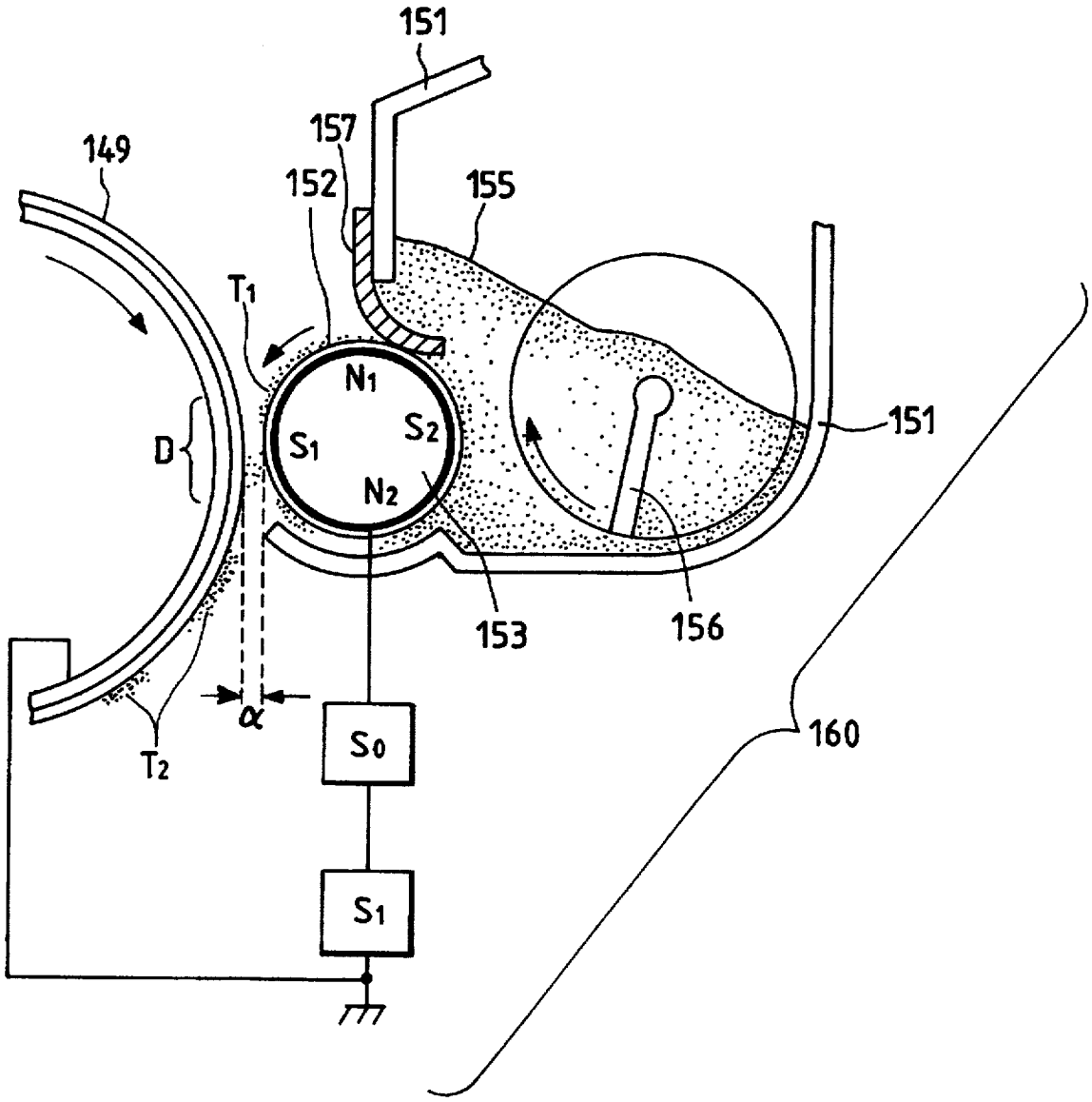
FIG. 11 illustrates schematically a developing apparatus in which an elastic blade is substituted for the developer layer thickness control means of the apparatus of FIG. 10.

FIG. 11 illustrates schematically a developing apparatus 160 in which an elastic blade 157 is employed in place of the doctor blade 154 as a member for controlling the developer layer thickness in the apparatus 150 shown in FIG. 10. The elastic blade 157 is fixed at its end to the development vessel 151 and the other end is elastically pressed to a developer holding member 152. In FIG. 11, the same reference numerals are used for the same constitutional member as in FIG. 10.

The elastic blade 157 as the developer layer thickness-controlling member is fixed at its upper end portion to the development vessel 151, and the lower portion of the blade is brought into contact with the development sleeve surface elastically in a distorted state at appropriate pressure in the forward direction of the development sleeve at the inside face of the blade, or in the reverse direction of the development sleeve at the outside face of the blade. With such an apparatus, a thin and close toner layer can be formed stably independently of variation in environmental conditions. This is probably for the reason that the developer is forced to rub against the sleeve surface, so that electrification may be effected at any times in the same state in spite of change in environmental conditions in comparison with an apparatus equipped with a conventional metal blade apart from the development sleeve by a certain distance. In the above apparatus employing an elastic blade, the electrification tends to become excessive to cause fusion-bonding of the toner onto the development sleeve or the blade. However, the toner in the present invention, which has excellent fluidity, can be used even in such an apparatus without problems.

In the development with a one-component magnetic developer, the contact pressure of the elastic blade against the development sleeve (as a line pressure in the generatrix direction of the development sleeve) is preferably not lower than 0.1 kg/m, more preferably in the range of from 0.3 to 25 kg/m, still more preferably from 0.5 to 12 kg/m. At the contact pressure of lower than 0.1 kg/m, the application of the developer becomes non-uniform to broaden the electrification distribution, and to cause image fogging and developer scattering. At the contact pressure of higher than 25 kg/m, the developer is pressed at an excessively high pressure to cause deterioration and agglomeration of the developer, so that a larger torque is required disadvantageously for driving the developer holding member.

The gap $\alpha$ between the latent image holding member and the developer holding member is preferably in the range of from 50 to 500 μm. When a magnetic blade is employed as a developer thickness controlling member, the gap between the magnetic blade and the developer holding member is preferably in the range of from 50 to 400 μm in the present invention.

The layer thickness of the one-component magnetic developer on the developer holding member is preferably smaller than the gap $\alpha$ between the latent image holding member and the developer holding member. However, in some cases, the layer thickness of the one-component magnetic developer may be controlled such that a part of the many ears of the developer layer comes into contact with the electrostatic latent image holding member.

The development sleeve is rotated at a peripheral speed of from 100% to 200% of that of the latent image holding member. The peak-to-peak voltage of the AC bias is preferably not less than 0.1 kV, more preferably in the range of from 0.2 to 3.0 kV, still more preferably from 0.3 to 2.0 kV. The AC bias frequency is preferably in the range of from 1.0 to 5.0 kHz, more preferably from 1.0 to 3.0 kHz, still more preferably from 1.5 to 3.0 kHz. The waveform of the AC bias may be rectangular, sine-wave, saw-tooth, or triangular. Further, asymmetric AC bias may be applied in which the voltage or the time of positive and negative polarity is different. A DC bias may be superposed preferably onto the AC bias.

The development sleeve in the present invention is made of a material such as metals and ceramics. Of these, aluminum and stainless steel are preferred in view of the chargeability of the developer. The development sleeve as drawn or machined is useful without further working. However, for controlling the delivery and friction chargeability of the developer, the surface of the sleeve may be ground, roughened in peripheral or length direction, blasted, or coated. In the present invention, blasting may be conducted with a regular-shaped particles and/or irregular-shaped particles as the blasting agent, and double blasting is also effective.

Any abrasive grains are useful as the irregular-shaped particulate material for the blasting.

The regular-shaped particulate material includes rigid spheres of a specified diameter of a metal such as stainless steel, aluminum, steel, nickel, and brass, and rigid spheres of ceramics, plastics, or glass beads. The regular-shaped particle has a substantially curved surface, and preferably a spherical or spheroidal, having a ratio of the major axis to the minor axis of preferably from 1 to 2, more preferably from 1 to 1.5, still more preferably from 1 to 1.2. The regular-shaped particles for the blasting of the development sleeve surface have preferably a diameter (or a major axis) in the range of from 20 to 250 μm. In double blasting, the regular shaped particles have preferably a diameter larger than the irregular-shaped particles, more preferably 1 to 20 times, more preferably 1.5 to 9 times that of the irregular blasting particles.

In double blasting with regular-shaped particles, preferably at least one of the treating time and the collision intensity of the regular particles is less than that with the irregular-shaped particles.

The development sleeve has preferably a surface coating layer containing electroconductive fine particles. The electroconductive fine particulate material is a fine particulate carbon, a mixture of fine particulate carbon and crystalline particulate graphite, or crystalline particulate graphite.

The crystalline graphite is classified roughly into natural graphite and artificial graphite. The artificial graphite is produced by solidifying pitch coke with tar pitch, baking it at about 1200° C., and treating it at a higher temperature of about 2300° C. in a graphatizing furnace whereby carbon crystals grow into graphite. The natural graphite is formed underground during lapse of enormous time with heat and high pressure in the earth into a complete graphite state. The graphite has various excellent properties, and is widely used in industry. The graphite is a dark gray or black crystalline mineral which is highly soft and lubricant. It is used not only for pencils, but is used as a lubricating agent, a fire-resistant material, an electric material, and the like in a form of a powder, a solid, or a paint because of its heat resistance and chemical stability. Its crystal structure is hexagonal or rhombohedral, and is perfectly layered. It is a good electric conductor owing to free electrons existing between the carbon-carbon bonds. Both natural graphite and artificial graphite are useful in the present invention.

The graphite in the present invention has preferably a diameter ranging from 0.5 to 20 μm.

The high polymer material for the coating layer includes thermoplastic resins such as styrene resins, vinyl resins, polyether sulfone resins, polycarbonate resins, polyphenylene oxide resins, polyamide resins, fluororesins, cellulose resins, and acrylic resins; and thermoserring resins and photosetting resins such as epoxy resins, polyester resins, alkyd resins, phenyl resins, melamine resins, polyurethane resins, urea resins, silicone resins, and polyimide resins. Of the above resins, preferred are those having a releasing property such as silicone resins, and fluororesins; and those having excellent mechanical properties such as polyether sulfone resins, polycarbonate resins, polyphenylene oxide resins, polyamide resins, phenol resins, polyester resins, polyurethane resins, styrene resins.

The electroconductive amorphous carbon is defined generally as an assemblage of crystallite formed by burning or thermally decomposing a hydrocarbon or a carbon-containing compound under an air deficient state. The amorphous carbon is especially excellent in electroconductivity, and is used widely as a filler to impart desired electroconductivity to some extent by controlling the amount of addition. The amorphous carbon used in the present invention has preferably a particle diameter ranging from 10 to 80 nm, more preferably from 15 nm to 40 nm.

Next, a development system employing one-component non-magnetic developer containing a non-magnetic toner is explained below by reference to a schematic diagram shown in FIG. 12. The development apparatus 170 comprises a development vessel 171 containing a one-component non-magnetic developer 176 containing a member 172 for holding the one-component non-magnetic developer 176 and delivering it to the development region, a roller 173 for feeding the one-component non-magnetic developer onto the developer holding member, an elastic blade 174 as a mender for controlling developer layer thickness on the developer holding member, and an agitating member 175 for agitating the one-component non-magnetic developer 176 in the development vessel 171.

A latent image is formed on a latent image holder 169 by an electrophotographic means or an electrostatic recording means not shown in the drawing. A development sleeve 172 is employed as the developer holder, which is a non-magnetic sleeve made of aluminum or stainless steel.

As the development sleeve, a drawn pipe of aluminum or stainless may be used without further processing. However, The surface is preferably roughened uniformly by blowing glass beads; mirror-polished; or coated with a resin, which is similar to the one employed in the system of the non-contacting one-component magnetic developer as shown in FIG. 10.

The one-component non-magnetic developer 176 is stored in the development vessel 171, and is fed by the feeding roller 173 onto the developer holding member 172. The feeding roller 173 is made of a foamed material such as polyurethane foam, and rotates at a relative rotation speed of not zero in the same or reverse direction of the rotation of the developer holding member, thereby feeding the developer, and scraping off the developer not used for development from the developer holding member 172. The one-component non-magnetic developer fed onto the developer holding member 172 is applied in a uniform thin layer by the elastic blade 174.

The contact line pressure of the elastic application blade against the developer holding member preferably in the range of from 0.3 to 25 kg/m, more preferably from 0.5 to 12 kg/m along the generatrix direction of the development sleeve. With the contact pressure of lower than 0.3 kg/m, the application of the one-component non-magnetic developer becomes non-uniform to broaden the electrification distribution in the developer causing image fogging and scattering image. With the contact line pressure of higher than 25 kg/m, the developer is exposed to an excessively high pressure to cause deterioration and agglomeration of the developer, and thereby a larger torque is required for driving the developer holding member, disadvantageously. The contact pressure of from 0.3 to 25 kg/m enables effective disintegration of the aggregates of the one-component non-magnetic developer in the present invention, and instantaneous charge up of the one-component developer.

The control member for developer layer thickness is similar to the one employed for the non-contacting one-component magnetic development system shown in FIG. 10. The material for the elastic blade and the elastic roller is selected from the materials having triboelectric characteristics suitable for electrifying the developer to the desired polarity, and being similar to the material suitable for the non-contacting one-component magnetic development system. The suitable material includes silicone rubbers, urethane rubbers, and styrene-butadiene rubbers. Additionally, an organic resin layer may be formed thereon in the present invention, the organic resin including polyamides, polyimides, nylons, melamine resins, melamine-crosslinked nylons, phenol resins, fluororesins, silicone resins, polyester resins, urethane resins, and styrene resins. For an appropriate electroconductivity and suitable properties for electrifying non-contacting one-component developer, the elastic blade or the roller, which is made of an electroconductive rubber or resin, may contain in the rubber, a filler or a charge-controlling agent such as metal oxides, carbon black, inorganic whiskers, and inorganic fibers in accordance with the non-contacting one-component magnetic development system shown in FIG. 10.

In formation of the thin layer of one-component non-magnetic developer on the developing sleeve by means of a blade in the one-component non-magnetic developing system, preferably the layer thickness of the developer is controlled to be smaller than the gap β between the development sleeve and the latent image holding member and an AC voltage is applied to the gap in order to obtain a sufficient image density. Specifically, as shown in FIG. 12, an AC field or a AC-DC superposition field is applied as a development bias from the bias source between the development sleeve and the latent image-holding member to facilitate the transfer of the one-component non-magnetic developer from the development sleeve to the latent image-holding member. The conditions for application of the electric field are in accordance with the non-magnetic one-component development system shown in FIG. 10.

In the image-forming method of the present invention having at least a first image-forming unit and a second image-forming unit, the length of the transfer-receiving medium along the delivery direction thereof is larger than the spacing between the first image-transfer section of the first image-forming unit and the second image-transfer section of the second image-forming unit, the intensity of the first transfer bias is different from the intensity of the second transfer bias, and the first toner for forming the first image and the second toner for forming the second image both have shape factors of SF-1 ranging from 100 to 180 and SF-2 ranging from 100 to 140. Thereby, the method has advantages that the efficiency of developer transfer is high; the reverse transfer of the developer is inhibited; the transfer at the second transfer section is less affected by the passage of the transfer-receiving medium through the first transfer section; formed image is excellent in uniformity; and full-color images are formed with less color tone variation regardless of the temperature and humidity in the environment, at a speed higher than conventional methods.

EXAMPLES

Now, a method of manufacturing a toner and a photosensitive drum according to the invention will be described in greater detail by way of examples and comparative examples.

Preparation of Cyan Toner 1

Ion-exchanged water (710 g) was put into 450 g of 0.1M —$Na_3PO_4$ aqueous solution, which was then heated to 600° C. and subsequently stirred by means of a TK-type Homo-mixer (available from Tokushu Kika Kogyo) at a rate of 1,200 rpm. Then, 68 g of 1.0M—$CaCl_2$ aqueous solution was gradually added thereto to obtain an aqueous medium containing $Ca_3(PO_4)_2$.

Meanwhile, a composition of:

| | | |
|---|---|---|
| (Monomers) | Styrene | 170 g |
| | n-Butylacrylate | 40 g |
| (Coloring agent) | C.I. pigment blue 15:3 | 15 g |
| (Electric charge controlling agent) | Metal salicylate | 3 g |
| (Polar resin) | Saturated polyester | 10 g |

was heated to 60° C. and evenly dissolved and dispersed by means of a TK-type Homo-mixer (available from Tokushu Kika Kogyo). 10 Grams of 2,2'-azo-bis(2,4-dimethylvaleronitrile) was dissolved as polymerization initiator to form a polymeric monomer composition. The polymeric monomer composition was put into the above aqueous medium and stirred for 10 minutes by means of a TK-type Homo-mixer at 60° C. in an $N_2$ atmosphere to obtain a pelletized polymeric monomer composition. Subsequently, the composition was heated to 80° C. and held to this temperature for 10 hours for polymerization, while it was being incessantly stirred by means of a paddle-type stirring blade. When the reaction of polymerization was completed, the residual monomer was removed by distillation under reduced pressure for 3 hours and the obtained polymer was cooled. Thereafter, hydrogen chloride was added thereto and calcium phosphate was dissolved into it. Then, the polymer was filtered, washed with water and dried to obtain suspended cyan particles (toner particles) 1 having an average particle diameter of about 7.5 μm and a sharp variation coefficient of 27% for particle size distribution. The residual monomer content of the obtained toner particles 1 was 140 ppm.

1.5 Parts by weight of hydrophobic silica A treated with a silane coupling agent and dimethyl silicon oil to a hydrophobicity of 95% and an average particle diameter of 15 nm were externally added to 98.5 parts by weight of the obtained toner particles 1 to produce suspended polymerized cyan toner 1. A two-component type developer was prepared by mixing 5 parts by weight of the obtained cyan toner 1 and 95 parts by weight of a carrier substance of acryl-coated ferrite.

The toner shape factors of the obtained cyan toner were determined to be SF-1=110 and SF-2=108.

Preparation of Cyan Toner 2

The preparation procedures of Preparation of Cyan Toner 1 were followed except that the residual monomer was removed by distillation under reduced pressure for 30 minutes to obtain suspended cyan particles (toner particles) 2 with a residual toner content of 2,000 ppm, to which hydrophobic silica A was externally added to produce suspended polymerized cyan toner 2. A two-component type developer was prepared by mixing it with a carrier substance.

Preparation of Cyan Toner 3

The preparation procedures of Preparation of Cyan Toner 1 were followed except that 1.5 parts by weight of hydrophobic silica B processed by a cyan coupling agent to a hydrophobicity of 87% and an average particle diameter of 20 nm was externally added to 98.5 parts by weight of sorted toner particles 1 to produce suspended polymerized cyan toner 3. A two-component type developer was prepared by mixing it with a carrier substance.

Preparation of Cyan Toner 4

The preparation procedures of Preparation of Cyan Toner 1 were followed except that 1.5 parts by weight of silica C surface-treated by dimethyldichlorosilane to a hydrophobicity of 55% and an average particle diameter of 16 nm was externally added to 98.5 parts by weight of sorted toner particles 1 to produce suspended polymerized cyan toner 4. A two-component type developer was prepared by mixing it with a carrier substance.

Preparation of Cyan Toner 5

The preparation procedures of preparation of Cyan Toner 1 were followed except that 1.0 part by weight of hydrophobic silica A and 1.0 part by weight of hydrophobic silica D surface-treated with a silane coupling agent and dimethyl silicone oil to a hydrophobicity of 94% and an average particle diameter of 70 nm were externally added to 98.0 parts by weight of classified toner particles 1 to produce suspended polymerized cyan toner 5. A two-component type developer was prepared by mixing it with a carrier.

Preparation of Cyan Toner 6

The preparation procedures of Preparation of Cyan Toner 1 were followed except that 1.0 part by weight of hydrophobic silica E surface-treated with a silane coupling agent to a hydrophobicity of 91% and an average particle diameter of 100 nm and 1.0 part by weight of hydrophobic silica F surface-treated with a silane coupling agent to a hydrophobicity of 90% and an average particle diameter of 110 nm were externally added to 98.0 parts by weight of classified toner particles 1 to produce suspended polymerized cyan toner 6. A two-component type developer was prepared by mixing it with a carrier.

Preparation of Cyan Toner 7

The preparation procedures of Preparation of Cyan Toner 1 were followed except that 1.0 part by weight of hydrophobic silica A and 1.0 part by weight of hydrophobic silica G surface-treated with a silane coupling agent to a hydrophobicity of 90% and an average particle diameter of 140 nm were externally added to 98.0 parts by weight of classified toner particles 1 to produce suspended polymerized cyan toner 7. A two-component type developer was prepared by mixing it with a carrier.

Preparation of Cyan Toner 8

The preparation procedures of Preparation of Cyan Toner 1 were followed except that 1.0 part by weight of hydrophobic silica A and 1.0 part by weight of hydrophobic silica H surface-treated with a silane coupling agent to a hydrophobicity of 93% and an average particle diameter of 26 nm were externally added to 98.0 parts by weight of classified toner particles 1 to produce suspended polymerized cyan toner 8. A two-component type developer was prepared by mixing it with a carrier substance.

Preparation of Cyan Toner 9

The preparation procedures of Preparation of Cyan Toner 1 were followed except that 1.0 part by weight of treated silica C and 1.0 part by weight of hydrophobic silica D to 98.0 parts by weight of classified toner particles 1 to produce suspended polymerized cyan toner 9. A two-component type developer was prepared by mixing it with a carrier substance.

Preparation of Cyan Toner 10

180 Parts by weight of nitrogen-substituted water and 20 parts by weight of a 0.20 wt % aqueous solution of polyvinylalcohol were put into a four-necked flask and 77 parts by weight of styrene, 22 parts by weight of n-butyl acrylate, 1.4 parts by weight of benzoyl peroxide and 0.2 parts by weight of divinylbenzene were added thereto and the mixture was stirred to produce a suspension. Thereafter, the suspension in the flask was subjected to an operation of nitrogen-substitution and then heated to 80° C. and held to this temperature for 10 hours for polymerization.

The produced polymer was washed with water and then dried under reduced pressure at 65° C. to obtain a resin substance. Then, the obtained resin, metal-containing azo dye, C.I. pigment blue 15:3 and low molecular weight polypropylene were mixed in an amount of 88 wt %, 2 wt %, 5 wt %, and 3 wt %, respectively in a fixed-tank-type dry mixer and the mixture was molten and kneaded by a biaxial extruder with a vent connected to a suction pump for sucking.

The molten and kneaded mixture was then coarsely crushed in a hammer mill To produce a coarsely crushed toner composition of 1 mm-mesh-pass. The grains of coarsely crushed composition was further crushed by a mechanical crusher until they show a volume average particle diameter of 20 to 30μm and, subsequently, crushed for another time in a jet mill that utilizes collisions of whirling particles. The particulate toner composition was then modified by means of heat and mechanical shearing force in a surface modifier and classified by a multi-stage classifier to produce particles of cyan toner 10 having an average particle diameter of 7.9 μm and a variation coefficient of 32% for particle size distribution. The residual monomer content of the obtained toner particles 10 was 200 ppm.

1.5 Parts by weight of hydrophobic silica A were externally added to 98.5 parts by weight of the obtained toner particles 10 to produce crushed toner 10. A two-component type developer was prepared by mixing 5 parts by weight of the obtained cyan toner 10 and 95 parts by weight of a carrier of acryl-coated ferrite.

The toner shape factors of the obtained cyan toner were determined to be SF-1=175 and SF-2=136.

Preparation of Cyan Toner 11

180 Parts by weight of nitrogen-substituted water and 20 parts by weight of 0.2 wt % aqueous solution of polyvinylalcohol were put into a four-necked flask and 77 parts by weight of styrene, 22 parts by weight of n-butyl acrylate, 1.5 parts by weight of benzoyl peroxide and 0.3 parts by weight of divinylbenzene were added thereto and the mixture was stirred to produce a suspension. Thereafter, the suspension in the flask was then subjected to an operation of nitrogen-substitution and then heated to 80° C. and held to this temperature for 10 hours for polymerization.

The produced polymer was washed with water and then dried under reduced pressure at 65° C. to obtain a resin substance. Then, the obtained resin, metal-containing ezo dye, C.I. pigment blue 15:3 and low molecular weight polypropylene were mixed in an amount of 88 wt %, 2 wt %, 5 wt %, and 3 wt %, respectively in a fixed-tank-type dry mixer and the mixture was molten and kneaded by a biaxial extruder.

The molten and kneaded mixture was then coarsely crushed in a hammer mill to produce a coarsely crushed toner composition of 1 mm-mesh-pass. The grains of coarsely crushed composition was further crushed by an air-type crusher provided with a collision panel. Subsequently, they were classified by a multi-stage classifier to produce particles of cyan toner 11 having an average particle diameter of 7.5 μm and a variation coefficient of 28% for particle size distribution. The residual monomer content of the obtained toner particles 11 was 300 ppm.

Hydrophobic silica A was externally added to the obtained toner particles 11 to produce crushed cyan toner 11 as in the case of cyan toner 10 above. A two-component type developer was prepared by mixing the obtained cyan toner 11 and a carrier material.

The toner shape factors of the obtained cyan toner were determined to be SF-1=191 and SF-2=161.

Preparation of Cyan Toner 12

The preparation procedures of Preparation of Cyan Toner 11 were followed except that particles of cyan toner 11 were treated to show a spherical form by means of heat and mechanical shearing force in a surface modifier and classified by a multi-stage classifier to produce particles of cyan toner 12 having a weight-average particle diameter of 7.4 μm.

Hydrophobic silica A was externally added to the obtained toner particles 12 to produce crushed cyan toner 12 as in the case of cyan toner 10 above. A two-component type developer was prepared by mixing the obtained cyan toner 12 and a carrier material.

The toner shape factors of the obtained cyan toner were determined to be SF-1=170 and SF-2=130.

Preparation of Cyan Toner 13

180 Parts by weight of nitrogen-substituted water and 20 parts by weight of 0.2 wt % aqueous solution of polyvinylalcohol were put into a four-necked flask and 77 parts by weight of styrene, 22 parts by weight of n-butyl acrylate, 1.5 parts by weight of benzoyl peroxide and 0.3 parts by weight of divinylbenzene were added thereto and the mixture was stirred to produce a suspension. Thereafter, the suspension in the flask was subjected to an operation of nitrogen-substitution and then heated to 80° C. and held to this temperature for 10 hours for polymerization.

The produced polymer was washed with water and then dried under reduced pressure at 65° C. to obtain a resin substance. Then, the obtained resin, metal-containing azo dye, C.I. pigment blue 15:3 and low molecular weight polypropylene were mixed in an amount of 50 wt %, 1 wt %, 5 wt %, and 1 wt %, respectively in a fixed-tank-type dry mixer and the mixture was molten and kneaded by a biaxial extruder with a vent connected to a suction pump for sucking.

The molten and kneaded mixture was then coarsely crushed in a hammer mill to produce a coarsely crushed toner composition of 1 mm-mesh-pass. The grains of coarsely crushed composition was further crushed by a mechanical crusher until they show a volume average particle diameter of 20 to 30 μm. Subsequently, they were classified by a multi-stage classifier to produce particles of cyan toner 13 having an average particle diameter of 7.0 μm and a variation coefficient of 38% for particle size distribution. The residual monomer content of the obtained toner particles 13 was 200 ppm.

Hydrophobic silica A was externally added to the obtained toner particles 13 to produce crushed cyan toner 13 as in the case of cyan toner 10 above. A two-component type developer was prepared by mixing the obtained cyan toner 13 and a carrier material.

The toner shape factors of the obtained cyan toner were determined to be SF-1=171 and SF-2=160.

Preparation of Cyan Toner 14

The preparation procedures of Preparation of Cyan Toner 10 were followed except that different classifying conditions were used to produce suspended cyan particles (toner particles) 14 with a weight-average particle diameter of about 7.9 μm and a variation coefficient of 38% for particle size distribution, to which hydrophobic silica A was externally added to produce suspended polymerized cyan toner 14. A two-component type developer was prepared by mixing the obtained cyan toner 14 and a carrier material.

Preparation of Cyan Toner 15

The preparation procedures of Preparation of Cyan Toner 10 were followed except that the obtained resin was dried at 45° C. under an ordinary pressure to produce particles of cyan toner 15 with a residual monomer content of 1,800 ppm, to which hydrophobic silica A was externally added to produce cyan toner 15. A two-component type developer was prepared by mixing the obtained cyan toner 15 and a carrier material.

Table 1 shows the compositions and the properties of the obtained cyan toners 1 through 15.

Preparation of Magenta Toners 1–15

The preparation procedures of Preparation of Cyan Toners 1–15 were followed except that C.I. pigment blue 15:3 was replaced by C.I. pigment red 122 to produce magenta toners 1–15 respectively. Two-component type developers were prepared by respectively mixing the obtained magenta toners 1–15 and a carrier material.

Preparation of Yellow Toners 1–15

The preparation procedures of Preparation of Cyan Toners 1–15 were followed except that C.I. pigment blue 15:3 was replaced by C.I. pigment yellow 17 to produce yellow toners 1–15 respectively. Two-component type developers were prepared by respectively mixing the obtained yellow toners 1–15 and a carrier material.

Preparation of Black Toners 1–15

The preparation procedures of Preparation of Cyan Toners 1–15 were followed except that C.I. pigment blue 15:3 was replaced by furnace carbon black to produce black toners 1–15 respectively. Two-component type developers were prepared by respectively mixing the obtained black toners 1–15 and a carrier material. Preparation of Black Toners 16

A composition of:

| | | |
|---|---|---|
| (Monomers) | Styrene | 165 g |
| | n-Burylacrylate | 35 g |
| (Coloring agent) | C.I. pigment blue 15:3 | 15 g |
| (Electric charge controlling agent) | Metal salicylate | 5 g |
| (Polar resin) | Saturated polyester | 10 g |

was heated to 60° C. and evenly dissolved and dispersed by means of a TK-type Homo-mixer (available from Tokushu Kika Kogyo) rotating at a rate of 12,000 rpm. 10 Grams of 2,2'-azo-bis(2,4-dimethylvaleronitrile) were dissolved as polymerization initiator to form a polymeric monomer composition.

The polymeric monomer coalposition was put into the aqueous medium of Preparation of Cyan Toner 1 and stirred for 20 minutes by means of a TK-type Homo-mixer at 60° C. in an $N_2$ atmosphere to obtain a pelletized polymeric monomer composition. Subsequently, the composition was heated to 80° C. and held to this temperature for 10 hours for polymerization, while it was being incessantly stirred by means of a paddle-type stirring blade. When the reaction of polymerization was completed. the residual monomer was removed by distillation under reduced pressure for 3 hours under the conditions same as those of Preparation of Cyan Toner 1 and the obtained polymer was cooled. Thereafter, hydrochloric acid was added thereto and calcium phosphate was dissolved into it. Then, the polymer was filtered, washed with water and dried to obtain suspended black particles (toner particles) 16 having a weight average particle diameter of about 7.2 μm and a sharp variation coefficient of 28% for particle size distribution. The residual monomer content of the obtained toner particles 16 was 160 ppm.

Hydrophobic silica A was externally added to the obtained toner particles 16 under the conditions exactly same as those of Preparation of Cyan Toner 1 to produce suspended polymerized black toner 16. A two-component type developer was prepared by mixing the obtained black toner 16 and a carrier substance.

The toner shape factors of the obtained black toner were determined to be SF-1=112 and SF-2=110.

Preparation of Cyan Toners 21–35

The preparation procedures of Preparation of Cyan Toners 1–15 were followed except the external additives were used by the rates listed in Table 2 to produce cyan toners 21–35 respectively. The obtained cyan toners were used as so many one-component type developers.

Preparation of Magenta Toners 21–35

The preparation procedures of Preparation of Cyan Toners 21–35 were followed except that the amounts of the external additives of Preparation of Magenta toners 1–15 were changed to those as listed in Table 2 to produce magenta toners 21–35 respectively. The obtained magenta toners were used as so many one-component type developers.

Preparation of Yellow Toners 21–35

The preparation procedures of Preparation of Cyan Toners 21–35 were followed except that the amounts of the external additives of Preparation of Yellow Toners 1–15 were changed to those as listed in Table 2 to produce yellow toners 21–35 respectively. The obtained yellow toners were used as so many one-component type developers.

Preparation of Black Toners 21–35

The preparation procedures of Preparation of Cyan Toners 21–35 were followed except that the amounts of the external additives of Preparation of Black Toners 1–15 were changed to those as listed in Table 2 to produce black toners 21–35 respectively. The obtained black toners were used as so many one-component type developers.

Preparation of Black Toner 36

180 Parts by weight of nitrogen-substituted water and 20 parts by weight of 0.2 wt % aqueous solution of polyvinylalcohol were put into a four-necked flask and 77 parts by weight of styrene, 22 parts by weight of n-butyl acrylate, 1.2 parts by weight of benzoyl peroxide and 0.2 parts by weight of divinylbenzene were added thereto and the mixture was stirred to produce a suspension. Thereafter, the suspension in the flask was subjected to an operation of nitrogen-substitution and then heated to 80° C. and held to this temperature for 10 hours for polymerization.

The produced polymer was washed with water and then dried under reduced pressure at 65° C. to obtain a resin substance. Then, the obtained resin, a particulate magnetic substance of 0.1 μm, metal-containing azo dye, carbon black and low molecular weight polypropylene were mixed in an amount of 55 wt %, 40 wt %, 1 wt %, 3 wt %, end 1 wt %, respectively in a fixed-tank-type dry mixer and the mixture was molten and kneaded by a biaxial extruder.

The molten and kneaded mixture was then coarsely crushed in a hammer mill to produce a coarsely crushed toner composition of 1 mm-mesh-pass. The grains of coarsely crushed composition was further crushed by a mechanical crusher until they show a volume average particle diameter of 20 to 30 μm and, subsequently, crushed for another time by an air-type crusher provided with a collision panel. The particulate toner composition was then modified by means of heat and mechanical shearing force in a surface modifier and classified by a multi-stage classifier to produce particles of black toner 36 having a weight-average particle diameter of 6.8 μm and a variation coefficient of 31% for particle size distribution. The residual monomer content of the obtained toner particles 36 was 180 ppm.

2.0 Parts by weight of hydrophobic silica A was externally added to 98 parts by weight of the obtained black particles 36 to produce crushed toner 36 as in the case of cyan toners. The obtained black toner was used as a one-component type developer.

The toner shape factors of the obtained black toner were determined to be SF-1=148 and SF-2=135.

Preparation of Photosensitive Drum A

10 Parts by weight of electroconductive titanium oxide (coated with tin oxide and having an average primary particle diameter of 0.4 μm), 10 parts by weight of phenol resin precursor (resol Type), 10 parts by weight of methanol and 10 parts by weight of butanol were dispersed in a send mill, applied to an aluminum cylinder by immersion and then heat-set at 140° C. to form an electroconductive layer having a volume resistivity of $5\times10^{9}$ cm and a thickness of 20 μm.

Subsequently, 10 parts by weight of methoxymethylated nylon (with a degree of methoxymethylation of about 30%) having a chemical structure as expressed by the formula:

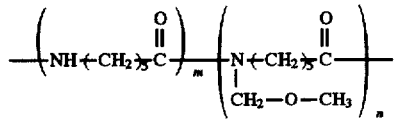

where m and n are integers, was mixed with and dissolved into 150 parts by weight of isopropanol and the solution was applied onto the electroconductive layer by immersion to produce an undercoat layer of 1 μm.

Then, 10 parts by weight of azo pigment having a chemical structure as expressed by the formula:

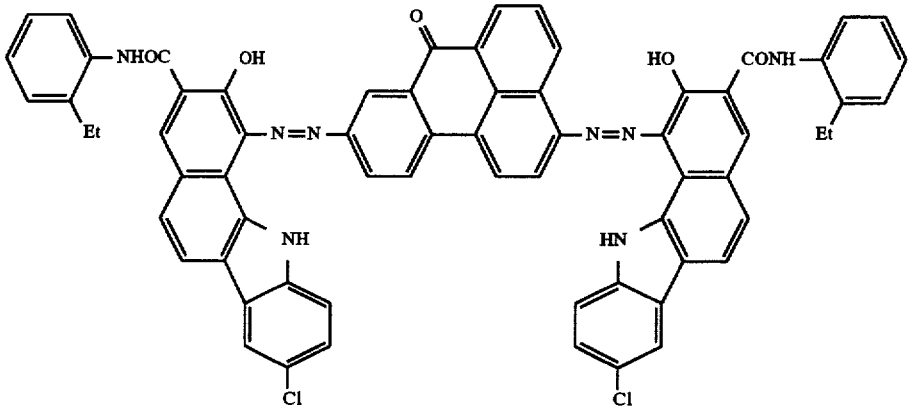

and 5 parts by weight of polycarbonate resin (bis-phenol A type with a molecular weight of 30,000) having a chemical structure as expressed by the formula:

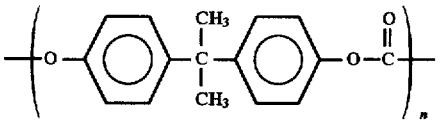

where n is an integer, were dissolved in 700 parts by weight of cyclohexanone and dispersed in a sand mill and the dispersed solution was applied onto said undercoat layer by immersion to produce a charge-generating layer having a thickness of 0.05 μm.

Subsequently, 3 parts by weight of triphenylamine having a chemical structure as expressed by the formula:

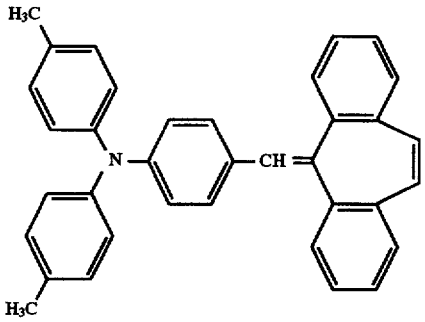

7 parts by weight of triphenylamine having chemical structure as expressed by the formula:

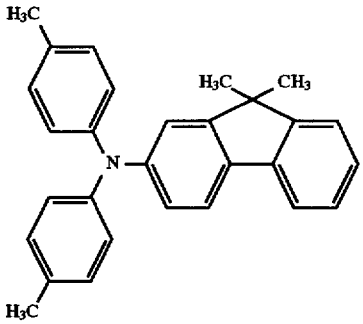

10 parts by weight of polycarbonate resin bis-phenol Z type with a molecular weight of 20,000) having a chemical structure as expressed by the formula:

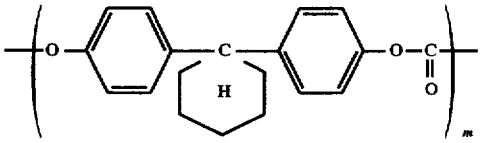

where m is an integer, 50 parts by weight of monochlorobenzene and 15 parts by weight of dichloromethane were mixed by stirring and then the mixture was applied onto said charge-generating layer by immersion. The cylinder carrying said mixture applied thereto was then dried in a hot air flow to produce a charge-transporting layer having a thickness 20 μm.

Then, 3 parts by weight of fine particles of carbon fluoride (with an average particle diameter of 0.27 μm, available from Central Glass), 5.5 parts by weight of polycarbonate resin bis-phenol Z type with a molecular weight of 80,000) having a chemical structure as expressed by the formula:

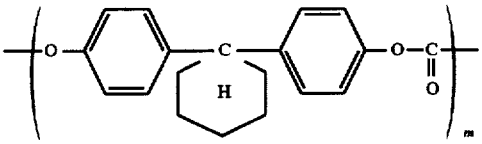

where m is an integer, 0.3 parts by weight of fluorine-substituted graft polymer (with a F content of 24 wt % and a molecular weight of 25,000) having e chemical structure as expressed by the formula:

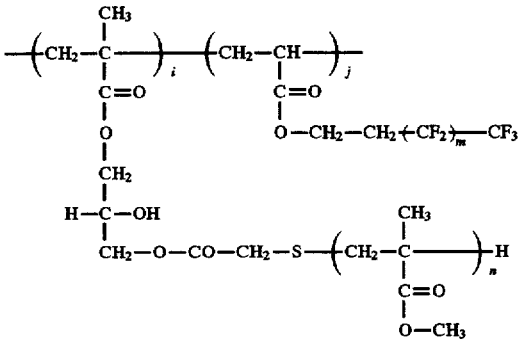

where i, j, m and n are integers, 120 parts by weight of monochlorobenzene and 80 parts by weight of dichloromethane were mixed and dispersed in a sand mill. Then, 2.5 parts by weight of triphenylamine having a chemical structure as expressed by the formula:

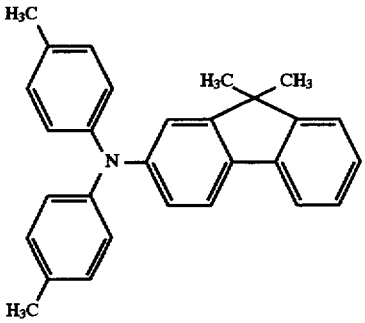

was dissolved into the above mixture, which was then applied onto said charge-transporting layer by means of a sprayer to produce a photosensitive drum A with a 4 μm thick protection-layer.

After peeling off the surface of said photosensitive drum, the elements on the surface were quantitatively analyzed by means of an X-ray photo-electron spectroscope (ESCALAB 200-X Type, available from VG). An area of 2×3 mm was analyzed to a depth of several angstroms by using a MgKa (300 W) for the source of X-rays. The elements and their quantities existing on the surface of the photosensitive member were found to be F by 11.3% and C by 75.5%, the F/C ratio being 0.150.

Preparation of Photosensitive Drum B

The preparation procedures of Preparation of Photosensitive Drum A were followed to produce Photosensitive Drum B except that the protection layer was formed in the following way.

One part by weight of fine particles of really spherical three-dimensional cross-linked polycyloxane (with an average particle diameter of 0.29 μm, available from Toshiba Silicon), 6 parts by weight of polycarbonate resin bis-phenol Z type with a molecular weight of 80,000) having a chemical structure as expressed by the formula:

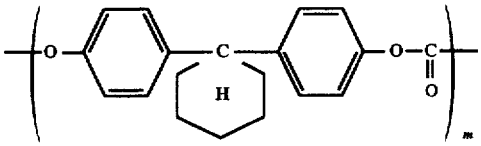

where m is an integer, 0.1 parts by weight of polydimethylcycloxanemethacrylate-methylmethacrylate block copolymer (with a molecular weight of 50,000 and an Si content of 12 wt %) having a structure as expressed by the formula:

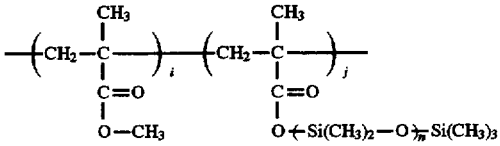

where i and j are integers and n is an integer between 1 and 15, 120 parts by weight of monochlorobenzen and 80 parts by weight of dichloromethane were mixed and dispersed in a sand mill. Then, 3 parts by weight of triphenylamine having a chemical structure are expressed by the formula:

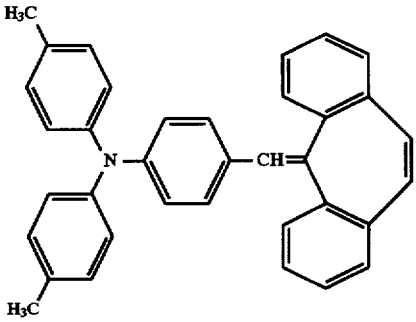

was dissolved into the above mixture, which was then applied onto the charge-transporting layer obtained in the above Preparation of Photosensitive Drum A by means of a sprayer to produce a photosensitive drum with a 3 μm thick protection layer to produce Photosensitive Drum B.

The elements and their quantities existing on the surface of the photosensitive member were found to be Si by 10.2% and C by 69.3%, the Si/C ratio being 0.147.

Preparation of Photosensitive Drum C

The preparation procedures of Preparation of Photosensitive Drum A were followed to produce Photosensitive Drum C except that it carried layers up to the charge-transporting layer and no protection layer was formed.

No F atoms nor Si atoms were found on the surface of this photosensitive member and, therefore, both the F/C and Si/C ratios were equal to nil.

Preparation of Photosensitive Drum D.

The preparation procedures of Preparation of Photosensitive Drum A were followed to produce Photosensitive Drum B except that the protection layer was formed in the following manner.

30 Parts by weight of acrylic monomer expressed by the formula:

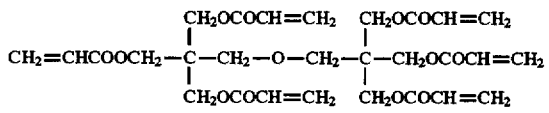

50 parts by weight of ultra-fine particles of tin oxide (with an average particle diameter of 400 Å prior to dispersion), 20 parts by weight of fine particles of polytetrationfluoroethylene resin (with an average particle diameter of 0.18 μm), 18 parts by weight of 2-methylthioxanthone as photopolymerization initiator and 150 parts by weight of ethanol were dispersed in a sand mill for 66 hours to produce a solution for application, which was then applied to the charge-transporting layer by immersion and caused to be photo-set by light irradiated from a high voltage mercury lamp at an intensity of 800 W/cm$^2$ for 60 seconds and subsequently dried at 120° C. in a hot air flow for 2 hours to produce a protection layer with a thickness of 3 μm.

The elements and their quantities existing on the surface of the photosensitive member were found to be F by 11.5% and C by 74.8%, the F/C ratio being 0.154.

Preparation of Photosensitive Drum E

The preparation procedures of Preparation of Photosensitive Drum B were followed to produce Photosensitive Drum E except that a protection layer was formed on the charge-transporting layer in the following manner.

30 Parts by weight of acrylic monomer expressed by the chemical formula:

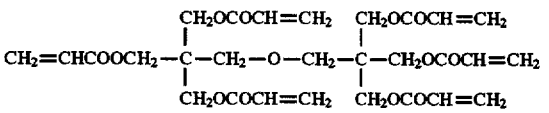

50 parts by weight of ultra-fine particles of tin oxide (with an average particle diameter of 400 Å prior to dispersion), 20 weight portion of fine particles of really spherical three-dimensional cross-linked polycyloxane (with an average particle diameter of 0.29 μm), 18 parts by weight of 2-methylthioxanthone as photopolymerization initiator and 150 parts by weight of ethanol were dispersed in a sand mill for 66 hours to produce a solution for application, which was then applied to the charge-transporting layer by immersion and caused to be photo-set by light irradiated from a high voltage mercury lamp at an intensity of 800 W/cm$^2$ for 60 seconds and subsequently dried a% 120° C. in a hot air flow for 2 hours to produce a protection layer with a thickness of 3 μm.

The elements and their quantities existing on the surface of the photosensitive body were found to be Si by 9.98% and C by 70.1%, the Si/C ratio being 0.142.

Preparation Of Photosensitive Drum F

The preparation procedures of Preparation of Photosensitive Drum D were followed to produce Photosensitive Drum F carrying a protection layer except that no polytetrafluoroethylene copolymer was added to the solution to be applied.

No F atoms nor Si atoms were found on the surface of this photosensitive member and, therefore, both the F/C and Si/C ratios were equal to nil.

Examples 1–15 and Comparative Examples 1–2

For these examples, an image-forming unit for magenta as shown in FIG. 4 and another image-forming unit for cyan same as the one for magenta were arranged in the cited order onto an image-forming apparatus having a configuration as shown in FIG. 1. In each of the image-forming units, the photosensitive drum had a diameter of 30 mm and was provided with an urethane blade abutted against the drum as cleaning means for removing the toner remaining on the photosensitive member after each image-transfer operation, which toner was then collected by a cleaner unit, and also with a corona-charger as electrifying or charging means, a transfer blade as image-transfer means and a transfer belt as transfer material carrying means, said transfer blade being abutted against the back side of said transfer belt. The image-transfer operation was carried out under the following conditions. An image portion was exposed to light emitted from a semiconductor laser operating as latent image forming means. A two-component, contacting type developing unit as shown in FIG. 8 was used as developing means for reversal image development.

For image development, the proximal end surface of the non-magnetic blade was separated by 500 μm for distance A from the surface of the development sleeve. The surface of the development sleeve was separated by 500 μm for distance B from the surface of the photosensitive drum. The development nip C was equal to 6 mm. A rectangularly parallelepipedic alternating pulse voltage with a peak-to-peak voltage of 2,000V and a frequency of 2,000 Hz was applied between the development sleeve and the photosensitive drum as developing bias voltage.

For image transfer, a first transfer bias voltage for a transfer current of 12 μA and a transfer voltage of +3.5 kV was applied to the first image-forming unit or the magenta unit, whereas a second transfer bias voltage for a transfer current of 12 μA and a transfer voltage of +4.3 kV was applied to the second image-forming unit or the cyan unit.

A-4 sized sheets (length of about 297 mm×width of about 210 mm) of recording paper were transversally fed at a rate of 15 sheets per minutes for the image-forming operation.

A heat roller fining unit was used for fixation.

Magenta Toners 1 through 15 and Cyan Toners 1 through 15 were used in the above described image-forming apparatus along with Photosensitive Drums A through C in the combinations listed in Table 3 in a high temperature and high humidity environment of 30° C. and 80% Rh. A total of 50,000 images were continuously formed for each combination and subjected to the following evaluations.

Image Uniformity

The formed images were evaluated for image uniformity in terms of the change in the color tone on each sheet of image transfer material at the second transfer section before and after passing the first transfer section in the above defined high temperature and high humidity environment.

The gap between the transfer sections was made to vary stepwise from 150 mm to 80 mm with a step of 10 mm for the image-forming operation in the high temperature and high humidity environment. The initial image uniformity was evaluated and expressed in terms of the gap between the transfer sections with which the images formed in the initial stages of operation revealed a visually recognizable change in the color tone for the first time (a change in the color tone taking place between the upstream region and the downstream regions in the conveyance direction of the sheet of image transfer material).

Additionally, the image uniformity after continuous image forming runs was evaluated and expressed in terms of the gap between the transfer sections with which the images formed after 50,000 runs revealed a visually recognizable change in the color for the first time (a change in the color tone taking place between the upstream region and the downstream regions in the conveyance direction of the sheet of image transfer material) as the gap was made to vary stepwise from 150 mm to 80 mm with a step of 10 mm for the image-forming operation in the high temperature and high humidity environment.

Transfer Efficiency

The transfer efficiency was evaluated on images formed in the initial stages of image-forming operation and those formed after 50,000 runs in the above defined high temperature and high humidity environment. For each run, the magenta toner image (with an image density of 1.4) formed on the photosensitive drum of the magenta unit was picked up by a transparent adhesive tape and the image density (D1) was determined by means of a MacBeth densitometer or a color reflection densitometer (Color Reflection Densitometer X-RITE 404A available from X-Rite). Then, a magenta toner image was formed again on the photosensitive drum and transferred onto a sheet of image transfer material and the transferred image on the sheet of image transfer material was picked up by means of a transparent adhesive tap to determine the image density (D2) of the transferred image. The transfer efficiency was defined by formula below.

$$\text{Transfer efficiency } (\%)=(D2/D1)\times 100$$

Retransfer Rate

The retransfer rate was evaluated only on images formed in the initial stages of image-forming operation.

After the magenta toner image (with an image density of 1.4) was transferred on a sheet of recording material in a run, it was picked up by a transparent adhesive tape and the image density (D3) was determined by means of a MacBeth densitometer or a color reflection densitometer. Then, The magenta toner image was once again transferred on a sheet of recording material in the magenta unit and, thereafter, a solid white image was formed in the cyan unit (as no toner image was existent on the photosensitive drum) and transferred on the sheet of recording material on which the magenta images had been transferred (but, in fact, only an image transfer operation was carried out because no cyan toner image was existent there). Then, the magenta toner image on the sheet of image transfer material was picked up by a transparent adhesive tape and the image density (D4) of the picked up image was determined. The retransfer rate was defined by formula below.

$$\text{Retransfer rate } (\%)=[(D3-D4)/D3]\times 100$$

Waste Toner Collecting Box Service Life

The number of sheets of image transfer material was counted until a waste toner collecting box with a capacity of 100 cc was filled with waste toner and replaced with another box in the magenta unit in the high temperature and high humidity environment.

The results of the above evaluations are listed in Table 3.

Examples 16 and 17

For these examples, an image-forming unit for magenta, and another image-forming unit for cyan, and further another image-forming unit for yellow were arranged in the cited order onto an image-forming apparatus used for Examples 1–15 and full color images were formed as in the case of these examples except that the operation of image transfer was conducted under the following conditions.

For image transfer, a first transfer bias voltage for a transfer current of 12 μA and a transfer voltage of +3.5 kV was applied to the first image-forming unit or the magenta unit, whereas a second transfer bias voltage for a transfer current of 12 μA and a transfer voltage of +4.3 kV was applied to the second image-forming unit or the cyan unit and a third transfer bias voltage for a transfer current of 12 μA and a transfer voltage of +5.1 kV was applied to the third image-forming unit or the yellow unit.

A two-component developing agent of a combination of Magenta Toner 1, Cyan Toner 1 and Yellow Toner 1 was used for Example 16, whereas a two-component developing agent of a combination of Magenta Toner 5, Cyan Toner 5 and Yellow Toner 5 was used for Example 17. Photosensitive Drum A was used and the transfer sections were separated by a distance of 80 mm to carry out 50,000 continuous runs in the high temperature and high humidity environment. After the 50,000 runs, no change in the color tone was visually recognized and excellent full color images were formed.

Examples 18 and 19

For these examples, image-forming units for magenta, cyan, yellow, and black were arranged in the cited order onto an image-forming apparatus used for Examples 1–15 and full color images were formed as in the case of these examples except that the operation of image transfer was conducted under the following conditions.

For image transfer, a first transfer bias voltage for a transfer current of 12 μA and a transfer voltage of +3.5 kV was applied to the first image-forming unit or the magenta unit and a second transfer bias voltage for a transfer current of 12 μA and a transfer voltage of +4.3 kv was applied to the second image-forming unit or the cyan unit, whereas a third transfer bias voltage for a transfer current of 12 μA and a transfer voltage of +5.1 kV was applied to the third image-forming unit or the yellow unit and a fourth transfer bias voltage for a transfer current of 12 μA and a Transfer voltage of +5.9 kV was applied to the fourth image-forming unit or the black unit.

A two-component developing agent of a combination of Magenta Toner 1, Cyan Toner 1, Yellow Toner 1, and Black Toner 1 was used for Example 18, whereas a two-component developing agent of a combination of Magenta Toner 5, Cyan Toner 5, Yellow Toner 5, and Black Toner 5 was used for Example 19. Photosensitive Drum A was used and the transfer sections were separated by a distance of 80 mm to conduct 50,000 continuous runs in the high temperature and high humidity environment. After the 50,000 runs, no change in the color tone was visually recognized and excellent full color images wore formed.

Additionally, images were formed in an environment of ordinary temperature and humidity of 23° C. and 60%Rh under the following image transfer conditions to find that excellent full color images were formed after 50,000 continuous runs.

For image transfer, a first transfer bias voltage for a transfer current of 15 μA and a transfer voltage of +4 kV was applied to the first image-forming unit or the magenta unit and a second transfer bias voltage for a transfer current of 15 μA and a transfer voltage of +4.9 kV was applied to the second image-forming unit or the cyan unit, whereas a third transfer bias voltage for a transfer current of 15 μA and a transfer voltage of +5.8 kV was applied to the third image-forming unit or the yellow unit and a fourth transfer bias voltage for a transfer current of 15 μA and a transfer voltage of +6.6 kV was applied to the fourth image-forming unit or the black unit.

Example 20

For this example, the image-forming procedures of Examples 18 and 19 were followed except that the transfer means of each of the image-forming units of Examples 18 and 19 was replaced by a non-contact transfer means, which was a corona charger, and the following image transfer conditions were used to obtain images, that were as good as those of Examples 18 and 19. However, Examples 18 and 19 were advantageous in that the rate of ozone generation was controllable in those examples.

For image transfer, a first transfer bias voltage for a transfer current of 50 μA and a transfer voltage of +7.2 kV was applied to the first image-forming unit or the magenta unit and a second transfer bias voltage for a transfer current of 70 μA and a transfer voltage of +7.2 kV was applied to the second image-forming unit or the cyan unit, whereas a third transfer bias voltage for a transfer current of 90 μA and a transfer voltage of +7.2 kV was applied to the third image-forming unit or the yellow unit and a fourth transfer bias voltage for a transfer current of 110 μA and a transfer voltage of +7.2 kV was applied to the fourth image-forming unit or the black unit.

Examples 21–35 and Comparative Examples 3–4

For these example, the image-forming procedures of Examples 1–15 and Comparative Examples 1–2 were followed except that the electrifying or charging means of each of the image-forming units was replaced by a contacting charger comprising a charging roller carrying a film of nylon resin on the surface of an electroconductive rubber layer of the roller and made to abut the photosensitive drum as shown in FIG. 5 to produce images that were as good as those of Examples 1–15 and Comparative Examples 1–2.

Examples 36 and 37

For these example, the image-forming procedures of Examples 16 and 17 were followed except that the charging means of each of the image-forming units was replaced by a contacting charger comprising a charging roller carrying a film of nylon resin on the surface of an electroconductive rubber layer of the roller and made to abut the photosensitive drum as shown in FIG. 5 to produce images that were as good as those of Examples 16 and 17.

Examples 38 and 39

For these example, the image-forming procedures of Examples 18 and 19 were followed except that the charging means of each of the image-forming units was replaced by a contacting charger comprising a charging roller carrying a film of nylon resin on the surface of an electroconductive rubber layer of the roller and made to abut the photosensitive drum as shown in FIG. 5 to produce images that were as good as those of Examples 18 and 19.

Example 40

For this example, the image-forming procedures of Example 38 were followed except that Black Toner 1 used in Example 38 was replaced by Black Toner 16 to produce full color images that were as good as those of Example 38.

Examples 41–55 and Comparative Examples 5–6

For these example, the image-forming procedures of Examples 1–15 and Comparative Examples 1–2 were followed except that photosensitive Drums A, B and C were replaced respectively by Photosensitive Drums D, E and F in the image-forming units, and the charging means of each of the image-forming units was replaced by a magnetic brush charger (contacting charger) comprising a magnetic brush arranged on an electroconductive sleeve and made to abut the photosensitive drum in order to directly inject an electric charge into the drum as shown in FIG. 7 and that the cleaning means was removed and the toner remaining on the surface of the photosensitive drum after the transfer operation was collected by the developing unit. 30,000 continuous runs were conducted to evaluate the image uniformity, the transfer efficiency and the retransfer rate as in the case of Examples 1–15 and Comparative Examples 1–2.

Additionally, the charging performance and the image-forming performance were also evaluated in a manner as described below.

Charging Performance

After the continuous image forming runs, a DC voltage of −750V was applied to the electroconductive sleeve of the electric charger of the most downstream image-forming unit to see the charged potential of the surface of the photosensitive drum from OV in terms of percentage relative to −750V and the following ratings were used.

A: 95% or more (excellent charging)

B: 90% or more but less than 95% (good charging)

C: less than 90% (insufficient charging)

Image-Forming Performance

The image-forming performance was determined by the fogging effect in white background that represented the electric charge of the photosensitive drum. The fogging effect was by turn determined by means of a reflection densitometer (REFLECTOMETER MODEL TC-6DS, available from TOKYO DENSHOKU CO., LTD). After the continuous image forming runs, a flat or solid white image was formed in each of the image-forming units and transferred and fixed on a sheet of image transfer material. The image-forming performance was defined in terms of Ds–Dr, where Ds was the worst reflection density of the white area of the sheet and Dr was the average reflection density of the sheet before the transfer of the image, and the following ratings were used.

A: 2% or less (substantially no fogging effect)

B: more than 2% and not more than 5% (slight fogging effect)

C: more than 5% (significant fogging effect)

The results of the evaluations are shown in Table 4.

Examples 56 and 57

For these example, the image-forming procedures of Examples 16 and 17 were followed except that, in each of the image-forming units, the photosensitive drum was replaced by Photosensitive Drum D and the charging means was replaced by a magnetic brush charger (contacting charger) comprising a magnetic brush arranged on an electroconductive sleeve and made to abut the photosensitive drum in order to directly inject an electric charge into the drum as shown in FIG. 7 and that the cleaning means was removed and the toner remaining on the surface of the photosensitive drum after the transfer operation was collected by the developing unit. 30,000 Continuous runs were conducted to evaluate the image uniformity, the transfer efficiency and the retransfer rate as in the case of Examples 16 and 17.

Additionally, the charging performance and the image-forming performance were also evaluated as in the case of Examples 41–55 and Comparative Examples 5–6.

As a result, no change in the color tone was observed and excellent full color images could be formed after the 30,000 runs in both Example 56 using Magenta Toner 1, Cyan Toner 1 and Yellow Toner 1 in combination and Example 57 using Magenta Toner 5, Cyan Toner 5 and Yellow Toner 5 in combination. Additionally, excellent charging and image-forming performances were observed in these example.

Examples 58 and 59

For these example, the image-forming procedures of Examples 18 and 19 were followed except that, in each of the image-forming units, the photosensitive drum was replaced by Photosensitive Drum D and the charging means was replaced by a magnetic brush charger (contacting charger) comprising a magnetic brush arranged on an electroconductive sleeve and made to abut the photosensitive drum in order to directly inject an electric charge into the drum as shown in FIG. 7 and that the cleaning means was removed and the toner remaining on the surface of the photosensitive drum after the transfer operation was collected by The developing unit. 30,000 continuous runs were conducted to evaluate the image uniformity, the transfer efficiency and the retransfer rate as in the case of Examples 18 and 19.

Additionally, the charging performance and the image-forming performance were also evaluated as in the case of Examples 41–55 and Comparative Examples 5–6.

As a result, no change in the color tone was observed and excellent full color images could be formed after the 30,000 runs in both Example 58 using Magenta Toner 1, Cyan Toner 1 and Yellow Toner 1 in combination and Example 59 using Magenta Toner 5, Cyan Toner 5 and Yellow Toner 5 in combination. Additionally, excellent charging and image-forming performances were observed in these example.

Example 60

For this example, the image-forming procedures of Example 58 were followed except that Black Toner 1 used in Example 58 was replaced by Black Toner 16 to produce full color images that were as good as those of Example 58.

Examples 61–75 and Comparative Examples 7–8

Figure 12:
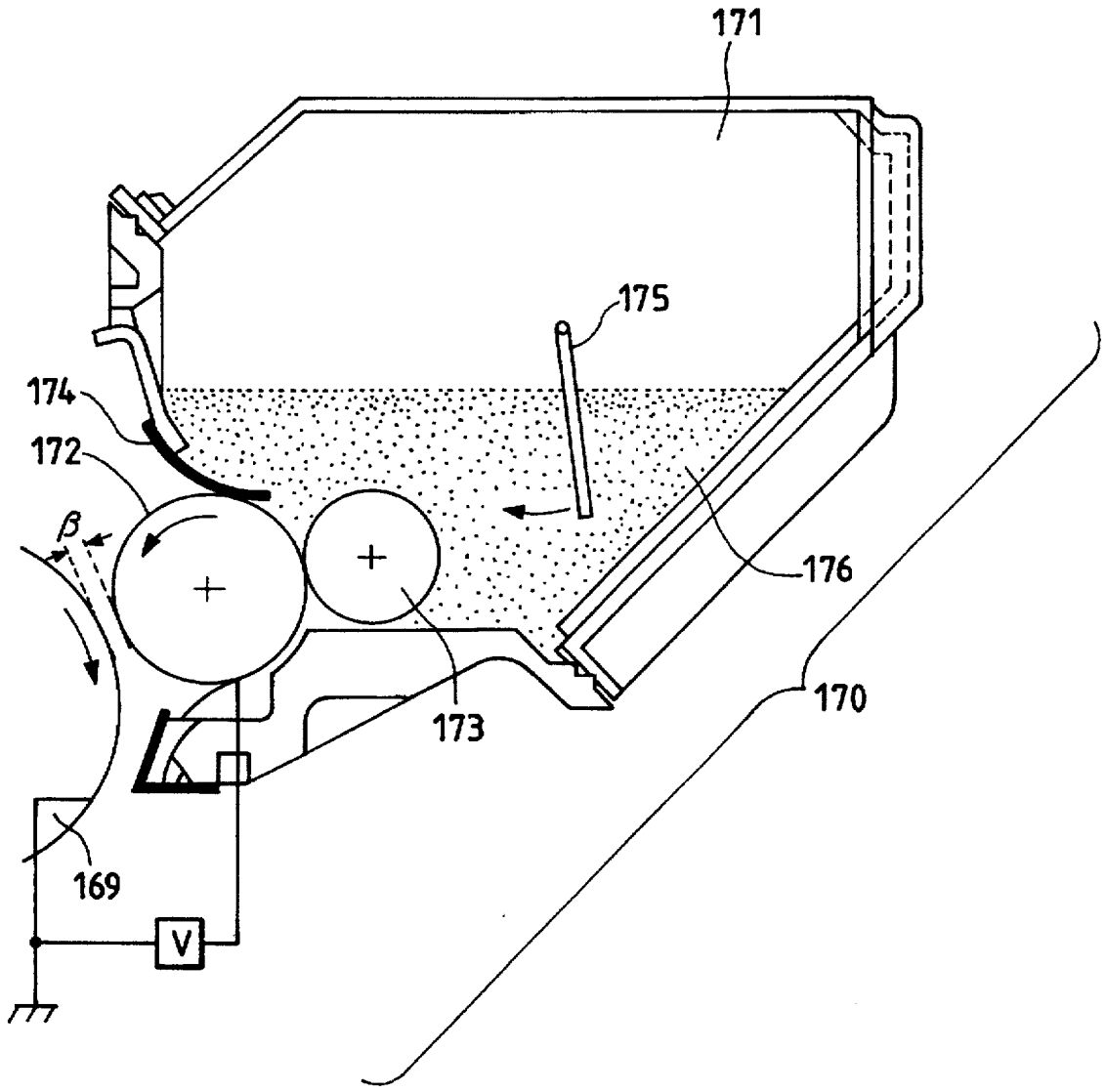
FIG. 12 illustrates schematically the constitution of a developing apparatus of a non-contact one-component non-magnetic development type.
Figure 13:
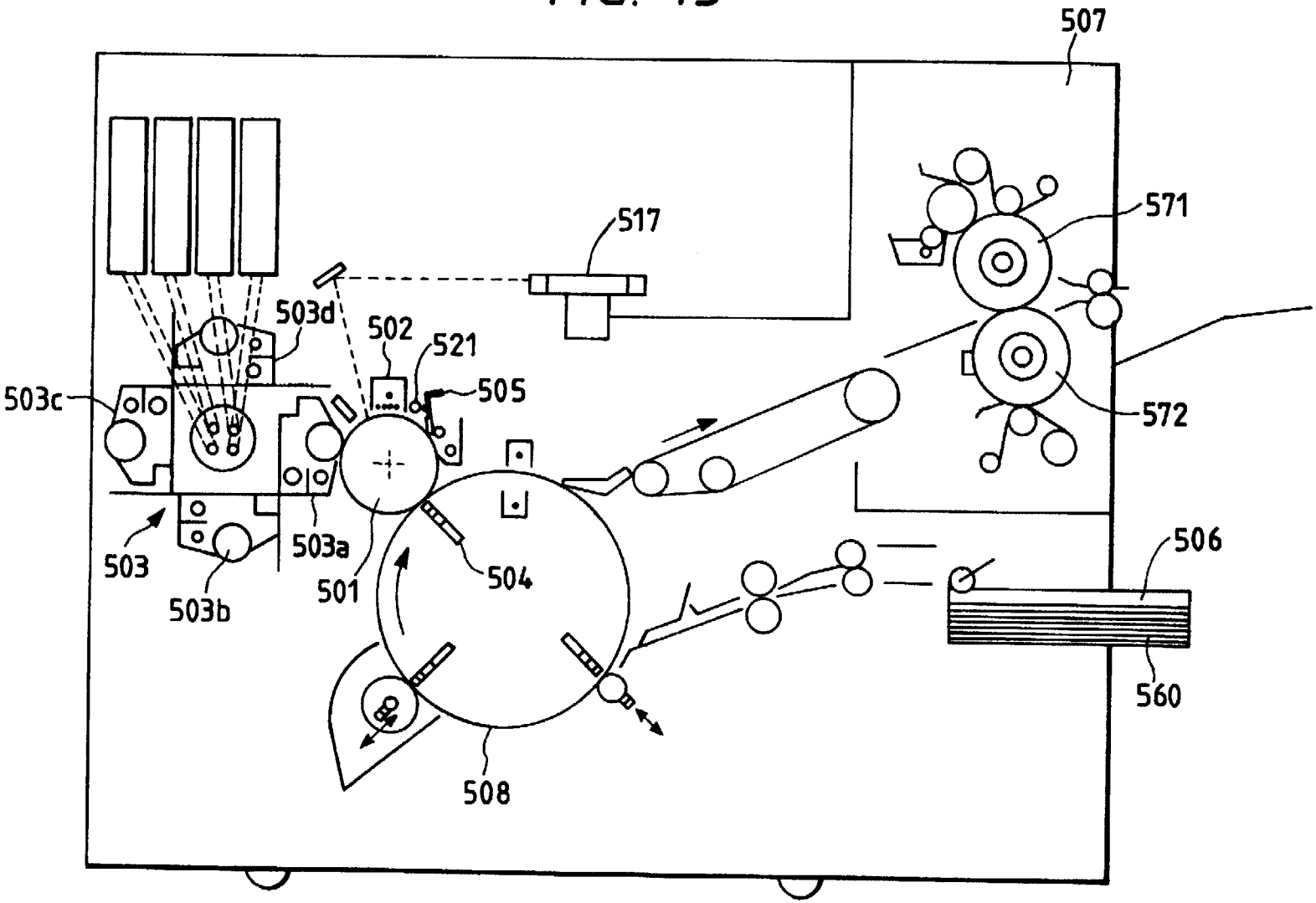
FIG. 13 illustrates schematically a conventional image-forming apparatus.

For these examples the image-forming procedures of Examples 1–15 and Comparative Examples 1–2 were followed except that the developing unit was replaced by a non-magnetic one-component type jumping developing unit as shown in FIG. 12 and the developing operation was conducted under the following developing conditions, using Magenta Toners 21–35 and Cyan Toners 21–35 as listed in Table 2. As a result, no change in the color tone was observed and excellent full color images could be formed after 7,000 runs in each example that were as good as those of Examples 1–15 and Comparative Examples 1–2.

For image development, an urethane blade was made to abut the surface of the photosensitive drum toner layer thickness control member and the between the surface of the photosensitive drum and that of the development sleeve and the thickness of the toner layer on the development sleeve were set to be 400 μm and 130 μm respectively. A rectangularly parallelepipedic alternating pulse voltage with a peak-to-peak voltage of 1,600V and a frequency of 1,800 Hz was applied between the development sleeve and the photosensitive drum to spray the toner on the development sleeve onto the photosensitive drum.

Examples 76 and 77

For these examples, three image-forming units for magenta, cyan and yellow were arranged in the cited order onto an image-forming apparatus used for Examples 61–75 and Comparative Examples 7–8 and full color images were formed as in the case of these examples except that the operation of image transfer was conducted under the following conditions.

A one-component developing agent of a combination of Magenta Toner 21, Cyan Toner 21 and Yellow Toner 21 was used for Example 76, whereas a one-component developing agent of a combination of Magenta Toner 25, Cyan Toner 25 and Yellow Toner 25 was used for Example 77. Photosensitive Drum A was used and the transfer sections were separated by a distance of 80 mm to carry out 7,000 continuous runs at the high temperature and high humidity environment. After the 7,000 runs, no change in the color tone was visually recognized and excellent full color images were formed.

Examples 78 and 79

For these examples, four image-forming units for magenta, cyan, yellow and black were arranged in the cited order onto an image-forming apparatus used for Examples 61–75 end Comparative Examples 7–8 and full color images were formed as in the case of these examples except that the operation of image transfer was conducted under the following conditions.

A one-component developing agent of a combination of Magenta Toner 21, Cyan Toner 21, Yellow Toner 21 and Black Toner 21 was used for Example 78, whereas a one-component developing agent of a combination of Magenta Toner 25, Cyan Toner 25, Yellow Toner 25 and Black Toner 25 was used for Example 79. Photosensitive Drum A was used and the transfer sections were separated by a distance of 80 mm to carry out 7,000 continuous runs at the high temperature and high humidity environment. After the 7,000 runs, no change in the color tone was visually recognized and excellent full color images were formed.

Additionally, images were formed in an environment of ordinary temperature and humidity of 23° C. and 60% Rh under the following image transfer conditions to find that excellent full color images were formed after 7,000 continuous runs.

For image transfer, a first transfer bias voltage for a transfer current of 15 μA and a transfer voltage of +4 kV was applied to the first image-forming unit or the magenta unit and a second transfer bias voltage for a transfer current of 15 μA and a transfer voltage of +4.9 kV was applied to the second image-forming unit or the cyan unit, whereas a third transfer bias voltage for a transfer current of 15 μA and a transfer voltage of +5.8 kV was applied to the third image-forming unit or the yellow unit and a fourth transfer bias voltage for a transfer current of 15 μA and a transfer voltage of +6.6 kV was applied to the fourth image-forming unit or the black unit.

Example 80

For this example, the image-forming procedures of Example 78 were followed to produce full color images of cyan, magenta, yellow and black toners except that the developing unit of the black image-forming unit was replaced by a magnetic one-component type jumping developing unit as shown in FIG. 11 and Black Toner 36 was used for it. The result was as good as that of Example 78.

For image development, an urethane blade was made to abut the surface of the photosensitive drum as toner layer thickness control member and a resin-coated sleeve containing a magnet in the inside was used for the development sleeve. The gap between the surface of the photosensitive drum and that of the development sleeve and the thickness of the toner layer on the development sleeve were set to be 300 μm and 160 μm respectively. A rectangular alternating pulse voltage with a peak-to-peak voltage of 1,600V and a frequency of 1,800 Hz was applied between the development sleeve and the photosensitive drum to spray the toner on the development sleeve onto the photosensitive drum.

Examples 81–95 and Comparative Examples 9–10

For these example, the image-forming procedures of Examples 1–15 and Comparative Examples 1–2 were followed except that, in each of the image-forming units, the charging means was replaced by a contacting charger comprising a charging roller carrying a film of nylon resin on the surface of an electroconductive rubber layer of the roller and made to abut the photosensitive drum as shown in FIG. 5 and a contacting one-component type developing unit as shown in FIG. 9 was used with Magenta Toners 21–35 and Cyan Toners 21–35 of Table 2 under the following development conditions and that the cleaning means was removed and the toner remaining on the surface of the photosensitive drum after the transfer operation was collected by the developing unit. 7,000 continuous runs were conducted as in the case of Examples 1–15 and Comparative Examples 1–2 and the image uniformity, the transfer efficiency and the retransfer rate were evaluated to obtain substantially similar results.

Additionally, the charging performance and the image-forming performance were also evaluated as in the case of Examples 41–55 and Comparative Examples 5–6 to obtain substantially similar results.

For the developing unit, a medium-resistance rubber roller made of foamed silicone rubber and having an electric resistance of $5\times10^{22}$cm was used as toner carrier, which was made to abut the surface of the photosensitive drum. The toner carrier was rotated in the sense of rotation of the photosensitive drum on the contact area thereof and eta peripheral rotary speed of 200% of the peripheral rotary speed of the photosensitive drum. A toner application roller was made to contact with the surface of the toner carrier and rotated in the sense opposite to the sense of rotation of the toner carrier on the contact area thereof in order to apply toner onto the toner carrier. A stainless steel blade was made to abut the surface of the photosensitive drum as toner layer thickness control member. Only the DC component of a voltage of −450V was applied as developing bias voltage and as means for collecting the Toner remaining on the photosensitive drum after each image transfer operation.

Examples 96 and 97

For these examples, three image-forming units for magenta, cyan and yellow were arranged in the cited order onto an image-forming apparatus used for Examples 81–95 and full color images were formed as in the case of these examples except that the operation of image transfer was conducted under the following conditions.

A one-component developing agent of a combination of Magenta Toner 21, Cyan Toner 21 and Yellow Toner 21 was used for Example 96, whereas a one-component developing agent of a combination of Magenta Toner 25, Cyan Toner 25 and Yellow Toner 25 was used for Example 97. Photosensitive Drum A was used and the transfer sections were separated by a distance of 80 mm to carry out 7,000 continuous runs at the high temperature and high humidity environment. After the 7,000 runs, no change in the color tone was visually recognized and excellent full color images were formed.

Examples 98 and 99

For these examples, four image-forming units for magenta, cyan, yellow and black were arranged in the cited order onto an image-forming apparatus used for Examples 81–95 and full color images were formed as in the case of these examples except that the operation of image transfer was conducted under the following conditions.

A one-component developing agent of a combination of Magenta Toner 21, Cyan Toner 21, Yellow Toner 21 and Black Toner 21 was used for Example 98, whereas a one-component developing agent of a combination of Magenta Toner 25, Cyan Toner 25, Yellow Toner 25 and Black Toner 25 was used for Example 99. Photosensitive Drum A was used and the transfer sections were separated by a distance of 80 mm to carry out 7,000 continuous runs at the high temperature and high humidity environment. After the 7,000 runs, no change in the color tone was visually recognized and excellent full color images were formed. Example 100

For this example, the image-forming procedures of Example 98 were followed except that Black Toner used in Example 98 was replaced by Black Toner 26 to produce full color images that were as good as those of Example 98.

TABLE 1

| | | Toner shape factor | | Method of toner | Particle size distribution of toner particles: Weight-average particle diameter | Particle size distribution of toner particles: Variation coefficient | Residual monomer content of toner particles | External Additive (Content Per Unit Toner Weight: %) | | |
|---|---|---|---|---|---|---|---|---|---|---|
| Cyan toner | | SF-1 | SF-2 | preparation | (μm) | (%) | (ppm) | | Hydrophobicity (%) | Average diameter (nm) |
| cyan toner 1 | cyan toner particle 1 | 110 | 108 | polymerization | 7.5 | 27 | 140 | hydrophobic silica A (1.5) | 95 | 15 |
| cyan toner 2 | cyan toner particle 2 | 110 | 108 | polymerization | 7.5 | 27 | 2000 | hydrophobic silica A (1.5) | 95 | 15 |
| cyan toner 3 | cyan toner particle 1 | 110 | 108 | polymerization | 7.5 | 27 | 140 | hydrophobic silica B (1.5) | 87 | 20 |

TABLE 1-continued

| Cyan toner | | Toner shape factor SF-1 | Toner shape factor SF-2 | Method of toner preparation | Particle size distribution of toner particles: Weight-average particle diameter (μm) | Particle size distribution of toner particles: Variation coefficient (%) | Residual monomer content of toner particles (ppm) | External Additive (Content Per Unit Toner Weight: %) | Hydrophobicity (%) | Average diameter (nm) |
|---|---|---|---|---|---|---|---|---|---|---|
| cyan toner 4 | cyan toner particle 1 | 110 | 108 | polymerization | 7.5 | 27 | 140 | hydrophobic silica C (1.5) | 55 | 16 |
| cyan toner 5 | cyan toner particle 1 | 110 | 108 | polymerization | 7.5 | 27 | 140 | hydrophobic silica A (1.0) | 95 | 15 |
| | | | | | | | | hydrophobic silica D (1.0) | 94 | 70 |
| cyan toner 6 | cyan toner particle 1 | 110 | 108 | polymerization | 7.5 | 27 | 140 | hydrophobic silica E (1.0) | 91 | 100 |
| | | | | | | | | hydrophobic silica F (1.0) | 90 | 110 |
| cyan toner 7 | cyan toner particle 1 | 110 | 108 | polymerization | 7.5 | 27 | 140 | hydrophobic silica A (1.0) | 95 | 15 |
| | | | | | | | | hydrophobic silica G (1.0) | 90 | 140 |
| cyan toner 8 | cyan toner particle 1 | 110 | 108 | polymerization | 7.5 | 27 | 140 | hydrophobic silica A (1.0) | 95 | 15 |
| | | | | | | | | hydrophobic silica H (1.0) | 93 | 26 |
| cyan toner 9 | cyan toner particle 1 | 110 | 108 | polymerization | 7.5 | 27 | 140 | hydrophobic silica C (1.0) | 55 | 16 |
| | | | | | | | | hydrophobic silica D (1.0) | 94 | 70 |
| cyan toner 10 | cyan toner particle 10 | 175 | 136 | crushing | 7.9 | 32 | 200 | hydrophobic silica A (1.5) | 95 | 15 |
| cyan toner 11 | cyan toner particle 11 | 191 | 161 | crushing | 7.5 | 28 | 300 | hydrophobic silica A (1.5) | 95 | 15 |
| cyan toner 12 | cyan toner particle 12 | 170 | 130 | crushing | 7.4 | 28 | 110 | hydrophobic silica A (1.5) | 95 | 15 |
| cyan toner 13 | cyan toner particle 13 | 171 | 160 | crushing | 7.0 | 38 | 200 | hydrophobic silica A (1.5) | 95 | 15 |
| cyan toner 14 | cyan toner particle 14 | 175 | 136 | crushing | 7.9 | 38 | 200 | hydrophobic silica A (1.5) | 95 | 15 |
| cyan toner 15 | cyan toner particle 15 | 175 | 136 | crushing | 7.9 | 32 | 1800 | hydrophobic silica A (1.5) | 95 | 15 |

TABLE 2

| Cyan toner | | Toner shape factor SF-1 | Toner shape factor SF-2 | Method of toner preparation | Particle size distribution of toner particles: Weight-average particle diameter (μm) | Particle size distribution of toner particles: Variation coefficient (%) | Residual monomer content of toner particles (ppm) | External additive (Content per Unit Toner Weight: %) | Hydrophobicity (%) | Average diameter (nm) |
|---|---|---|---|---|---|---|---|---|---|---|
| cyan toner 21 | cyan toner particle 1 | 110 | 108 | polinerization | 7.5 | 27 | 140 | hydrophobic silica A (2.0) | 95 | 15 |
| cyan toner 22 | cyan toner particle 2 | 110 | 108 | polinerization | 7.5 | 27 | 2000 | hydrophobic silica A (2.0) | 95 | 15 |
| cyan toner 23 | cyan toner particle 1 | 110 | 108 | polinerization | 7.5 | 27 | 140 | hydrophobic silica B (2.0) | 87 | 20 |
| cyan toner 24 | cyan toner particle 1 | 110 | 108 | polinerization | 7.5 | 27 | 140 | hydrophobic silica C (2.0) | 55 | 16 |
| cyan toner 25 | cyan toner particle 1 | 110 | 108 | polinerization | 7.5 | 27 | 140 | hydrophobic silica A (1.1) | 95 | 15 |
| | | | | | | | | hydrophobic silica D (1.1) | 94 | 70 |
| cyan toner 26 | cyan toner particle 1 | 110 | 108 | polinerization | 7.5 | 27 | 140 | hydrophobic silica E (1.1) | 91 | 100 |
| | | | | | | | | hydrophobic silica F | 90 | 110 |

TABLE 2-continued

| Cyan toner | | Toner shape factor SF-1 | Toner shape factor SF-2 | Method of toner preparation | Particle size distribution of toner particles: Weight-average particle diameter (μm) | Particle size distribution of toner particles: Variation coefficient (%) | Residual monomer content of toner particles (ppm) | External additive (Content per Unit Toner Weight: %) | Hydrophobicity (%) | Average diameter (nm) |
|---|---|---|---|---|---|---|---|---|---|---|
| | | | | | | | | (1.1) | | |
| cyan toner 27 | cyan toner particle 1 | 110 | 108 | polinerization | 7.5 | 27 | 140 | hydrophobic silica A (1.1) | 95 | 15 |
| | | | | | | | | hydrophobic silica G (1.1) | 90 | 140 |
| cyan toner 28 | cyan toner particle 1 | 110 | 108 | polinerization | 7.5 | 27 | 140 | hydrophobic silica A (1.1) | 95 | 15 |
| | | | | | | | | hydrophobic silica H (1.1) | 93 | 26 |
| cyan toner 29 | cyan toner particle 1 | 110 | 108 | polinerization | 7.5 | 27 | 140 | hydrophobic silica C (1.1) | 55 | 16 |
| | | | | | | | | hydrophobic silica D (1.1) | 94 | 70 |
| cyan toner 30 | cyan toner particle 10 | 175 | 136 | crushing | 7.9 | 32 | 200 | hydrophobic silica A (2.0) | 95 | 15 |
| cyan toner 31 | cyan toner particle 11 | 191 | 161 | crushing | 7.5 | 28 | 300 | hydrophobic silica A (2.0) | 95 | 15 |
| cyan toner 32 | cyan toner particle 12 | 170 | 130 | crushing | 7.4 | 28 | 110 | hydrophobic silica A (2.0) | 95 | 15 |
| cyan toner 33 | cyan toner particle 13 | 171 | 160 | crushing | 7.0 | 38 | 200 | hydrophobic silica A (2.0) | 95 | 15 |
| cyan toner 34 | cyan toner particle 14 | 175 | 136 | crushing | 7.9 | 38 | 200 | hydrophobic silica A (2.0) | 95 | 15 |
| cyan toner 35 | cyan toner particle 15 | 175 | 136 | crushing | 7.9 | 32 | 1800 | hydrophobic silica A (2.0) | 95 | 15 |

TABLE 3

| Example | Cyan toner | Magenta toner | Toner shape factor SF-1 | Toner shape factor SF-2 | Photosensitive drum | F/C | Si/C | Image uniformity *1 Inital (mm) | Image uniformity *1 After runs (mm) | Transfer efficiency (%) Initial (mm) | Transfer efficiency (%) After runs (mm) | Retransfer rate (%) | Waste toner collecting service life (No. of sheets) |
|---|---|---|---|---|---|---|---|---|---|---|---|---|---|
| Example 1 | Cyan toner 1 | Magenta toner 1 | 110 | 108 | A | 0.150 | 0 | 80 | 80 | 97 | 95 | 0.7 | 24000 |
| Example 2 | Cyan toner 2 | Magenta toner 2 | 110 | 108 | A | 0.150 | 0 | 80 | 100 | 97 | 91 | 0.7 | 20000 |
| Example 3 | Cyan toner 3 | Magenta toner 3 | 110 | 108 | A | 0.150 | 0 | 80 | 90 | 97 | 94 | 0.8 | 20000 |
| Example 4 | Cyan toner 4 | Magenta toner 4 | 110 | 108 | A | 0.150 | 0 | 80 | 110 | 93 | 91 | 0.9 | 18000 |
| Example 5 | Cyan toner 5 | Magenta toner 5 | 110 | 108 | A | 0.150 | 0 | 80 | 80 | 98 | 98 | 0.5 | 28000 |
| Example 6 | Cyan toner 6 | Magenta toner 6 | 110 | 108 | A | 0.150 | 0 | 80 | 80 | 98 | 97 | 0.5 | 27000 |
| Example 7 | Cyan toner 7 | Magenta toner 7 | 110 | 108 | A | 0.150 | 0 | 80 | 80 | 97 | 97 | 0.8 | 23000 |
| Example 8 | Cyan toner 8 | Magenta toner 8 | 110 | 108 | A | 0.150 | 0 | 80 | 80 | 97 | 92 | 0.8 | 22000 |
| Example 9 | Cyan toner 9 | Magenta toner 9 | 110 | 108 | A | 0.150 | 0 | 80 | 80 | 94 | 91 | 0.8 | 22000 |
| Example 10 | Cyan toner 10 | Magenta toner 10 | 175 | 136 | A | 0.150 | 0 | 100 | 110 | 94 | 90 | 0.9 | 19000 |
| Example 11 | Cyan toner 12 | Magenta toner 12 | 170 | 130 | A | 0.150 | 0 | 90 | 100 | 94 | 91 | 0.9 | 18000 |
| Example 12 | Cyan toner 14 | Magenta toner 14 | 175 | 136 | A | 0.150 | 0 | 100 | 120 | 92 | 89 | 1.0 | 17000 |
| Example 13 | Cyan toner 15 | Magenta toner 15 | 175 | 136 | A | 0.150 | 0 | 100 | 130 | 92 | 87 | 1.0 | 16000 |
| Example 14 | Cyan toner 1 | Magenta toner 1 | 110 | 108 | B | 0 | 0.147 | 90 | 90 | 96 | 94 | 0.8 | 23000 |
| Example 15 | Cyan toner 1 | Magenta toner 1 | 110 | 108 | C | 0 | 0 | 100 | 110 | 94 | 92 | 0.8 | 19000 |
| Comparative Example 1 | Cyan toner 11 | Magenta toner 11 | 191 | 161 | A | 0.150 | 0 | 130 | 140 | 89 | 85 | 3.0 | 8000 |
| Comparative Example 2 | Cyan toner 13 | Magenta toner 13 | 171 | 160 | A | 0.150 | 0 | 130 | 140 | 89 | 86 | 2.1 | 9000 |

*1: The distance between the transfer sections when a change in the color toner was visually recognized in the image.

TABLE 4

| | | | Toner shape factor | | Photosensitive drum | | | Image uniformity *1 | | Transfer efficiency (%) | | | | |
|---|---|---|---|---|---|---|---|---|---|---|---|---|---|---|
| | Cyan toner | Magenta toner | SF-1 | SF-2 | | F/C | Si/C | Initial (mm) | after runs (mm) | Initial (mm) | after runs (mm) | Retransfer rate (%) | Charging performance | Image-forming performance |
| Example 41 | Cyan toner 1 | Magenta toner 1 | 110 | 108 | D | 0.154 | 0 | 80 | 80 | 97 | 96 | 0.7 | A | A |
| Example 42 | Cyan toner 2 | Magenta toner 2 | | | D | 0.154 | 0 | 80 | 90 | 97 | 93 | 0.7 | B | B |
| Example 43 | Cyan toner 3 | Magenta toner 3 | 110 | 108 | D | 0.154 | 0 | 80 | 90 | 97 | 95 | 0.8 | A | A |
| Example 44 | Cyan toner 4 | Magenta toner 4 | 110 | 108 | D | 0.154 | 0 | 80 | 100 | 93 | 91 | 0.9 | B | B |
| Example 45 | Cyan toner 5 | Magenta toner 5 | 110 | 108 | D | 0.154 | 0 | 80 | 80 | 98 | 98 | 0.5 | A | A |
| Example 46 | Cyan toner 6 | Magenta toner 6 | 110 | 108 | D | 0.154 | 0 | 80 | 80 | 98 | 98 | 0.5 | A | A |
| Example 47 | Cyan toner 7 | Magenta toner 7 | 110 | 108 | D | 0.154 | 0 | 80 | 80 | 97 | 97 | 0.8 | A | A |
| Example 48 | Cyan toner 8 | Magenta toner 8 | 110 | 108 | D | 0.154 | 0 | 80 | 80 | 97 | 97 | 0.8 | A | A |
| Example 49 | Cyan toner 9 | Magenta toner 9 | 110 | 108 | D | 0.154 | 0 | 80 | 80 | 94 | 92 | 0.8 | B | A |
| Example 50 | Cyan toner 10 | Magenta toner 10 | 175 | 136 | D | 0.154 | 0 | 100 | 110 | 94 | 92 | 0.9 | B | B |
| Example 51 | Cyan toner 12 | Magenta toner 12 | 170 | 130 | D | 0.154 | 0 | 90 | 100 | 94 | 92 | 0.9 | B | B |
| Example 52 | Cyan toner 14 | Magenta toner 14 | 175 | 136 | D | 0.154 | 0 | 100 | 110 | 92 | 90 | 1.0 | B | B |
| Example 53 | Cyan toner 15 | Magenta toner 15 | 175 | 136 | D | 0.154 | 0 | 100 | 120 | 92 | 89 | 1.0 | B | B |
| Example 54 | Cyan toner 1 | Magenta toner 1 | 110 | 108 | E | 0 | 0.142 | 90 | 90 | 96 | 95 | 0.8 | A | A |
| Example 55 | Cyan toner 1 | Magenta toner 1 | 110 | 108 | F | 0 | 0 | 100 | 110 | 94 | 93 | 0.8 | B | A |
| Comparative Example 5 | Cyan toner 11 | Magenta toner 11 | 191 | 161 | D | 0.154 | 0 | 130 | 140 | 89 | 86 | 3.0 | C | C |
| Comparative Example 6 | Cyan toner 13 | Magenta toner 13 | 171 | 160 | D | 0.154 | 0 | 130 | 140 | 89 | 87 | 2.1 | C | C |

*1: The distance between the transfer sections when a change in the color tone was visually recognized in the image.

What is claimed is:

1. An image-forming method comprising the steps of delivering a transfer-receiving medium to a first image-forming unit, forming a first toner image by a first image-forming means of the first image-forming unit, transferring the first toner image onto the transfer-receiving medium at a first transfer section of the first image-forming unit with a first transfer bias applied, delivering the transfer-receiving medium to a second image-forming unit, forming a second toner image by a second image-forming means of the second image-forming unit, transferring the second toner image onto the transfer-receiving medium carrying the first toner image at a second transfer section of the second image-forming unit with a second transfer bias applied, fixing the first toner image and the second toner image transferred on the transfer-receiving medium by a fixing means, wherein the length of the transfer-receiving medium in the direction in which the transfer-receiving medium is conveyed is larger than the spacing between the first image-transfer section and the second image-transfer section, the intensity of the second transfer bias is different from the intensity of the first transfer bias, and a first toner for forming the first toner image and a second toner for forming the second toner image both have shape factors of SF-1 ranging from 100 to 180 and SF-2 ranging from 100 to 140.

2. The method according to claim 1, wherein the spacing between the first image-transfer section and the second image-transfer section is not larger than 110 mm.

3. The method according to claim 1, wherein the spacing between the first image-transfer section and the second image-transfer section is not larger than 100 mm.

4. The method according to claim 1, wherein the second transfer bias is set to be higher than that of the first transfer bias and in a polarity opposite to the electrification polarity of the second toner.

5. The method according to claim 1, wherein the first toner and the second toner each have the shape factors of SF-1 ranging from 100 to 160 and SF-2 ranging from 100 to 135.

6. The method according to claim 1, wherein the first toner and the second toner each have the shape factors of SF-1 ranging from 100 to 140 and SF-2 ranging from 100 to 120.

7. The method according to claim 1, wherein the first toner and the second toner each are particulate toner produced through the steps of melting, blending, and pulverizing a toner material containing at least a binder resin and a coloring agent, and sphering the resulting pulverized toner.

8. The method according to claim 1, wherein the first toner and the second toner each are particulate toner produced by polymerizing a monomer composition containing at least a polymerizable monomer and a coloring agent.

9. The method according to claim 8, wherein the particulate toner is produced by suspension polymerization, dispersion polymerization, or emulsion polymerization.

10. The method according to claim 9, wherein the particulate toner is produced by suspension polymerization.

11. The method according to claim 1, wherein the first toner and the second toner each contain a residue of the monomer at a content of not higher than 1000 ppm.

12. The method according to claim 1, wherein the first toner and the second toner each contain a residue of the monomer at a content of not higher than 500 ppm.

13. The method according to claim 1, wherein the first toner and the second toner each have a weight-average particle diameter ranging from 1 to 9 μm, and exhibit a variation coefficient (A) of not larger than 35% in number distribution.

14. The method according to claim 1, wherein the first toner and the second toner each are a mixture of toner particles and a fine powdery matter having hydrophobicity degree of not lower then 60%.

15. The method according to claim 1, wherein the first toner and the second toner each are a mixture of toner particles and a fine powdery matter having hydrophobicity degree of not lower than 90%.

16. The method according to claim 1, wherein the first toner and the second toner each are a mixture of toner particles a hydrophobicity-imparted inorganic fine powdery matter a, and a hydrophobicity-imparted silicon compound b having a diameter larger than the inorganic fine powdery matter a.

17. The method according to claim 16, wherein the inorganic fine powdery matter a has an average particle diameter ranging from 3 to 90 nm, and the silicon compound b has an average particle diameter ranging from 30 to 120 nm.

18. The method according to claim 16, wherein the inorganic fine powdery matter a has a hydrophobicity degree of not lower than 60%.

19. The method according to claim 16, wherein the inorganic fine powdery matter a has a hydrophobicity degree of not lower than 90%.

20. The method according to claim 16, wherein the first toner and the second toner each contain the inorganic fine powdery matter a in an amount ranging from 0.05 to 3.5 parts by weight, and the silicon compound b in an amount ranging from 0.05 to 3.5 parts by weight per 100 parts by weight of the toner particles.

21. The method according to claim 1, wherein the first toner image is formed in the first image-forming means through the steps of electrifying primarily a first latent image holding member for holding a first electrostatic latent image by a first electrifying means, forming a first electrostatic latent image by a first latent image-forming means on the first latent image holding member thus primarily electrified, and developing the first electrostatic latent image with a first toner stored in a first development means; and the second toner image is formed in the second image-forming means through the steps of electrifying primarily a second latent image holding member for holding a second electrostatic latent image by a second electrifying means, forming a second electrostatic latent image by a second latent image-forming means on the second latent image holding member thus primarily electrified, and developing the second electrostatic latent image with a second toner stored in a second development means.

22. The method according to claim 21, wherein the first latent image holding member and the second latent image holding member each have fluorine atoms and carbon atoms on the surface of the latent image holding member in a ratio (F/C) ranging from 0.03 to 1.00 as measured by X-ray photoelectron spectroscopy.

23. The method according to claim 21, wherein the first latent image holding member and the second latent image holding member each have silicon atoms and carbon atoms on the surface of the latent image holding member in a ratio (Si/C) ranging from 0.03 to 1.00 as measured by X-ray photoelectron spectroscopy.

24. The method according to claim 21, wherein the first latent image holding member and the second image holding member each are drum shaped photosensitive members having a diameter ranging from 20 to 40 mm.

25. The method according to claim 21, wherein the first electrifying means is a non-contacting electrifying means which electrifies the surface of the first latent image holding member without contacting with the surface thereof, and the second electrifying means is a non-contacting electrifying means which electrifies the surface of the second latent image holding member without contacting with the surface thereof.

26. The method according to claim 25, wherein the non-contacting electrifying means comprises a corona charger.

27. The method according to claim 21, wherein the first electrifying means is a contacting electrifying means which electrifies the surface of the first latent image holding member by contact with the surface thereof, and the second electrifying means is a contacting electrifying means which electrifies the surface of the second latent image holding member by contact with the surface thereof.

28. The method according to claim 27, wherein the contacting electrifying means comprises a roller-shaped electrifying means.

29. The method according to claim 27, wherein the contacting electrifying means comprises a blade-shaped electrifying means.

30. The method according to claim 27, wherein the contacting electrifying means comprises a blush-shaped electrifying means.

31. The method according to claim 30, wherein the brush-shaped electrifying means is a magnetic brush electrifying means comprising an electroconductive sleeve having a magnet in the inside thereof, and a magnetic brush formed from electroconductive magnetic particles on the electroconductive sleeve.

32. The method according to claim 21, wherein the first image-forming means and the second image-forming means each have a contacting development system in the development area in which the thickness of the layer of the developing agent held on the developing agent holding member is larger than the gap between the latent image holding member and the developing agent holding member, and the latent image is developed by bringing the layer of the developing agent into contact with the surface of the latent image holding member.

33. The method according to claim 32, wherein the developing agent is of a two-component type, comprising a toner and a magnetic carrier.

34. The method according to claim 32, wherein the developing agent is of a one-component type, comprising a toner.

35. The method according to claim 32, wherein the first image-forming means and the second image-forming means each have no cleaning means for removing the toner remaining after the toner image transfer on the surface of the latent image holding member between the transfer section and the electrifying section of the electrifying means, and the development means serves also as a cleaning means for recovering the remaining toner and cleaning the surface of the latent image holding member after the transfer.

36. The method according to claim 21, wherein the first image-forming means and the second image-forming means each have a non-contacting development system in the development area, in which the thickness of the layer of the developing agent held on the developing agent holding means is smaller than the gap between the latent image holding member and the developing agent holding member, and the latent image is developed by allowing the developing agent to fly from the developing agent holding member onto the surface of the latent image holding member without bringing the layer of the developing agent into contact with the surface of the latent image holding member.

37. The method according to claim 36, wherein the developing agent is of a one-component type, comprising a toner.

38. The method according to claim 1, comprising delivering the transfer-receiving member to a third image-forming unit after the second image transfer before fixation of the image, forming a third toner image by a third image-forming means of the third image-forming unit, transferring the third toner image onto the transfer-receiving medium carrying the first and second toner images at a third transfer section of the third image-forming unit with a third transfer bias applied, and fixing the first, second, and third toner images transferred on the transfer-receiving medium by a fixing means, wherein the length of the transfer-receiving medium in the conveyance direction is larger than the spacing between the first transfer section and the second transfer section; the intensities of the first, second, and third transfer biases are different from each other, and the third toner for forming the third toner image has shape factors of SF-1 ranging from 100 to 180 and SF-2 ranging from 100 to 140.

39. The method according to claim 38, wherein the first toner, the second toner, and the third toner each are any of a magenta toner, a cyan toner and a yellow toner, and a full-color image is formed by combination of the magenta toner, the cyan toner, and the yellow toner.

40. The method according to claim 1, comprising delivering the transfer-receiving member to a third image-forming unit after the second image transfer before fixation of the image, forming a third toner image by a third image-forming means of the third image-forming unit, transferring the third toner image onto the transfer-receiving medium carrying the first and second toner images at a third transfer section of the third image-forming unit with a third transfer bias applied, delivering the transfer-receiving member to a fourth image-forming unit, forming a fourth toner image by a fourth image-forming means of the fourth image-forming unit, transferring the fourth toner image onto the transfer-receiving medium carrying the first, second, and third toner images at a fourth transfer section of the fourth image-forming unit with a fourth transfer bias applied, and fixing the first, second, third, and fourth toner images transferred on the transfer-receiving medium by a fixing means, wherein the length of the transfer-receiving medium in the conveyance direction is larger than the spacing between the second transfer section and the third transfer section; the length of the transfer-receiving medium in the conveyance direction is larger than the spacing between the third transfer section and the fourth transfer section; the intensities of the first, second, third, and fourth transfer biases are different from each other, and the third, and fourth toners image each have shape factors of SF-1 ranging from 100 to 180 and SF-2 ranging from 100 to 140.

41. The method according to claim 40, wherein the first toner, the second toner, the third toner, and the fourth toner are respectively a magenta toner, a cyan toner, a yellow toner, or a black toner, and a full-color image is formed by combination of the magenta toner, the cyan toner, the yellow toner, and the black toner.

* * * * *

UNITED STATES PATENT AND TRADEMARK OFFICE

CERTIFICATE OF CORRECTION

PATENT NO. : 5,698,354

DATED : December 16,1997

INVENTOR(S) : UGAI et al.

It is certified that error appears in the above-identified patent and that said Letters Patent is hereby corrected as shown below:

Column 1

Line 31, "end" should read --and--.
Line 63, "e" should read --a--.

Column 2

Line 8, "without" should read --without being--.
Line 42, "The" should read --the--.

Column 3

Line 22, "section" should read --section,--.

Column 4

Line 15, "image forming-unit" should read --image-forming unit--.

Column 5

Line 9, "has" should read --have--.
Line 31 , "140." should read --140--.

Column 7

Line 4, "=to" should read --to--
Line 45, "Weals" should read --Waals--.
Line 46, "The" should read --the--.
Line 58, "e" should read --a--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 8

Line 14, "e" should read --a--.
Line 51, "ie" should read --is--.
Line 58, "damage" should read --damages--.

Column 9

Line 25, "to" should read --on--.

Column 10

Line 8, "The" should read --the--.
Line 16, "end/or" should read --and/or--.
Line 19, "polyproppylenes," should read --polypropylenes,--.
Line 40, "end" should read --and--.

Column 11

Line 32, "polyesterst" should read --polyesters,-- and "poiyethylenes" should read --polyethylenes,--.

Column 13

Line 48, "yellow, mis," should read --the toners,--.
Line 55, "isoindrlnone," should read --isoindrinone,-- and "anthraguinone," should read --authraquinone--.
Line 61, "authragu-" should read --authraqu---.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 14

Line 6, "may" should read --may be--.
Line 25, "naphtholc" should read --naphthoic--.
Line 39, "is" should read --is to--.
Line 46, "1,1'-azobis(cyclchexane -1-" should read --1,1'-azobis(cyclohexane -1--.
Line 66, "phosphate." (first occurrence) should read --phosphate,--.

Column 15

Line 24, "tetredecylsufate," should read --tetradecylsulfate,--.
Line 41, "particulate.state" should read --particulate state--.

Column 16

Line 6, "dissolve" should read --dissolves--.

Column 17

Line 2, "melt-adhesion" should read --melt-adhesion of--.
Line 33, "for" should read --to--.
Line 65, "a" should read --an--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 19

Line 1, "which" should be deleted.
Line 21, "material" should read --material for--.
Line 56, "n-hexadecvltrimethoxysllane," should read --n-hexadecyltrimethoxysilane,--.

Column 20

Line 36, "SET" should read --BET--.
Line 64, "hexamethyldisilasane," should read --hexamethyldisidazane,--.
Line 67, "allylphenyldlchorosilane," should read --allylphenyldichlosilane,--.

Column 21

Line 3, "β-choroethyltrichlorosilane," should read --β-chloroethyltrichlorosilane,--.
Line 14, "diethylaminoproyltrimethoxysilane," should read --dimethylaminopropyltrimethyoxysilane,--.
Line 15, "diethylaminoproyltrimethoxysilane," should read --dimethylaminopropyltrimethyoxysilane,--.
Line 17, "dibutylaminopropyltrimethonysilene," should read --dibutylaminopropyltrimethonysilane,--.
Line 19, "ldimethoxysilane." should read --ldimethoxysilane,--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 23

Line 25, "hither"" should read --higher--.

Column 25

Line 8, "an" should read --a--.
Line 52, "preferable" should read --preferably--.

Column 26

Line 12, "ill" should read --in--.

Column 27

Line 46, "a" should read --an--.

Column 28

Line 65, "spars" should read--apart--.

Column 29

Line 25, "153" should read --123--.
Line 51, "attach" should read --attached--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 30

Line 21, "is" (second occurrence) should be deleted.
Line 64, "To" should read --to--.

Column 31

Line 36, "lane" should read --line--.

Column 32

Line 12, "are" should read --is--.
Line 37, "The" should read --the--.

Column 34

Line 5, "times" should read --time--.

Column 35

Line 52, "thermoserring" should read --thermosetting--.

Column 36

Line 44, "member" should read --member is--.

Column 38

Line 32, "Parts" should read --parts--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 40

Line 19, "To" should read --to--.
Line 32, "Parts" should read --parts--.
Line 42, "Parts" should read --parts--.
Line 55, "ezo" should read --azo--.

Column 41

Line 30, "Parts" should read --parts--.
Line 53, "show" should read --showed--.

Column 42

Line 48, "material. Preparation" should read --material. ¶ Preparation--.
Line 52, "n-Burylacrylate" should read --n-Butylacrylate--.
Line 60, "Grams " should read --grams--.
Line 64, "coalposition" should read --composition--.

Column 43

Line 59, "Parts" should read --parts--.

Column 44

Line 28, "Parts" should read --parts--.
Line 38, "Parts" should read --parts--.
Line 41, "Type)," should read --type),--.
Line 42, "seid" should read --sand --.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 46

Line 50, "thickness" should read --thickness of--.

Column 48

Line 29, "monochlorobenzen" should read --monochlorobenzene--.

Column 49

Line 3, "Parts" should read --parts--.
Line 32, "Parts" should read --parts--.
Line 52, "a%" should read --at--.
Line 58, "Of" should read --of--.

Column 50

Line 40, "minutes" should read --minute--.
Line 43, "above described" should read --above-described--.

Column 51

Line 13, "above defined" should read --above-defined--.

Column 52

Line 36, "Transfer" should read --transfer--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 54

Line 64, "Continuous" should read --continuous--.

Column 55

Line 24, "The" should read --the--.
Line 61. "the" should read --the gap--. (1st occurance)

Column 57

Line 40, "5 x $10^{22}$ cm" should read --5 x $10^{5\Omega}$ cm--.
Line 43, "eta" should read --at a--.

Column 58

Line 5, "Toner" should read --toner--.
Line 43, "formed. Example" should read --formed. ¶ Example--.

Column 65

Line 21, "particle" should read --particles,--.

UNITED STATES PATENT AND TRADEMARK OFFICE

CERTIFICATE OF CORRECTION

PATENT NO. : 5,698,354

DATED : December 16, 1997

INVENTOR(S) : UGAI et al.

It is certified that error appears in the above-identified patent and that said Letters Patent is hereby corrected as shown below:

Column 68

Line 26, "toners image" should read --toner images--.

Signed and Sealed this

First Day of September, 1998

*Attest:*

*Attesting Officer*

BRUCE LEHMAN

*Commissioner of Patents and Trademarks*